US011904215B2

(12) United States Patent
Hayden et al.

(10) Patent No.: US 11,904,215 B2
(45) Date of Patent: Feb. 20, 2024

(54) GYMNASTIC TRAINING APPARATUS AND METHODS

(71) Applicant: Max Hayden Enterprises, LLC, Augusta, GA (US)

(72) Inventors: Daniel Hayden, Augusta, GA (US); Tamas Reszeli, Plano, TX (US)

(73) Assignee: Max Hayden Enterprises, LLC, Augusta, GA (US)

( * ) Notice: Subject to any disclaimer, the term of this patent is extended or adjusted under 35 U.S.C. 154(b) by 260 days.

(21) Appl. No.: 16/993,947

(22) Filed: Aug. 14, 2020

(65) Prior Publication Data

US 2021/0093909 A1 Apr. 1, 2021

Related U.S. Application Data

(63) Continuation of application No. PCT/US2019/018614, filed on Feb. 19, 2019.
(Continued)

(51) Int. Cl.
*A63B 5/12* (2006.01)
*A63B 21/00* (2006.01)
*A63B 71/00* (2006.01)

(52) U.S. Cl.
CPC ..... *A63B 5/12* (2013.01); *A63B 21/4035* (2015.10); *A63B 71/0054* (2013.01);
(Continued)

(58) Field of Classification Search
CPC ..... A63C 19/00; A63C 19/05; A63C 19/005; A63B 2244/10; A63B 71/02;
(Continued)

(56) References Cited

U.S. PATENT DOCUMENTS 243,456 A * 6/1881 Medart ..... A63B 5/12 482/25
438,640 A * 10/1890 Reach ..... A63B 5/12 482/25
(Continued)

FOREIGN PATENT DOCUMENTS

CN 2041189 U 7/1989
CN 2071966 U 2/1991
(Continued)

OTHER PUBLICATIONS

STIC search (Year: 2022).*
(Continued)

*Primary Examiner* — Megan Anderson
(74) *Attorney, Agent, or Firm* — COOLEY LLP

(57) ABSTRACT

Athletic, and more particularly gymnastic, training apparatus and methods are disclosed herein. In some embodiments, an apparatus includes a pommel portion of a pommel horse training apparatus, the pommel portion including a plurality of elongate pommel segments. A first pommel segment from the plurality of elongate pommel segments is coupled to a second pommel segment from the plurality of elongate pommel segments. A centerline of the first pommel segment is non-parallel to a centerline of the second pommel segment. The centerline of the first pommel segment is coplanar with the centerline of the second pommel segment.

20 Claims, 31 Drawing Sheets

Related U.S. Application Data

(60) Provisional application No. 62/798,844, filed on Jan. 30, 2019, provisional application No. 62/710,383, filed on Feb. 16, 2018.

(52) U.S. Cl.
CPC ..... *A63B 2209/00* (2013.01); *A63B 2210/50* (2013.01); *A63B 2220/833* (2013.01)

(58) Field of Classification Search
CPC ..... A63B 71/0054; A63B 5/00; A63B 5/02; A63B 5/04; A63B 5/06; A63B 5/08; A63B 5/11; A63B 5/12; A63B 5/16; A63B 5/22; A63B 26/00; A63B 2220/833; A63B 2210/50; A63B 2209/00; A63B 21/4035; A63B 21/00; A63B 21/00047; A63B 21/4029; A63B 4/00; A63B 1/00
USPC ..... 482/25, 51
See application file for complete search history.

(56) References Cited

U.S. PATENT DOCUMENTS 450,186 A * 4/1891 Peterson ..... A63B 5/12 482/25
826,609 A * 7/1906 Reach ..... A63B 5/12 482/25
941,665 A * 11/1909 Thornley ..... A63B 5/12 482/25
1,013,685 A * 1/1912 Reach ..... A63B 5/12 482/25
1,094,823 A * 4/1914 Thornley ..... A63B 5/12 482/25
2,573,125 A * 10/1951 Wilks ..... D06F 55/02 24/511
3,073,595 A * 1/1963 Jones ..... A63G 1/40 472/18
3,339,939 A 9/1967 Bowers
3,379,439 A * 4/1968 Sorenson ..... A63B 69/0064 482/25
3,628,790 A * 12/1971 Gordon ..... A63B 6/00 482/25
3,758,110 A 9/1973 Fenner et al.
3,767,191 A * 10/1973 Riley ..... A63B 22/20 482/25
3,813,096 A * 5/1974 Welch ..... A63B 23/032 482/11
3,912,262 A 10/1975 Micko
D244,788 S * 6/1977 Burgess ..... D23/262
4,105,201 A * 8/1978 L'Ecuyer ..... A63B 4/00 482/34
4,126,308 A * 11/1978 Crumley ..... A63B 22/20 482/25
4,149,712 A 4/1979 Murphy
4,203,525 A * 5/1980 Okubo ..... A63B 5/12 482/25
4,272,073 A * 6/1981 Grosser ..... A63B 4/00 482/34
4,410,174 A * 10/1983 Hamada ..... A63B 21/00047 482/25
4,674,330 A * 6/1987 Ellis ..... A61B 5/224 73/379.03
4,955,367 A * 9/1990 Homsy ..... A61H 1/02 433/215
4,957,444 A 9/1990 Armen
5,035,420 A * 7/1991 Beeuwkes, III ..... A61H 1/02 482/11
5,087,030 A * 2/1992 Jones ..... A63C 19/10 62/235
5,267,374 A * 12/1993 Drake ..... B65D 33/1675 24/30.5 R
5,746,703 A * 5/1998 Levatino ..... A63B 23/032 482/121
6,001,045 A * 12/1999 Gift ..... A63B 5/11 482/28
6,050,961 A * 4/2000 Arnold ..... A61B 5/228 600/595
6,129,651 A 10/2000 Denaro
6,340,334 B1 * 1/2002 Olsen ..... A63C 19/005 472/92
6,517,466 B2 * 2/2003 Eyman, Jr. ..... A63B 4/00 482/25
6,679,811 B2 * 1/2004 Chen ..... A63B 71/0054 482/29
6,932,750 B1 * 8/2005 Dorner ..... A63B 23/12 482/141
7,311,617 B2 * 12/2007 Langhorn ..... A63B 63/00 273/400
7,347,806 B2 * 3/2008 Nakano ..... A63B 24/00 434/247
7,731,594 B1 * 6/2010 Hansen ..... A63C 19/005 472/93
D635,623 S * 4/2011 Wright ..... A63B 21/028 D21/686
8,286,280 B1 * 10/2012 Matos ..... A47D 11/005 5/2.1
D731,611 S * 6/2015 Klein ..... D21/826
9,272,174 B2 3/2016 Carter et al.
9,278,242 B2 * 3/2016 Winn ..... A63B 5/12
9,283,419 B2 * 3/2016 Chen ..... A63B 71/022
9,351,667 B2 * 5/2016 Barlow ..... A61B 5/4088
9,801,365 B2 * 10/2017 Constantine ..... A01K 97/18
9,999,488 B1 * 6/2018 Morgan ..... A61C 19/05
D844,731 S * 4/2019 Chin ..... A63B 23/032 D21/826
10,327,629 B2 * 6/2019 Lee ..... A61B 1/32
10,434,355 B1 * 10/2019 Kipnis ..... A63B 21/4031
10,499,802 B1 * 12/2019 Chen ..... A61B 1/24
10,925,809 B2 * 2/2021 Sieffert ..... A61H 9/0078
11,148,002 B2 * 10/2021 Wittenbrink ..... A63B 6/00
11,351,440 B2 * 6/2022 Feldman ..... A63B 71/0054
2004/0242347 A1 * 12/2004 Langhorn ..... A63B 63/00 473/402
2005/0266939 A1 * 12/2005 Purcell ..... A63B 69/0002 473/504
2006/0276305 A1 12/2006 Schank
2007/0287598 A1 * 12/2007 Christensen, III ..... A61H 1/02 482/11
2007/0293373 A1 * 12/2007 Nakanishi ..... A63B 69/04 482/51
2008/0009395 A1 * 1/2008 Tseng ..... A63B 69/04 472/95
2008/0020900 A1 * 1/2008 Wang ..... A63B 22/14 482/25
2008/0146357 A1 * 6/2008 Hsu ..... A61H 1/001 472/59
2008/0153673 A1 * 6/2008 Lin ..... A63B 69/04 482/142
2008/0293554 A1 * 11/2008 Chou ..... A63B 69/04 482/142
2009/0011393 A1 * 1/2009 Lin ..... A63B 26/003 434/247
2009/0093343 A1 * 4/2009 Gallus ..... A63B 4/00 482/34
2011/0012310 A1 * 1/2011 Anderton ..... A63C 19/005 273/440
2011/0143896 A1 6/2011 Senegal
2011/0251025 A1 10/2011 Harker
2013/0172160 A1 * 7/2013 Poole ..... A63B 23/0458 482/129
2014/0011641 A1 * 1/2014 Winn ..... A63B 5/12 482/25
2014/0360104 A1 * 12/2014 Jannotti Newlands ..... G09F 23/02 52/741.1
2015/0231485 A1 * 8/2015 Ton ..... A63C 19/005 472/93

(56) References Cited

U.S. PATENT DOCUMENTS

| | | | | |
|---|---|---|---|---|
| 2015/0251051 | A1* | 9/2015 | Mohammed | A63B 23/032 482/11 |
| 2016/0074693 | A1* | 3/2016 | Henry | A63B 21/4033 482/141 |
| 2016/0250508 | A1* | 9/2016 | Todokoro | F16B 7/0446 482/35 |
| 2017/0134712 | A1* | 5/2017 | Remer | A63C 19/005 |
| 2017/0165522 | A1* | 6/2017 | James | A63B 71/0669 |
| 2017/0174393 | A1* | 6/2017 | Casey | A63B 55/00 |
| 2017/0296866 | A1* | 10/2017 | Paquin | A61H 1/0292 |
| 2017/0361144 | A1* | 12/2017 | Pallesen | A63B 21/4017 |
| 2018/0085623 | A1* | 3/2018 | Flook | A63B 21/0557 |
| 2018/0178052 | A1* | 6/2018 | Rella | A63B 71/0054 |
| 2018/0353838 | A1* | 12/2018 | Padovan | A63B 71/085 |
| 2019/0022464 | A1* | 1/2019 | Brieu | A63B 26/00 |
| 2019/0168051 | A1* | 6/2019 | Hausheer | A63B 5/16 |
| 2019/0255373 | A1* | 8/2019 | Hayden | A63B 5/12 |
| 2019/0288373 | A1* | 9/2019 | Chen | H01Q 1/2283 |
| 2020/0188753 | A1* | 6/2020 | Kwiatek | A63B 67/06 |
| 2020/0218889 | A1* | 7/2020 | Masui | G06V 40/23 |
| 2022/0110716 | A1* | 4/2022 | Lin | A61C 7/02 |
| 2022/0126153 | A1* | 4/2022 | Sharp | A63B 23/047 |

FOREIGN PATENT DOCUMENTS

| | | | |
|---|---|---|---|
| CN | 102641569 | A | 8/2012 |
| CN | 103157235 | A | 6/2013 |
| CN | 103751946 | A | 4/2014 |
| CN | 107930001 | A | 4/2018 |
| GB | 2446947 | A | 8/2008 |
| WO | WO-2019161403 | A1 | 8/2019 |

OTHER PUBLICATIONS

International Search Report and Written Opinion for International Application No. PCT/US2019/018614, dated May 6, 2019, 9 pages.

Norberts, Ultra Dome Pommel Horse Trainer, [Online], Retrieved from the Internet: <https://www.amazon.com/Ultra-Dome-Pommel-Horse-Trainer/dp/B0068R5612>, Retrieved from the Internet on Jan. 31, 2018, 2 pages.

Gymnastic World, Mushroom Trainer—Gymnastics Equipment Boys Mens Pommel Horse Olympics Circles, [Online], Retrieved from the Internet: <https://www.amazon.co.uk/MUSHROOM-TRAINER-GYMNASTICS-Equipment-OLYMPICS/dp/B00JXILGSA>, Retrieved from the Internet on Jan. 31, 2018, 1 page.

By GMR, Inc., Gymnastic Equipment & Mats, Pommel Top Trainer with 3 Pommels (Pommel Horse), [Online], Retrieved from the Internet: <http://www.ten-o.com/Pommel-Top-Trainer-with-3-Pommels,2873.html?b=d*393>, Retrieved from the Internet on Feb. 7, 2018, 1 page.

Team Sports, Dome/Mushroom Trainers, [Online], Retrieved from the Internet: <https://gymnastics-equipment.com/gym-specials/dome-trainers.html>, Retrieved from the Internet on: Feb. 21, 2019, 2 pages.

Gym-Tech, "PE & Gymnastics Equipment," GYM-TECH.com, Jan. 11, 2018, [online], Retrieved from the Internet: <URL: https://web.archive.org/web/20180111143558/http:/www.gym-tech.com/PE_and_gymnastics_equipment.htm>, 7 pages.

TheClassroom.co, "Box of Tricks Gym Movement Table—Box Top," Viewed on Apr. 2, 2019, [online], Retrieved from the Internet: <URL: https://www.theclassroom.co/gymnasium-equipment/box-of-tricksbox-top.html>, 1 page.

Taylor, J., "Baby-Proofing 101: How to Baby-Proof Your Fireplace," Jul. 22, 2017, [online], Retrieved from the Internet: <URL: https://www.momtricks.com/baby-proofing/how-tobaby-proof-your-fireplace/>, 7 pages.

Team Sports, "Ultra Dome Pommel Top Only (wood disk, 3-pommels)—Free Shipping," Jan. 13, 2017, [online], Retrieved from the Internet: <URL: https://web .archive.org/web/20170113075154/https:/gymnastics-equipment.com/gym-specials/ultra-dome-pommel-top-only-wood-disk-3-pommels.html>, 2 pages.

Extended European Search Report for European Application No. 19753999.2, dated Nov. 3, 2021, 7 pages.

* cited by examiner

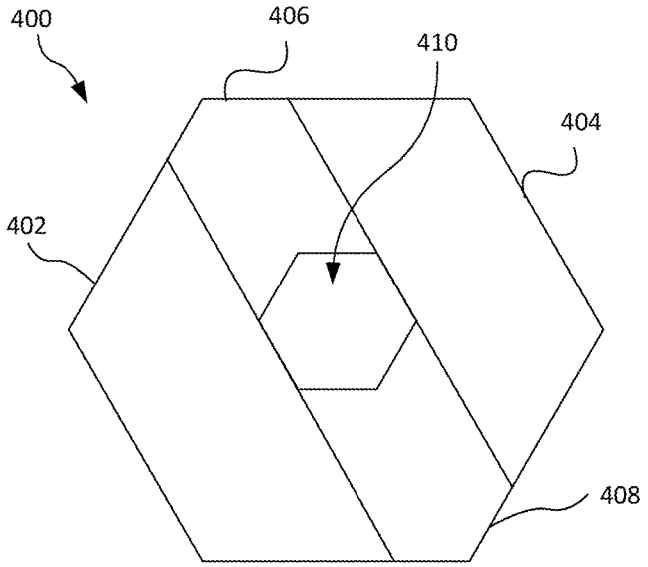
FIG. 41
FIG. 41A
FIG. 41B
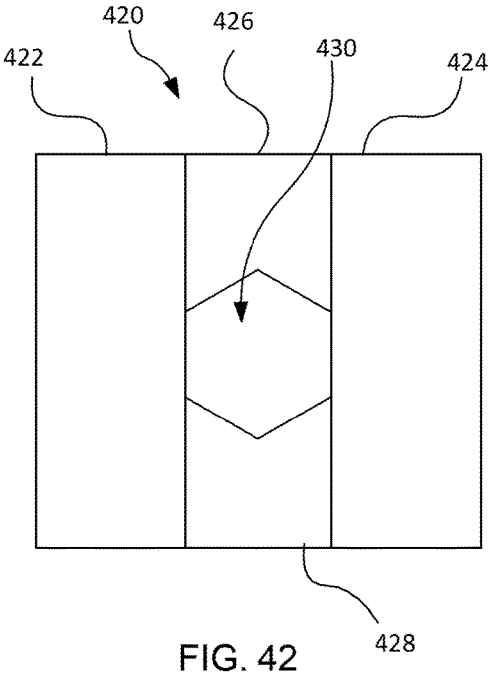
FIG. 42
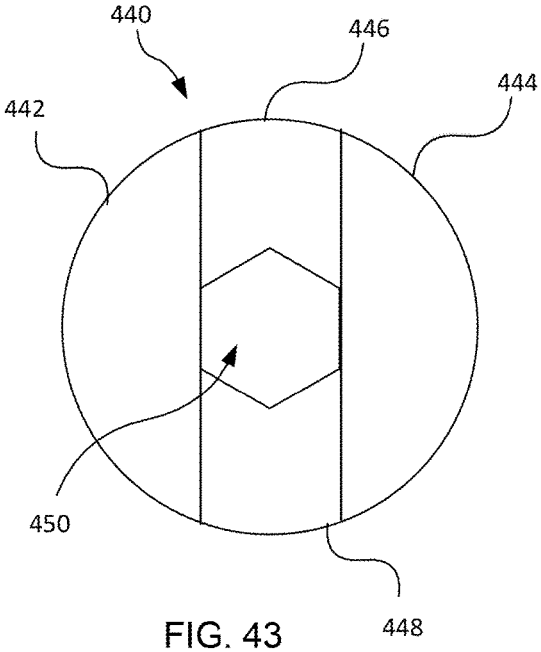
FIG. 43
FIG. 42A
FIG. 43A
FIG. 42B
FIG. 43B

GYMNASTIC TRAINING APPARATUS AND METHODS

CROSS-REFERENCE TO RELATED APPLICATIONS

This application is a continuation of International patent application Ser. No. PCT/US2019/018614, filed on Feb. 19, 2019, entitled "Gymnastic Training Apparatus and Methods," which claims priority to and the benefit of U.S. provisional application Ser. No. 62/798,844, filed on Jan. 30, 2019, entitled "Gymnastic Training Apparatus and Methods," and U.S. provisional application Ser. No. 62/710,383, filed on Feb. 16, 2018, entitled "Gymnastic Training Apparatus and Methods," the disclosures of which are incorporated herein by reference in their entireties.

BACKGROUND

This application relates generally to athletic training apparatus and methods, more specifically to gymnastics training apparatus and methods of use, and still more specifically to pommel horse (also known as a side horse or gymnastics horse) training apparatus and methods.

Known pommel horses used in gymnastics include a saddle and two parallel spaced-apart handles or pommels extended from an upper surface of the saddle. In the United States, rule changes in the Men's Junior Olympic Program were implemented after the 2016 Olympic Games, which changes required lower level gymnastic competitors to train and compete on the pommel horse leather saddle without the pommels. Under the revised rule, a gymnast is not permitted to use the pommels in levels 4, 5, 6, 7 or 8 in competition, but instead must wait until level 9 to use the pommels. One practical effect of this rule change was that a gymnast may not train on the pommels for a minimum of six to eight years, instead likely training only on known mushroom style training devices and the leather saddle of the horse. For some athletes, the delay may be even longer depending on how much time it took for the gymnast to compete in his first competition. In addition, some gymnasts compete two or three years in each of a few levels and that makes it even longer before such gymnasts touch the pommels. The delay in introducing the pommels to gymnasts could be a detriment to the development of young athletes. In some cases, there is a transitional period lasting six months up to two years for an athlete to adapt, and play "catch-up," to performing and feeling comfortable with swinging and performing on the pommels. Also, known pommel horses do not fit the size of the younger gymnast, in that the horse is often too big, too wide, and too bulky in relation to the younger gymnast's size.

Accordingly, a need exists for training equipment and methods that can bridge the gap between an athlete's skill development on the leather pommel horse saddle and the athlete's skill development on the pommels. More specifically, a need exists for training equipment and methods that enable athletes to train on the pommels separate from training on the saddle. Also, a need exists for training equipment and methods that enable progressive skills training on the pommels. A further need exists for training equipment and methods that enhances an athlete's proprioception during execution of skills on the pommels, which can promote faster adaptation of the athlete to the pommels.

Still a further need exists for training equipment that is sized to be readily usable for training by younger gymnasts.

SUMMARY

Athletic, and particularly gymnastic, training apparatus and methods are disclosed herein. In some embodiments, an apparatus includes a pommel portion of a pommel horse training apparatus. The pommel portion includes a plurality of elongate pommel segments. A first pommel segment from the plurality of elongate pommel segments is coupled to a second pommel segment from the plurality of elongate pommel segments. A centerline of the first pommel segment is non-parallel to a centerline of the second pommel segment. The centerline of the first pommel segment is coplanar with the centerline of the second pommel segment.

BRIEF DESCRIPTION OF THE FIGURES

FIG. 41 is a top view of a mat system according to an embodiment. The bottom view (not shown) of the mat system of FIG. 41 is a mirror image of the top view. FIGS. 41A and 41B are front and left side views, respectively, of the mat system of FIG. 41. The rear and right side views of the mat system of FIG. 41 are the same as the front and left side views, respectively, and thus are not shown.

FIG. 42 is a top view of a mat system according to an embodiment. The bottom view (not shown) of the mat system of FIG. 42 is the same as the top view. FIGS. 42A and 42B are front and left side views, respectively, of the mat system of FIG. 42. The rear and right side views of the mat system of FIG. 42 are the same as the front and left side views, respectively, and thus are not shown.

FIG. 43 is a top view of a mat system according to an embodiment. The bottom view (not shown) of the mat system of FIG. 43 is a mirror image of the top view. FIGS. 43A and 43B are front and left side views, respectively, of the mat system of FIG. 43. The rear and right side views of the mat system of FIG. 43 are the same as the front and left side views, respectively, and thus are not shown.

DETAILED DESCRIPTION

Figure 1:
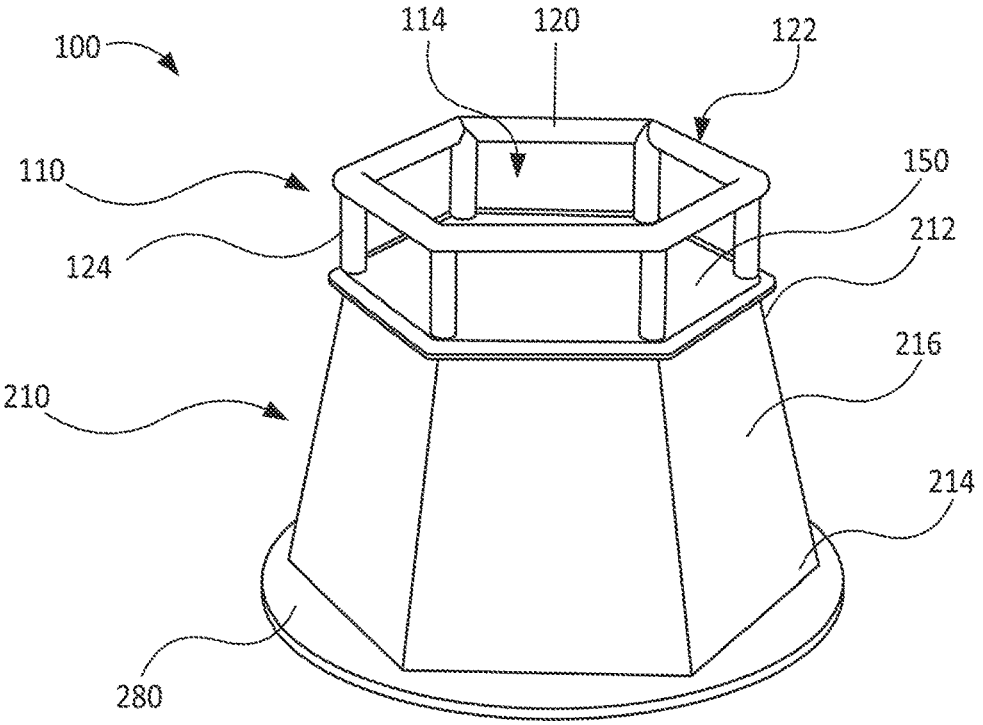
FIG. 1 is a front perspective view of an apparatus according to an embodiment.

Apparatus and methods for athletic and gymnastics training are generally disclosed herein, and more particularly pommel horse training apparatus and methods of use are disclosed herein. Although the training apparatus described herein are particularly suitable for training athletes on the use of pommels for a gymnastics pommel horse, the apparatus is configured for athletic training across a variety of disciplines, including, for example, Cross-Fit, other exercise programs, and sports.

As used in this specification, the singular forms "a," "an" and "the" include plural referents unless the context clearly dictates otherwise. Thus, for example, the term "a member" is intended to mean a single member or a combination of members, "a material" is intended to mean one or more materials, or a combination thereof. As used herein, the terms "reversible," "reversibly," "removably," and/or the like when used to described a process and/or procedure generally refer to a non-destructive process or procedure that can be subsequently undone by a similar yet substantially opposed, inverse, and/or opposite non-destructive process or procedure. When used herein with respect to attachment and/or detachment of an element or assembly, a reversible or removable attachment refers to a non-destructive, repeatable attachment and/or detachment of the element or assembly.

As used herein, the terms "about" and/or "approximately" when used in conjunction with numerical values and/or ranges generally refer to those numerical values and/or ranges near to a recited numerical value and/or range. For example, in some instances, "about 40 [units]" can mean within ±25% of 40 (e.g., from 30 to 50). In some instances, the terms "about" and "approximately" can mean within ±10% of the recited value. In other instances, the terms "about" and "approximately" can mean within ±9%, ±8%, ±7%, ±6%, ±5%, ±4%, ±3%, ±2%, ±1%, less than ±1%, or any other value or range of values therein or therebelow. The terms "about" and "approximately" may be used interchangeably. Furthermore, although a numerical value modified by the term "about" or "approximately" can allow for and/or otherwise encompass a tolerance of the stated numerical value, it is not intended to exclude the exact numerical value stated.

In a similar manner, term "substantially" when used in connection with, for example, a geometric relationship, a numerical value, and/or a range is intended to convey that the geometric relationship (or the structures described thereby), the number, and/or the range so defined is nominally the recited geometric relationship, number, and/or range. For example, two structures described herein as being "substantially parallel" is intended to convey that, although a parallel geometric relationship is desirable, some non-parallelism can occur in a "substantially parallel" arrangement. By way of another example, a structure defining a diameter that is "substantially 100 millimeters (mm)" is intended to convey that, while the recited diameter is desirable, some tolerances can occur when the volume is "substantially" the recited volume (e.g., 100 mm). Such tolerances can result from manufacturing tolerances, measurement tolerances, and/or other practical considerations (such as, for example, minute imperfections, age of a structure so defined, a pressure or a force exerted within a system, and/or the like). As described above, a suitable tolerance can be, for example, of ±1%, ±2%, ±3%, ±4%, ±5%, ±6%, ±7%, ±8%, ±9%, ±10%, or more of the stated geometric construction, numerical value, and/or range. Furthermore, although a numerical value modified by the term "substantially" can allow for and/or otherwise encompass a tolerance of the stated numerical value, it is not intended to exclude the exact numerical value stated.

While numerical ranges may be provided for certain quantities, it is to be understood that these ranges can include all subranges therein. Thus, the range "from 5 to 10" includes all possible ranges therein and all values within a given range may be an endpoint for the range encompassed thereby (e.g., 6-10, 7-10, 8-10, 9-10, 5-9, 6-9, 7-9, 8-9, 5-8, 6-8, 7-8, 6-8, 7-8, 8-9, or fractions thereof). An apparatus according to an embodiment comprises a pommel portion of a pommel horse training apparatus. The pommel portion includes a plurality of elongate pommel segments. A first pommel segment from the plurality of elongate pommel segments is coupled to a second pommel segment from the plurality of elongate pommel segments. A centerline of the first pommel segment is non-parallel to a centerline of the second pommel segment. The centerline of the first pommel segment is coplanar with the centerline of the second pommel segment.

In some embodiments, an interior angle formed by an intersection of the centerline of the first pommel segment and the centerline of the second pommel segment is within the range of about 45 degrees to about 144 degrees. In some embodiment, the plurality of elongate pommel segments includes three to ten pommel segments. In some embodiments, the plurality of elongate pommel segments has an outer perimeter in the shape of a polygon. In some embodiments, the first pommel segment is directly coupled to and in contact with the second pommel segment. In some embodiments, the plurality of elongate pommel segments includes a third pommel segment and a fourth pommel segment. The third pommel segment has a centerline substantially coplanar with and parallel to the first pommel segment, and the fourth pommel segment has a centerline substantially coplanar with and parallel to the second pommel segment. In some embodiments, the pommel portion includes a plurality of support posts coupled to the plurality of elongate pommel segments such that the plurality of support posts space the plurality of elongate pommel segments apart from a support surface. The plurality of support posts can include a number of support posts that is no greater in number than a number of pommel segments in the plurality of elongate pommel segments.

In some embodiments, the pommel portion includes a support member and a plurality of support posts. The plurality of elongate pommel segments are coupled to the support member by the plurality of support posts such that the plurality of elongate pommel segments are spaced apart from a surface of the support member. The support member is configured to removably couple the pommel portion to a base portion. The pommel portion can have an outermost perimeter from a top view of the pommel portion, and the pommel portion can include a pad disposed about at least a portion of the outermost perimeter of the pommel portion. In some embodiments, the pommel portion includes a support member coupled to the plurality of elongate pommel segments. The plurality of elongate pommel segments can define an inner perimeter from a top view of the pommel portion. A surface of the support member and the inner perimeter defined by the plurality of elongate pommel segments can collectively define, from the top view of the pommel portion, an interior region. The pommel portion can include a pad disposed on the surface of the support member within the interior region.

In some embodiments, the apparatus further comprises a base portion coupled to the pommel portion. The base portion can include a first end portion, a second end portion opposite the first end portion, and a plurality of sidewalls disposed between the first end portion and the second end portion. The first end portion of the base portion is coupled to the pommel portion. The apparatus can further comprise a plurality of mat sections having a first configuration in which the plurality of mat sections are removably coupled together and a second configuration in which the plurality of mat sections are uncoupled. The plurality of mat sections in the first configuration can have an outer perimeter and an inner perimeter defining an opening. The opening defined by the inner perimeter of the plurality of mat sections in the first configuration is configured to receive therein at least a portion of the base portion. The inner perimeter of the plurality of mat sections in the first configuration can have a shape complementary to an outer perimeter shape of the base portion. In some embodiments, the shape of the inner perimeter of the plurality of mat sections in the first configuration is a hexagon. In some embodiments, the outer perimeter of the plurality of mat sections in the first configuration is in the shape of a polygon different than the hexagon. In some embodiments, the plurality of mat sections includes at least a first mat section that has an upper surface with an outermost perimeter that has a first polygonal shape and a second mat section that has an upper surface with a perimeter that has a second polygonal shape different from the first polygonal shape. In some embodiments, an upper surface of each mat section from the plurality of mat sections defines a polygonal shape.

In some embodiments, the apparatus further comprises a base portion coupled to the pommel portion. The base portion can have an outer perimeter in the shape of a polygon. The plurality of elongate pommel segments can have an outer perimeter in the shape of the polygon. In some embodiments, the apparatus further comprises an elongate member configured to be removably coupled to the pommel portion. A first end portion of the elongate member can be disposed adjacent a side portion of the pommel portion and a second end portion of the elongate member can extend longitudinally away from the side portion of the pommel portion when the elongate member is removably coupled to the pommel portion. The elongate member has an upper surface configured for a user to practice gymnastic skills. In some embodiments, at least one of the first pommel segment, the second pommel segment, or adjacent end portions of the first pommel segment and the second pommel segment, can be at least partially enclosed in a pad.

In some embodiments, the pommel portion includes a support member and a plurality of posts that are disposed between the plurality of elongate pommel segments and the support member. The support member, the plurality of posts and the plurality of elongate pommel segments can collectively define an interior volume. The pommel portion can include a pommel distinct from the plurality of elongate pommel segments, in which the pommel is spaced apart from, and at least partially disposed within, the interior volume. The pommel portion can include a padded pommel at least partially disposed within the interior volume. The padded pommel can be distinct from the plurality of elongate pommel segments, and can include an inner pommel and an outer pad. The outer pad can be disposed over at least upper and side surfaces of the inner pommel. The padded pommel can have a cross-sectional diameter that is greater than a cross-sectional diameter of the first pommel segment.

An apparatus according to an embodiment comprises a pommel portion including a first set of parallel pommel segments and a second set of parallel pommel segments coupled to the first set of parallel pommel segments. The second set of parallel pommel segments are non-parallel to the first set of parallel pommel segments. Each pommel segment from the first set of parallel pommel segments and from the second set of parallel pommel segments are linearly arranged on a substantially common geometric plane. In some embodiments, the first set of parallel pommel segments is directly coupled to the second set of parallel pommel segments. The pommel portion can include a third set of parallel pommel segments, and the third set of parallel pommel segments can be non-parallel to each of the first set of parallel pommel segments and the second set of parallel pommel segments. The pommel portion can have an outer perimeter in the shape of a polygon.

An apparatus according to an embodiment comprises a pommel portion of a pommel horse training apparatus and a plurality of posts. The pommel portion includes a plurality of pommel segments that form a closed geometric shape. Each pommel segment from the plurality of pommel segments has a centerline. The centerline of each pommel segment from the plurality of pommel segments is disposed on a geometric plane. The plurality of pommel segments define an opening within the closed geometric shape. The plurality of posts are configured to support the pommel above and spaced apart from a support surface. The closed geometric shape can be a polygon or a circle. In some embodiments, the apparatus further comprises the support surface and a base portion. The support surface can include a support member coupled to the plurality of posts. The support member can be removably coupled to and disposed on the base portion. The apparatus can further comprise a sensor unit disposed in the opening of the plurality of pommel segments. The sensor unit can be configured to detect at least one of (1) a threshold amount of pressure caused by contact of a user with the sensor unit, (2) a proximity, within a predetermined distance, of a user with a portion of the sensor unit, or (3) a threshold amount of movement of the sensor unit with respect to the pommel portion. The sensor unit can be configured to produce a signal in response to detection of the at least one of the threshold amount of pressure, the proximity, or the threshold amount of movement. In some embodiments, the apparatus further comprises a metronome coupled to the pommel horse training apparatus.

Figure 4:
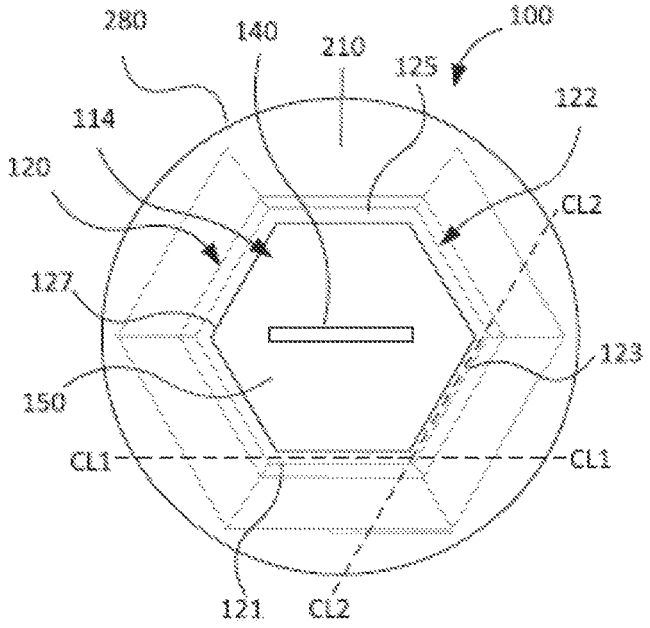
FIGS. 4-5 are top and bottom views, respectively of the apparatus of FIG. 1.

An apparatus 100 according to an embodiment is shown in FIGS. 1-5. The apparatus 100 can be, for example, a pommel horse training apparatus. The apparatus 100 can include a pommel portion 110 and a base portion 210. The pommel portion 110 includes a plurality of elongate pommel segments 122. A first pommel segment 121 is coupled to a second pommel segment 123, as described in more detail herein. A centerline (represented by dashed line CL1 shown in FIG. 4) of the first pommel segment 121 is non-parallel to a centerline (represented by dashed line CL2 shown in FIG. 4) of the second pommel segment 123. An interior angle formed by an intersection of the centerline CL1 of the first pommel segment 121 and the centerline CL2 of the second pommel segment 123 can be within the range of about 45 degree to about 144 degrees. In some embodiments, the interior angle is within the range of about 90 degrees to about 135 degrees. As shown in FIG. 4, the interior angle formed by the intersection of centerlines CL1, CL2 of the first and second pommel segments 121, 123 is about 120 degrees. The centerline CL1 of the first pommel segment 121 is coplanar (see, e.g., geometric plane P in FIG. 3A) with the centerline CL2 of the second pommel segment. Said another way, centerlines CL1 and CL2 are each linearly arranged on a substantially common geometric plane P. In use, the plurality of elongate pommel segments can be oriented substantially horizontally (e.g., with respect to a support surface, such as the support member 150 (or any support member described herein), the base portion 210 (or any base portion described herein), a floor or the ground).

Figure 12:
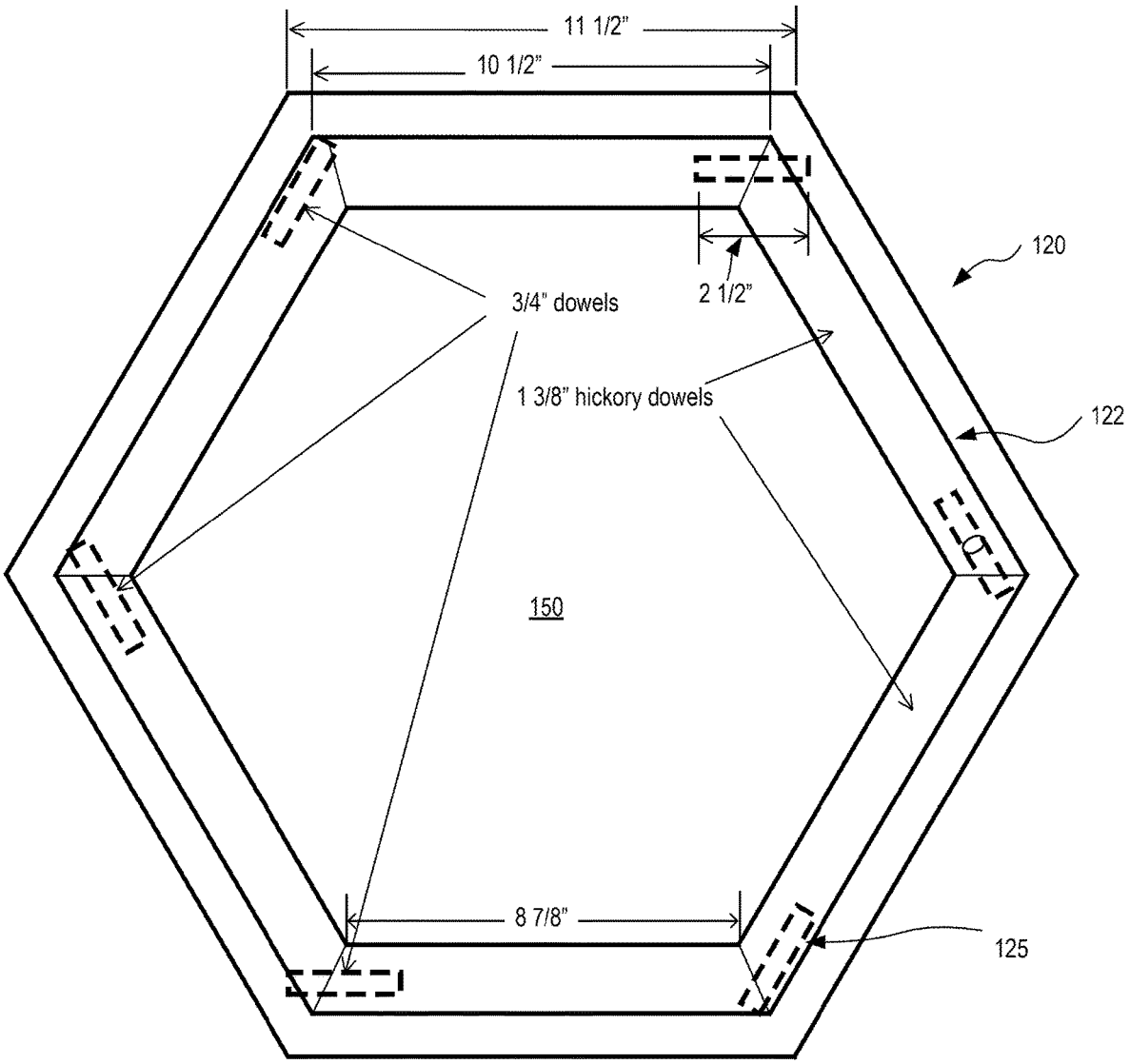
FIG. 12 is a schematic top view of a portion of the apparatus of FIG. 1.
Figure 13:
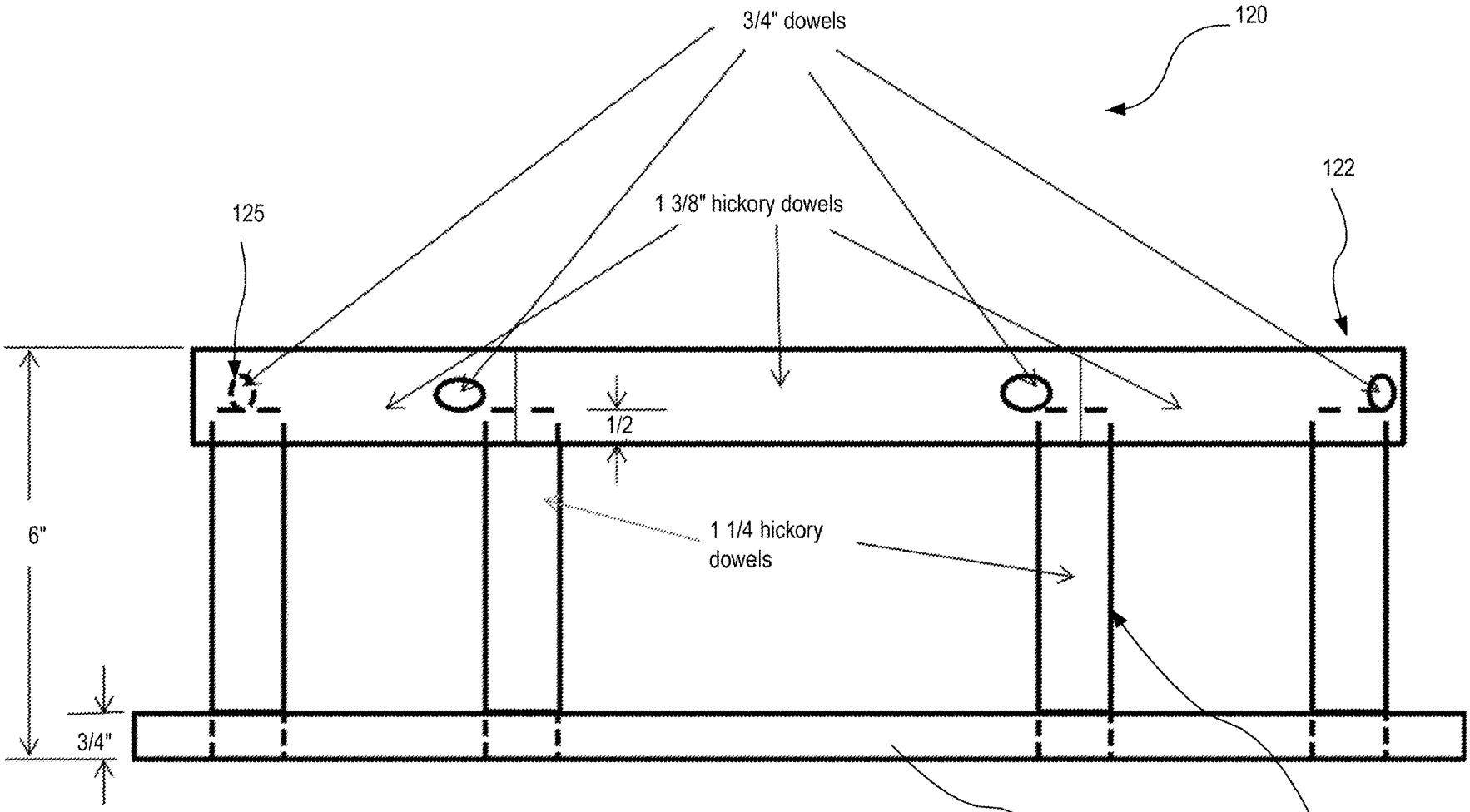
FIG. 13 is a front view of the pommel portion of the apparatus of FIG. 1.

The pommel segments 122 can be coupled together. For example, an end portion of an elongate pommel segment 122 (e.g., the first pommel segment 121) can be coupled to an end portion of an adjacent elongate pommel segment 122 (e.g., second pommel segment 123) via any suitable coupling mechanism, such as an adhesive, fastener (e.g., a screw), a weld, a dowel (see, e.g., dowels 125 shown in FIGS. 12-13), or the like, or any combination thereof. In some embodiments, an elongate pommel segment (e.g., the first pommel segment 121) is in contact with and directly coupled to another elongate pommel segment (e.g., the second pommel segment 123). The pommel segments 122 can be coupled together in a manner that results in an upper surface of the pommel portion 110 being substantially smooth and/or substantially free of any outwardly extending protrusions. Each pommel segment can have a substantially cylindrical body portion between a first end portion and a second end portion thereof. The elongate pommel segments 122 can each be substantially linear. The elongate pommel segments 122 can each be substantially uniform in circumference along its length (or at least a majority of its length, e.g., between opposing end portions thereof). In some embodiments, opposing end portions of one or more of the elongate pommel segments 122 can be beveled or otherwise angled (see, e.g., FIG. 12), which can help in accurately and smoothly aligning an end portion of one elongate pommel segment 122 with an end portion of an adjacent elongate pommel segment 122 during construction.

The plurality of elongate pommel segments 122 can include any suitable number of pommel segments. For example, in some embodiments, the plurality of elongate pommel segments 122 includes two to twelve pommel segments. In another example, the plurality of elongate pommel segments 122 can include three to ten pommel segments. In the embodiment shown in FIGS. 1-4, the plurality of elongate pommel segments 122 includes six pommel segments As shown in FIG. 1, the six elongate pommel segments 122 (also referred to herein as horizontal members) are collectively arranged into the shape (e.g., from a top view) of a polygon. Said another way, the pommel segments can be arranged to form a geometric shape that has an outer perimeter (e.g., from a top view) in the shape of a polygon. More specifically, as shown in FIG. 4, the plurality of elongate segments can have an outer perimeter in the shape of a hexagon. Also in this manner, the pommel portion 110 can have, e.g., from a top view, an outer perimeter in the shape of the polygon, including, for example, a hexagon. Said another way, the plurality of pommel segments 122 can be arranged to form a closed geometric shape. In this manner, end portions of adjacent pommel segments are in contact such that the outer perimeter shape formed by the plurality of pommel segments 122 is continuous. In some embodiments, the plurality of pommel segments 122 define an opening within the closed geometric shape. The opening can be defined, for example, by an inner perimeter of the plurality of pommel segments 122 (from the top view). The collective arrangement of the pommel segments in other embodiments, however, can have a different geometric shape (e.g., like that of a triangle, tetragon, pentagon, heptagon, octagon, nonagon, decagon, or other polygon or the like, or a circle as described in more detail herein), and the geometric shape can be closed.

Also as shown in FIGS. 1 and 4, the pommel portion 110, or in some embodiments, the plurality of elongate pommel segments 122, can include multiple sets of parallel pommel segments. For example, a first set of parallel pommel segments can include the first pommel segment 121 and a third pommel segment 125 from the plurality of elongate parallel pommel segments 122, which third pommel segment 125 has a centerline (not shown) that is substantially coplanar with and parallel to the centerline of the first pommel segment 121. A second set of parallel pommel segments can include the second pommel segment 123 and a fourth pommel segment 127 from the plurality of elongate parallel pommel segments 122, which fourth pommel segment 127 has a centerline (not shown) that is substantially coplanar with and parallel to the centerline of the second pommel segment 123. The first set of parallel pommel segments is coupled to (and in some embodiments, directly coupled to, as shown in FIG. 4) the second set of parallel pommel segments. The second set of parallel pommel segments are nonparallel to the first set of parallel pommel segments. Each pommel segment from the first and second sets of parallel pommel segments is linearly arranged on a substantially common geometric plane (e.g., plane P). The pommel portion 110 can include a third set of parallel pommel segments, which is non-parallel to each of the first set of parallel pommel segments and the second set of parallel pommel segments. The pommel portion can include more than three sets of parallel pommel segments, such as four, five or six sets of parallel pommel segments, each of which is non-parallel to the other sets of parallel pommel segments. Each pommel segment from the sets of parallel pommel segments can be linearly arranged on a substantially common geometric plane. In some embodiments, each pommel segment from the plurality of pommel segments 122 has a centerline that is disposed on a geometric plane.

Arrangement of the pommel segments in a geometric shape having two or more parallel sets of elongate pommel segments, such as the hexagon (or the octagon, decagon or dodecagon), can be particularly useful in pommel horse training. For example, as discussed herein, interior angles formed by the elongate pommel segments 122 in the shape of the hexagon provides for progressively greater angle of turns for the gymnast's hand during execution of a pommel horse skill. Other suitable shapes include a plus sign, triangle, square, or rectangle, or the like. Such additional shapes, e.g., the plus sign, can be useful in training a gymnast on other particular pommel horse skills. In some embodiments, the pommel portion 110 includes a single pommel 140 (shown in FIG. 3A, with hidden portions in the front view shown in broken lines for the sake of illustration, and in FIG. 4) that can be at least partially disposed within an inner perimeter of the geometric arrangement formed by the pommel segments 122. The more centrally disposed single pommel can enable the user to also use the apparatus to work on single pommel skills nearer to a center of gravity of the apparatus 100.

Each elongate pommel segment is sized and shaped to be gripped by a hand of a user. For example, a cross-sectional diameter of the elongate pommel segment 122 can be about 1 inch to about 1.5 inches. For example, the elongate pommel segment 122 can have a diameter of about 1⅜ inch. The elongate pommel segment 122 can be constructed of hickory, walnut, oak, or other wood, plastic, fiberglass, metal, or any other suitable material. The elongate pommel segment 122 can have a length in the range of about 3 inches to about 18 inches. Each elongate pommel segment 122 can have a length within the range of about 7 inches to about 12 inches, about 8 inches to about 11 inches, or about 9 inches to about 10 inches. In some embodiments, the elongate pommel segment 122 can be about 9⅜ inches in length. In some embodiments, the elongate pommel segment 122 can be about 10.5 inches in length.

The pommel portion 110 can include at least one support post (also referred to herein as a post) 124. The post can be, for example, an elongate member, such as a substantially vertically arranged elongate member. In some embodiments, the pommel portion 110 includes a plurality of support posts 124 coupled to the plurality of elongate pommel segments 122 such that the plurality of support posts space the pommel segments apart from a support surface (e.g., a support member described herein, a base portion described herein, the floor, the ground, or the like). In this manner, the support posts 124 are configured to couple the pommel segments 122 to the support member 150 such that the pommel segments 122 are vertically disposed above the support member 150 when the apparatus 100 is disposed in an upright position on the support surface. The support post 124 is coupled at a first end to the support member 150 and at a second end to the elongate pommel segment 122. The posts 124 can be coupled to the support member 150, for example using any suitable coupling mechanism, including, but not limited to a screw or other fastener, a weld, or the like. In some embodiments, the posts 124 and/or the pommel segments 122 can be monolithically formed with the support member 150. In some embodiments, the support post 124 is partially disposed in a hole defined by the support member 150, to help couple the support post 124 to the support member in a substantially vertical orientation (e.g., such that a center axis of a length of the support post 124 is transverse to, or orthogonal to, a horizontal axis of, or plane defined by, an upper surface of the support member 150).

The support post 124 can have any suitable size and dimension, including, for example, a diameter within the range of about 0.5 inches to about 2 inches, or within the range of about ⅞ inches to about 1.5 inches. Each support post 124 (which can be, e.g., upright or vertically arranged dowel-like supports, and may also be referred to as a vertical member) can have a height within the range of about 1 inch to about 12 inches. Each support post from the plurality of support posts 124 has substantially the same height. The support post 124 can be constructed of any suitable material, including, for example, those described herein with respect to the elongate pommel segment 122. The apparatus 100 is shown as including six support posts 124, each of which is disposed adjacent an end portion of adjacent elongate pommel segments 122. In other embodiments, however, the pommel portion 110 can include a different number of support posts. For example, the pommel portion 110 can include one, two, three, four, five, seven, eight, nine, ten or more support posts. The number of elongate pommel segments 122 can be the same as the number of support posts 124. In other embodiments, the number of pommel segments 122 can be less than the number of support posts 124. In still other embodiments, the number of support posts 124 can be no greater in number than a number of pommel segments 122.

In some embodiments, the pommel segments (or the plurality of elongate pommel segments 122 and the plurality of support posts 124, also collectively referred to herein as a pommel 120) can have a maximum width (e.g., from a top view or a bottom view) of about 12 inches to about 24 inches. In some embodiments, the pommel can have a maximum width (e.g., from a top view or a bottom view, measured to the outside edge of the pommel segments 122 from the top view) of about 16 inches (e.g., 16⅜ inches or 16½ inches), about 17 inches (e.g., about 17⅛ inches) or about 18 inches (e.g., 17⅝ inches or 18.5 inches).

In some embodiments, the pommel portion 110 includes the support member 150. The support member 150 is coupled to the plurality of elongate pommel segments 122, for example, via one or more support posts 124 as described herein. In this manner, a plurality of posts can be disposed between the plurality of elongate pommel segments 122 and the support member 150. The support member 150 is configured to be disposed on, and (optionally) couple the pommel portion 110 to, a base portion 210, as described herein. The support member 150 includes an upper surface, a lower surface, and an outer perimeter (from a top view). The upper surface of the support member 150 can be substantially planar (e.g., flat). The lower surface of the support member 150 can be substantially planar, or can have a different configuration to enable the support member 150 to be coupled to the base portion 210 or a support surface.

The apparatus 100 can include at least one fastener (not shown in FIGS. 1-5) to removably couple the support member 150 to the base portion 210, thereby coupling the pommel portion 110 to the base portion. The fastener can be disposed through at least a portion of the support member 150 between the upper surface and the lower surface of the support member 150, and disposed through at least a portion of an upper surface of the base portion 210. The support member 150 can be coupled to an upper surface of the base portion 210 using any suitable fastener, including, but not limited to, bolts (e.g., toggle bolts), wing nuts, screws (e.g., hex screws that are configured to be tightened and/or released using a hex key, also known as an Allen key or Allen wrench), or the like. In some embodiments, the support member 150 is coupled to the upper surface of the base portion using one or more quick-release locks. In some embodiments, the fastener is configured to be accessed (for coupling and/or uncoupling) via the upper surface of the support member 150. In other embodiments, the fastener is configured to be accessed via an underside of the upper surface of the base portion 210. In some embodiments, the support member 150 is coupled to the base portion 210 using two, three, four or more fasteners. Use of multiple fasteners (including, e.g., four fasteners) to couple the support member 150 to the base portion 210 helps to prevent movement of the support member 150 with respect to the base portion 210, e.g., in response to shear forces during use of the apparatus 100. In some embodiments, the pommel portion 110 can be selectively coupled to a different base portion (e.g., a base portion of a different height, like base portions 610', 610", 613, 617, as shown in FIGS. 21-22 and 62-71). In other embodiments, however, the support member 150, and thus the pommel portion 110, is permanently coupled to the base portion 210.

Figure 2:
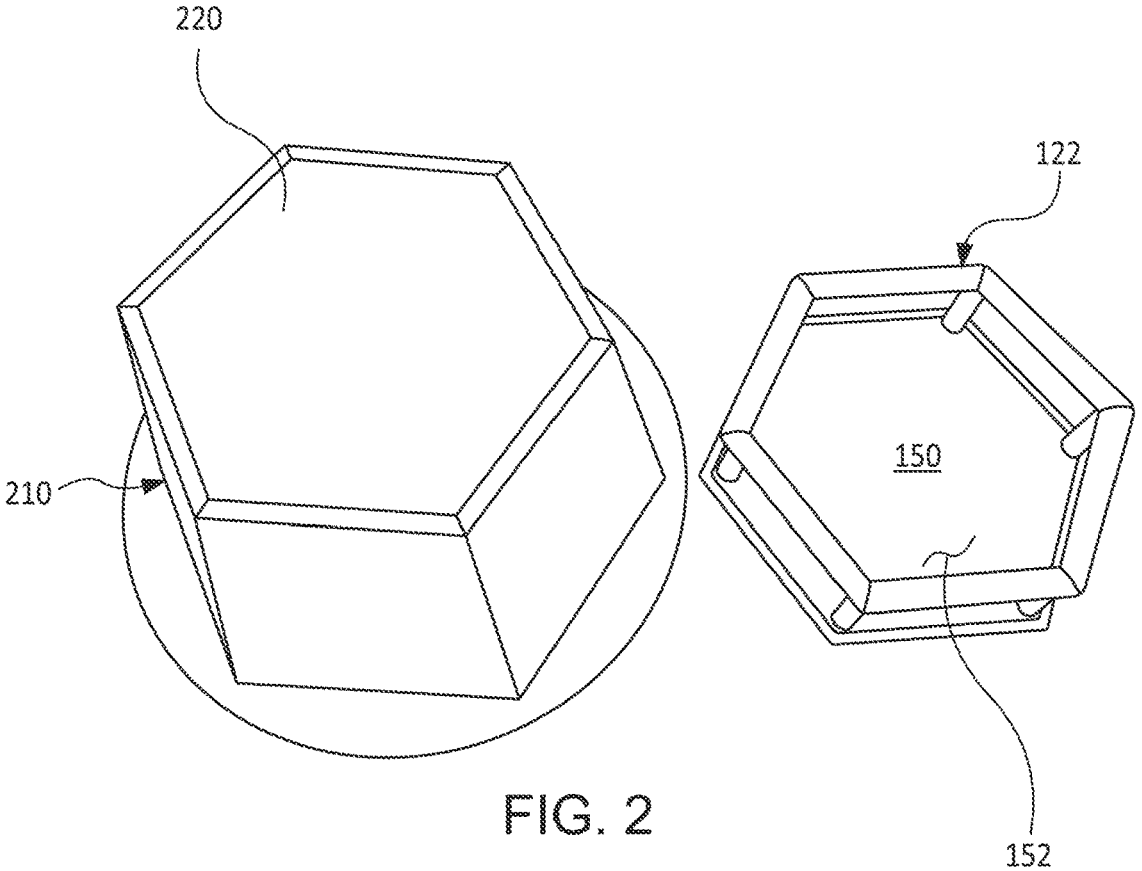
FIG. 2 is a top perspective view of the apparatus of FIG. 1, with portions of the apparatus uncoupled.
Figure 3A:
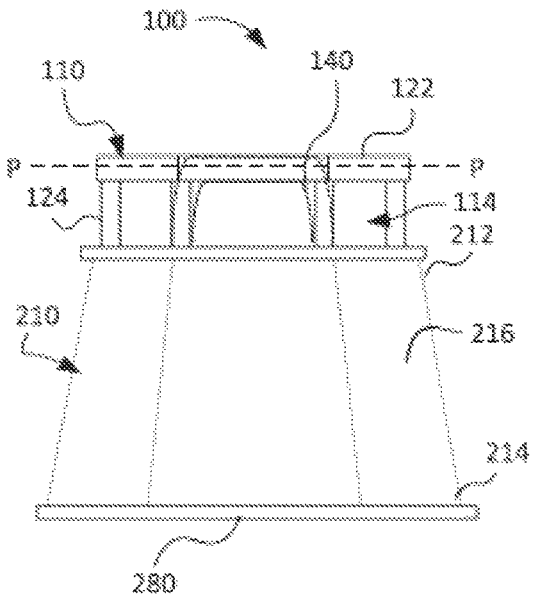
FIG. 3A is a front view of the apparatus of FIG. 1. The rear view of the apparatus of FIG. 1 is identical to the front view.
Figure 3B:
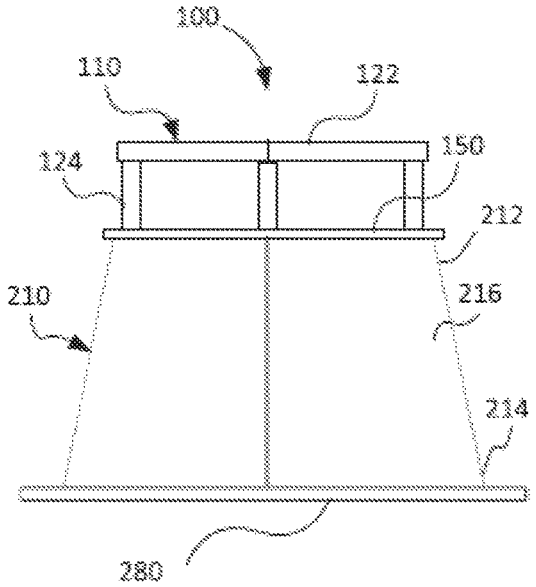
FIG. 3B is a side view of the apparatus of FIG. 1. The opposing side view of the apparatus of FIG. 1 is identical to the side view shown in FIG. 3B.
Figure 6:
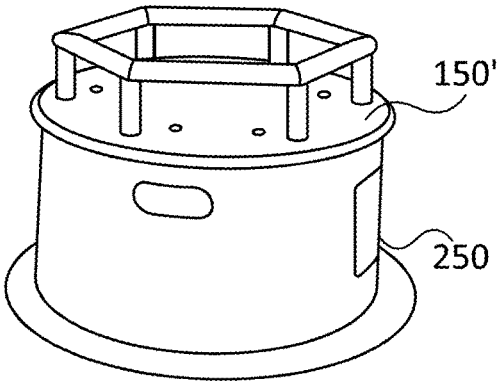
FIG. 6 is a front view of an apparatus according to an embodiment.

The outer perimeter of the support member 150, from a top view, can have any suitable shape. For example, the support member 150 can have a perimeter (from a top view) having a shape that is substantially the same shape that formed by an outer perimeter (from a top view) of the plurality of elongate pommel segments 122, though the size of the shape of the support member perimeter can be the same as or different (e.g., larger or smaller) than the size of the shape of the outer perimeter of the plurality of elongate pommel segments. The perimeter of the support member 150 can have, for example, a polygonal shape (such as a triangle, a rectangle, a square, a hexagon, an octagon, a decagon, a dodecagon, or any other polygon described herein, or the like). As shown in FIGS. 1-2 and 4, in some embodiments, the support member 150 perimeter can be in the shape of a hexagon. In other embodiments, a support member 150' can have a substantially circular or otherwise rounded perimeter shape (e.g., as shown in FIG. 6). The support member 150 can have a diameter (or maximum width, for example, taken from a corner or vertex of a polygonal-shaped support member to an opposing corner or vertex of the polygonal-shaped support member) within the range of about 12 inches to about 30 inches. In some embodiments, the support member 150 has a diameter or maximum width within the range of about 16 inches to about 20 inches. In one embodiment, for example, the support member 150 can have a diameter or maximum width of about 19 inches. The support member 150 can be constructed of any suitable material. For example, in some embodiments, the support member 150 can be constructed of wood (e.g., plywood, or more specifically ¾ inch plywood), plastic, fiberglass, or any other suitable material, or combination thereof. For example, the support member 150 can be constructed of an eleven layer ¾ inch hickory, oak, or walnut plywood.

In some embodiments, a surface (e.g., the upper surface) of the support member 150 and an inner perimeter defined by the plurality of elongate pommel segments collectively define, from a top view of the pommel portion 110, an interior region (or volume) 114 (see, e.g., FIGS. 1 & 4). In some embodiments, the support member 150, the plurality of posts 124 and the plurality of elongate pommel segments 122 collectively define the interior volume 114 (see, e.g., FIG. 3A).

In some embodiments, the support member 150 is coupleable to a second support member (e.g., the second support member can be coupled to the bottom of the support member 150) so that the apparatus 100 can be a stable floor training apparatus (e.g., separate from the base portion 210 described herein). The second support member can be any suitable material described herein, and can have any suitable size and shape. For example, the second support member can have a height within the range of about 1 inch to about 16 inches. In another example, the second support member can have a width similar to the support member 150 described herein, or a width similar to that described herein with respect to foundation 280.

Figure 25:
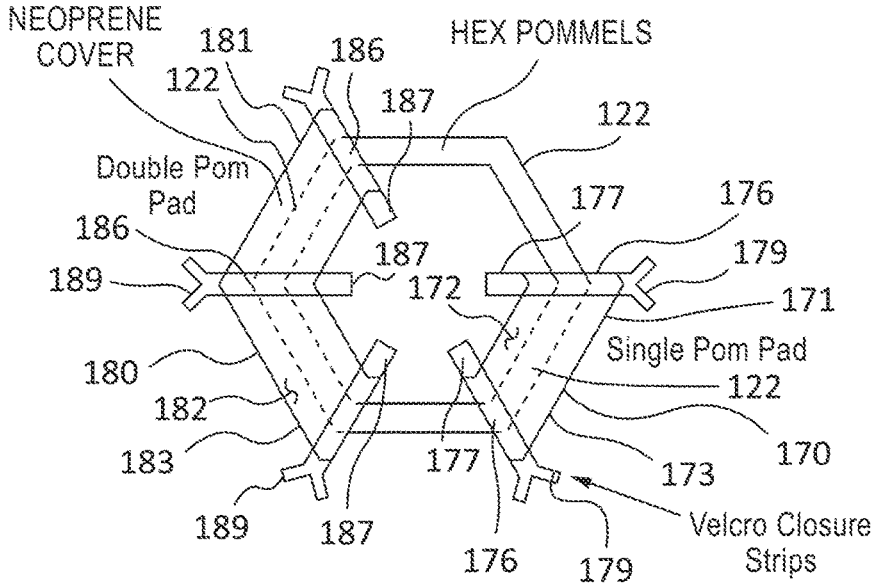
FIGS. 25-27 are bottom views of a portion of the apparatus of FIG. 1 with one or more pads according to embodiments.

In some embodiments, the apparatus 100 includes a pad configured to be coupled to one or more portions of the pommel portion 110. For example, in some embodiments, the support member 150 can include a pad (not shown in FIGS. 1-5), or a padded portion, disposed on or otherwise coupled to an upper surface of the support member 150, as described in more detail herein (see, e.g., FIGS. 44-47). In another example, referring to FIGS. 25-27, a pad according to an embodiment is coupleable to at least a portion of the plurality of elongate pommel portions 122 (or to pommel 120) as described herein. Referring to FIG. 25, for example, a pad 170 can be associated with at least a portion of the pommel portion 110, and more specifically with at least a portion of an elongate pommel segment 122. The pad 170 can be removably coupled to the elongate pommel segment 122. The pad 170 can include a first surface 172 and a second surface (not shown in FIG. 25). The first surface 172 of the pad 170 can be disposed on and facing a surface of the elongate pommel segment 122 such that at least a portion of the second surface (not shown in FIG. 25) of the pad 170 faces outwardly (away from the centerline of the pommel segment). The pad 170 can be wrapped around at least a portion of the elongate pommel segment 122 such that portion of the elongate pommel segment 122 is substantially circumferentially enveloped by the pad 170 (e.g., a wrapped configuration). In some implementations, opposing side portions (or edges) of the pad 170 are in contact or overlap when the pad is in the wrapped configuration. In some implementations, opposing side portions of the pad 170 are spaced apart when the pad is in the wrapped configuration. In some embodiments, the pad 170 is configured to be disposed over at least an upper surface and/or side surface(s) of the pommel segment 122.

End portions 171, 173 of the pad 170 can include a fastening strap 176. The fastening strap 176 can include a first portion of a hook-and-loop fastener at a first end portion 177 thereof and a second, complementary, portion of a hook-and-loop fastener at a second end portion 179 thereof. At least one of the first end portion 177 or the second end portion 179 of the strap 176 (e.g., the second end portion 179, as shown in FIG. 25) can be forked into at least two branched portions. In use, a middle portion of the fastening strap 176 can be wrapped around an end portion of at least one elongate pommel segment 122, and the branched portions of the second end portion 179 of the fastening strap 176 can be wrapped around (or disposed on either side of) at least a portion of a circumference of an end portion of a post 124 coupled to the end portion of the elongate pommel segment 122 such that the first portion of the hook-and-loop fastener on the first end portion 177 of the fastening strap 176 can contact and/or be coupled to the second portion of the hook-and-loop fastener of the second end portion 179 of the fastening strap 176.

Although the pad 170 is shown and described as having a fastening strap 176 with hook-and-loop fasteners, in other implementations, any suitable fastener or coupling mechanism may be used, including, but not limited to, tie straps, snap connectors, or the like, or a combination thereof, that can retain the pad 170 in the wrapped configuration. Although the pad 170 is shown and described as including fastening straps 176 disposed at end portions 171, 173 of the pad 170, in other implementations, a different or additional portion of the pad 170 can include a fastener, such as the opposing side portions extended between the fastening straps 176 in FIG. 25.

Although the pad 170 is shown and described as being configured for use with one elongate pommel segment 122, in some embodiments, a pad can be configured to be wrapped at least partially about and coupled to (or in the wrapped configuration with respect to) two or more elongate pommel segments 122. For example, as shown in FIG. 25, a pad 180 according to an embodiment is configured to be wrapped about at least a portion of two adjacent elongate pommel segments 122. The pad 180 can be similar or identical in many respects to pad 170, and therefore is not described in detail herein. The pad 180 can include three fastening straps, each identical or substantially similar in operation to the fastening strap 176 described with respect to pad 170. Two of the fastening straps 186 are disposed at opposing end portions of the pad, and one strap 186 is disposed at a middle portion of the pad between the end portions. In this manner, each fastening strap 186 is configured to wrap about a portion of the pommel 120 at an end portion of at least one elongate pommel segment 122 and, optionally, an end portion of a support post 124 (not shown in FIG. 25), such as where the end portion of the support post 124 is coupled to and/or contacts the end portion of the at least one elongate pommel segment 122.

Figure 26:
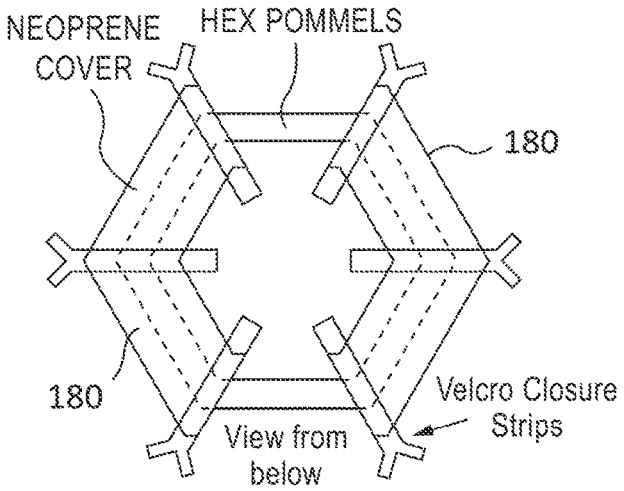

The pads 170, 180 can be selectively used to produce a desired combination of exposed pommels. For example, as shown in FIG. 25, two pads 170,180 are positioned to be coupled to the pommel 120 such that one pad 180 covers a pair of adjacent elongate pommel segments 122 and the other pad 170 covers a third elongate pommel segment spaced apart from the pair of adjacent elongate pommel segments 122, and such that three elongate pommel segments 122 are exposed (unwrapped). In another example, as shown in FIG. 26, two pads 180 are coupled to the pommel 120 such that each pad 180 can be wrapped about two adjacent pommels and such that two parallel elongate pommel segments are exposed (unwrapped). Such pad 180 placement can be useful, for example, when the athlete works on a basic developmental circle or flair circle.

The pad 170, 180 can be used to pad the pommel 120, or portion thereof, to reduce the risk of injury and/or risk for the novice or more experienced athlete by padding corner portions of the pommel 120 or any portion thereof while training and/or performing basic skills or more complex developmental exercises and progressions designed for the apparatus described herein. The pad 170, 180 also helps to alleviate apprehension and/or fear on the part of the athlete while progressing to their goals. In use, the pad 170, 180 placement also provides visual and tactile indications to the athlete in where the athlete should (e.g., the exposed elongate pommel segment(s)) or should not (e.g., the padded portion of one or more elongate pommel segments) place the athlete's hands while performing skill development exercises. In some embodiments, one or more pads can have a color different from that of the pommel 120, to enhance the athlete's visual field and thereby make it easier for the athlete to determine where to place his hand(s). In some embodiments, each pad can have a color different from another pad coupled to the pommel 120. For example, a first pad, or a portion of the pad that extends between a first set of neighboring support posts, can be a first color; a second pad, or a portion of the first or second pad that extends between a second set of neighboring support posts, can be a second color different from the first color. Each color can be used to provide an indicia to the athlete during use. For example, the first color (e.g., red, blue, green, orange, yellow, or any suitable color) can indicate to the athlete that the next unpadded elongate pommel segment is immediately adjacent. In another example, the second color can indicate to the athlete that that the next elongate pommel segment is also padded, thereby also indicating to the athlete that the athlete should continue a rotation further and/or reach further to a non-neighboring horizontal segment before moving the athlete's hand to the next unpadded horizontal segment and/or the next horizontal segment appropriate for the particular maneuvered being executed.

The pads 170, 180 can be constructed of neoprene or any other suitable material including, but not limited to, foam, rubber, plastic, silicone, or another suitable material, or a combination of the foregoing materials. The pad can have a thickness (e.g., between the first surface and the second surface) of about 1/16 inches to 1 inch. The pad can have a length of from about 3 inches to about 24 inches. For example, a pad configured to be wrapped about a single elongate pommel segment (or portion thereof) can have a length of about 3 inches to about 20 inches. For example, the pad can have a length of about 9½ inches, 10½ inches, 11½ inches, or 12½ inches. In another example, a pad configured to be wrapped around two or more elongate pommel segments can have a length of about 18 inches to about 24 inches. For example, the pad 170, 180 can have a length of about 18 inches, 20 inches, 22 inches, or 24 inches. The pads can have any suitable width, including, for example, a width of about 2 inches to about 3 inches.

In some embodiments, adjacent end portions of the first pommel segment and the second pommel segment are at least partially enclosed in a pad (any pad described herein, or a portion thereof, e.g., pad 170, 180, 190). For example, a pad can be configured to be disposed over a corner portion formed by end portions of adjacent elongate pommel segments, optionally leaving a middle portion of the adjacent elongate pommel segments exposed (or unwrapped). In this manner, one or more corner portions of the pommel (e.g., the six points of the hexagonally shaped pommel) can be covered by the pad to protect the user from sharp contact therewith during use of the pommel while permitting the user to access at least a portion of each of the plurality of elongate pommel segments 122.

Figure 27:
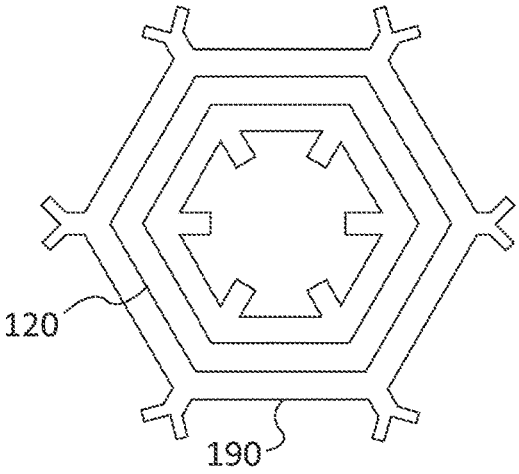

Although the pads described herein have been shown and described as covering a portion of the pommel portion 110, in still other embodiments, a pad 190 can be configured to be disposed over substantially an entirety of at least an upper surface of the plurality of elongate pommel segments 122, as shown in FIG. 27. The pad 190 can include fastening straps, as described herein, at each corner of the plurality of elongate pommel segments 122. Although the fastening straps are described herein as including branched portions configured to be wrapped or disposed about an end portion of a support post 124, in some embodiments, the end portions of the fastening straps are configured to be wrapped circumferentially around end portions of the elongate pommel segment 122 instead of or in addition to being wrapped or disposed about an end portion of the support post 124.

In use, the pommel portion 110 according to embodiments described herein can be used to improve training of a gymnast to use a known gymnastics pommel horse. For example, the plurality of elongate pommel segments 122 can enable a gymnast to progress in training with respect to various handholds; e.g., from holding the pommel with the gymnast's hands on parallel pommel segments, to holding the pommel with the gymnast's hands closer together on non-neighboring and non-parallel pommel segments, to holding the pommel with the gymnast's hands on neighboring pommel segments, and to holding the pommel with the gymnast's hands on a single pommel segment. In practice, this plurality of elongate pommel segments 122 arrangement enables a gymnast to learn skills progressively with an approximately 30 degree turn (with respect to relative positions of the hands from a starting position on the parallel elongate pommel segments 122), then an approximately 60 degree turn, then an approximately 90 degree turn, then an approximately 150 degree turn, then an approximately 180 degree turn, or any combination thereof. The arrangement of the plurality of elongate pommel segments (also referred to as horizontal or elongate members) is configured to facilitate the gymnast's proprioception during various movements on the pommel horse.

The proprioception experience by an athlete or other user training on the apparatus described herein and/or using the methods described herein is instrumental in increasing the speed of the athlete's learning process and adaptation to the pommels. Moreover, the apparatus described herein and/or using the methods described herein can reduce the period of time for an athlete to learn skills to a matter of hours and days versus months or years. The apparatus and methods described herein enable a gymnast to learn skills progressively with an approximately 30 degree turn (of the hands from a starting position on the pommels), then an approximately 60 degree turn, then an approximately 90 degree turn, then an approximately 120 degree turn, then an approximately 150 degree turn, then an approximately 180 degree turn, or a combination thereof. The apparatus and methods described herein are also configured so that an athlete can also train on Thomas flair skills, handstands, and other suitable skills. The apparatus and methods described herein can help the gymnast develop their skills in three (e.g., the 30, 60 and 90 degree turns of the hand discussed above) to six different stages (e.g., the 30, 60, 90, 120, 150 and 180 degree turns discussed above). No known apparatus has been developed that provides the option to break down pommel skills in three to six stages. In addition, no known apparatus has allowed teaching of pommel skills in such a progressive and methodical manner as that provided by the apparatus and methods described herein. The pommel horse may be the most difficult piece of equipment in men's gymnastics, however, the apparatus and methods described herein can simplify the learning process.

The apparatus 100 can include the base portion 210. The base portion 210 includes a first end portion 212, a second end portion 214 opposite the first end portion, multiple sidewalls (or side members) 216 disposed between and including the first end portion 212 and the second end portion 214. The base portion 210 is configured to be coupled to the pommel portion 110. For example, the first end portion 212 of the base portion 210 can be coupled to the pommel portion 110, and more specifically can be coupled to the support member 150 of the pommel portion 110. The base portion 210 is configured to support the pommel portion 110 in a vertically spaced relationship with respect to a support surface (e.g., the ground, floor, gymnastics mat, or other suitable surface), when the apparatus 100 is in an upright position. The base portion 210 can be, for example, within the range of about 2 inches to 30 inches in height. In one embodiment, for example, the base portion 210 is about 16 inches in height. In some embodiments, the base portion 210 is removably coupled to the pommel portion 110, as described herein. The base portion 210 can be coupled to the pommel portion 110 using any suitable coupling mechanism, including one or more of the coupling mechanisms described herein.

In the embodiment of FIG. 1, each sidewall 216 has a substantially planar or flat outer surface that has a substantially trapezoidal shaped perimeter. In other embodiments, however, the side member 216 can have a different shape. In some embodiments, as shown in FIGS. 1-4, the side member 216 is coupled at a first side thereof to an adjacent side member and at a second, opposite, side thereof to another adjacent side member. In some embodiments, the base portion 210 has a first (or upper) support plate 220 (see, e.g., FIG. 2) and a second (or lower) support plate (not shown). The first support plate 220, sidewalls 216, and second support plate of the base portion 210 can collectively define an interior volume. Although the base portion 210 is shown as having a substantially hexagonal perimeter profile (from a top view or from a horizontal cross-sectional view), in other embodiments the base portion 210 can be differently shaped. For example, in some embodiments, the base portion can be frustoconical. In some embodiments, the base portion can be substantially cylindrical (e.g., as shown in FIG. 6).

In some embodiments, as shown in FIGS. 1-4, the base portion 210 can be tapered outwardly, such that the base 210 is wider at its second end portion 214, which is closer and lower to the ground or other support surface, than at its first end portion 212. The larger width (or diameter) second end portion 214 of the base portion 210 increases the stability of the base portion 210, in comparison, for example, to a base portion with side portions 216 that are substantially perpendicular to the support surface. Said another way, the first end portion 212 of the base can be narrower in circumference (or have a smaller diameter or maximum width, or shorter perimeter length) than the corresponding dimension of the second end portion 214 of the base portion 210. In some embodiments, for example, the base portion 210 includes a first end portion that is about 18 inches in diameter or maximum width and a bottom portion that is about 24.5 inches in diameter or maximum width. The base portion can have an outer perimeter (e.g., from a top view) in the shape of a polygon. In some embodiments, the outer perimeter of the base portion is in the shape of a polygon that is the same as the outer perimeter shape of the plurality of elongate pommel segments 122. The perimeter of the first end portion 212 and/or second end portion 214 of the base portion can be shaped like a circle, square, triangle, rectangle, a hexagon, octagon, decagon, or other polygon.

In some embodiments, for example, the top, or first end portion 212, of the base portion 210 has a hexagon perimeter shape (from a top view) that is about 10 inches to about 24 inches in diameter (at the widest diameter of opposing points of the hexagon). In some embodiments, the first end portion 212 of the base portion 210 can have any suitable diameter or maximum width, including a diameter or maximum width within the range of about 10 inches to about 30 inches, about 15 inches to about 25 inches, or about 18 inches to about 22 inches. In some embodiments, the first end portion 212 of the base portion 210 has a diameter or maximum width that is about 15 inches, about 16 inches, about 17 inches, about 18 inches, about 19 inches, about 20 inches, about 21 inches, or about 22 inches. For example, the first end portion 212 of the base portion 210 can be a hexagon shape with an about 18 inch maximum width (measured at the widest opposing points of the hexagon).

Figure 7:
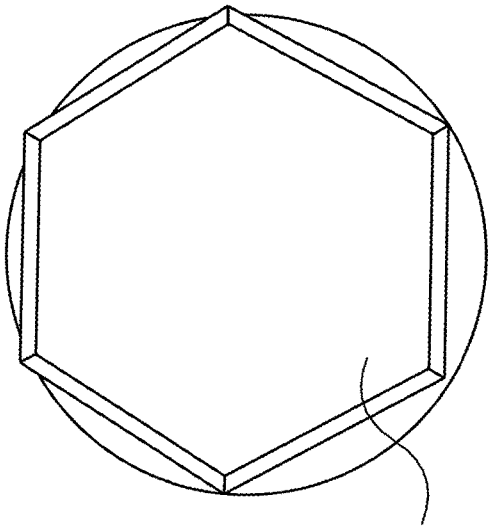
FIG. 7 is top view of a portion of an apparatus according to an embodiment.
Figure 8:
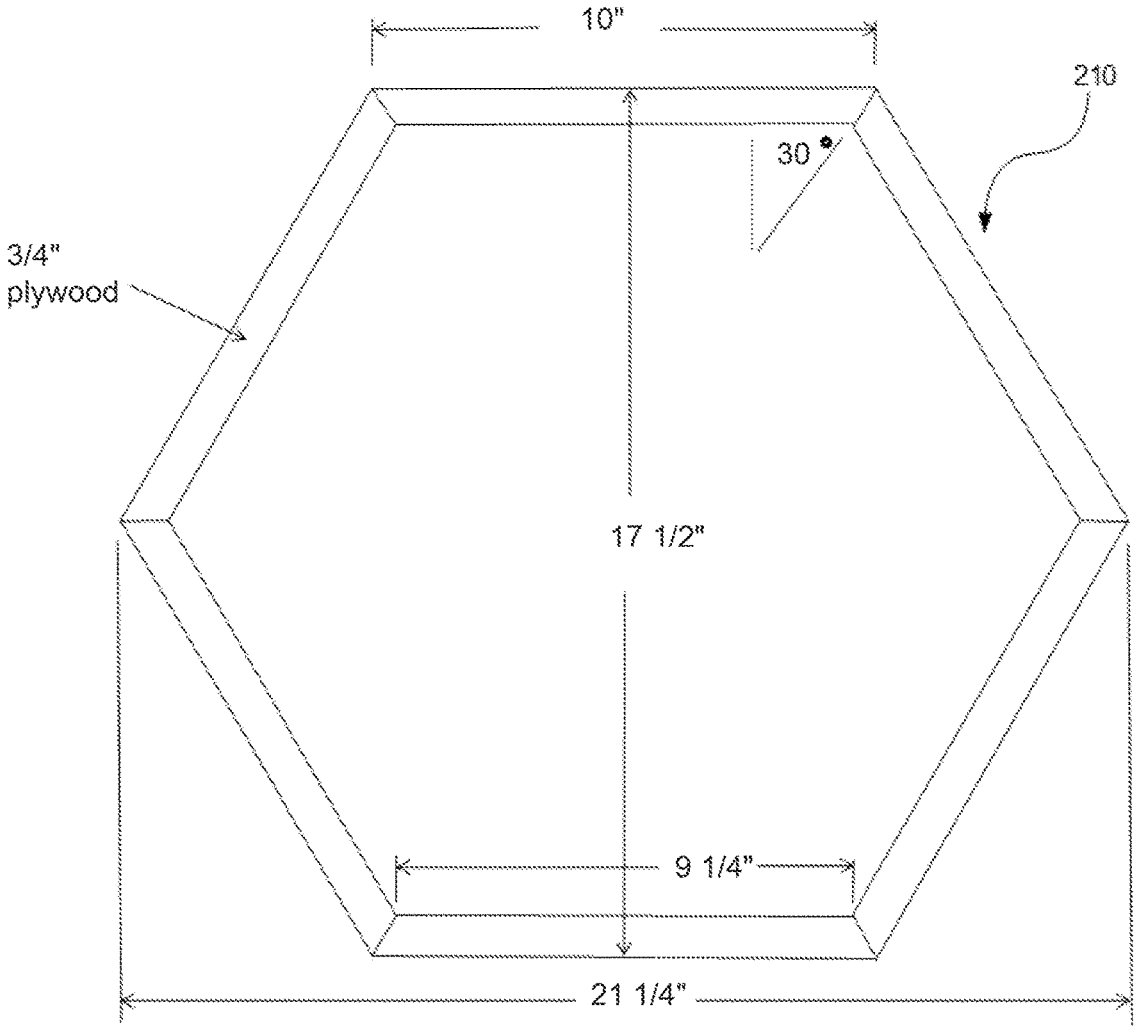
FIGS. 8-10 are schematic top, front and side views, respectively, of a base portion of the apparatus of FIG. 1.
Figure 9:
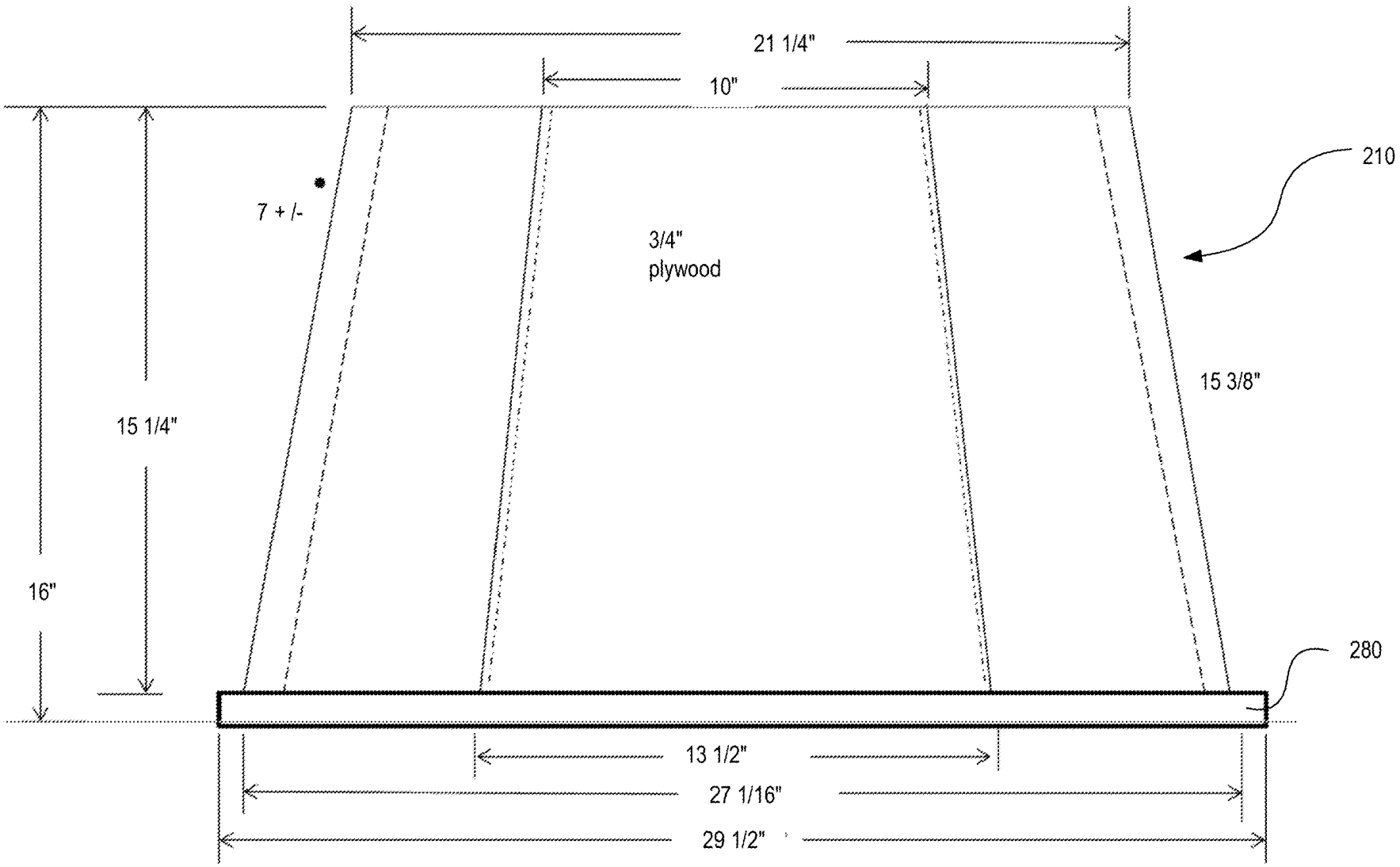
Figure 10:
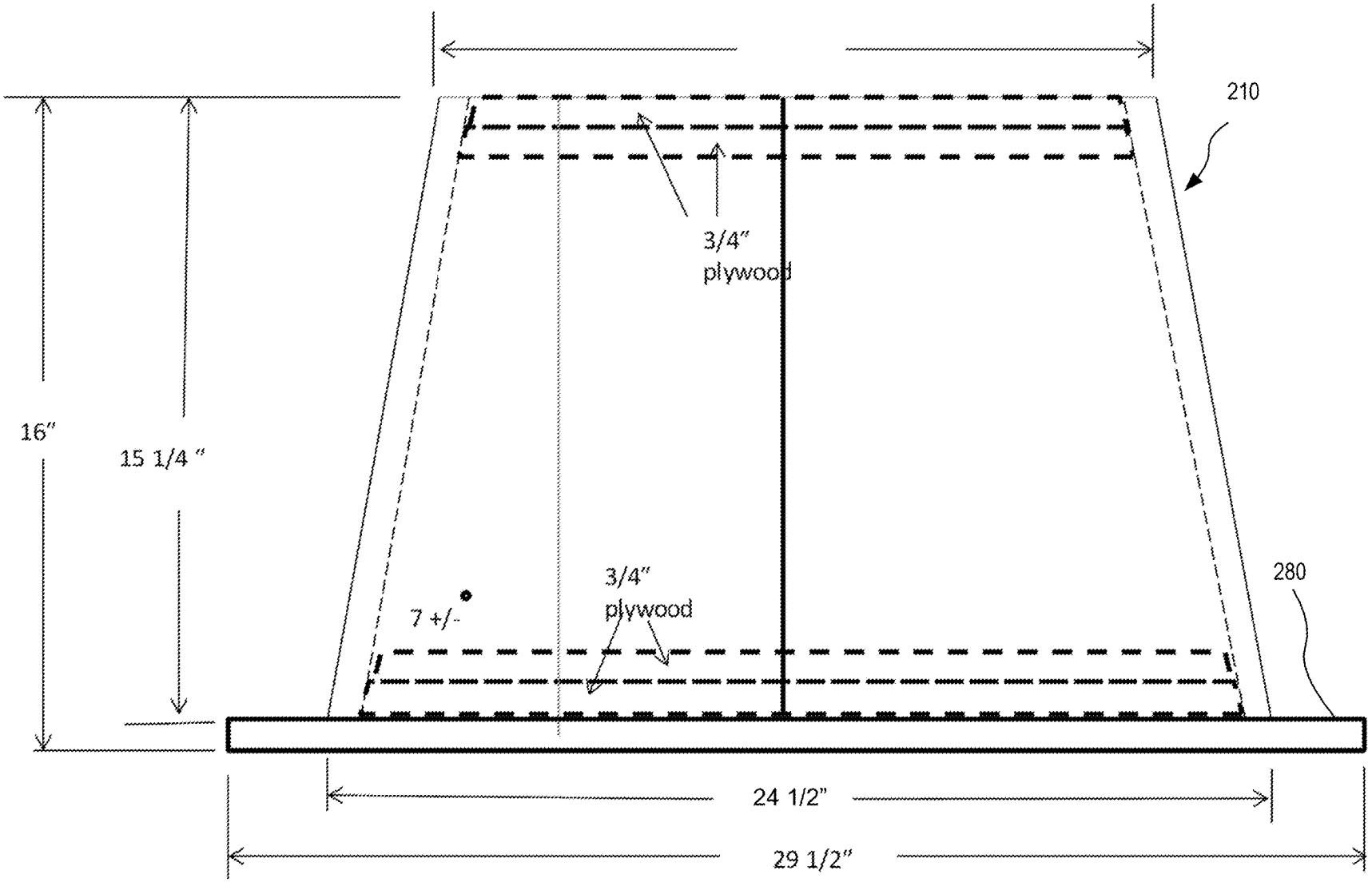
Figure 11:
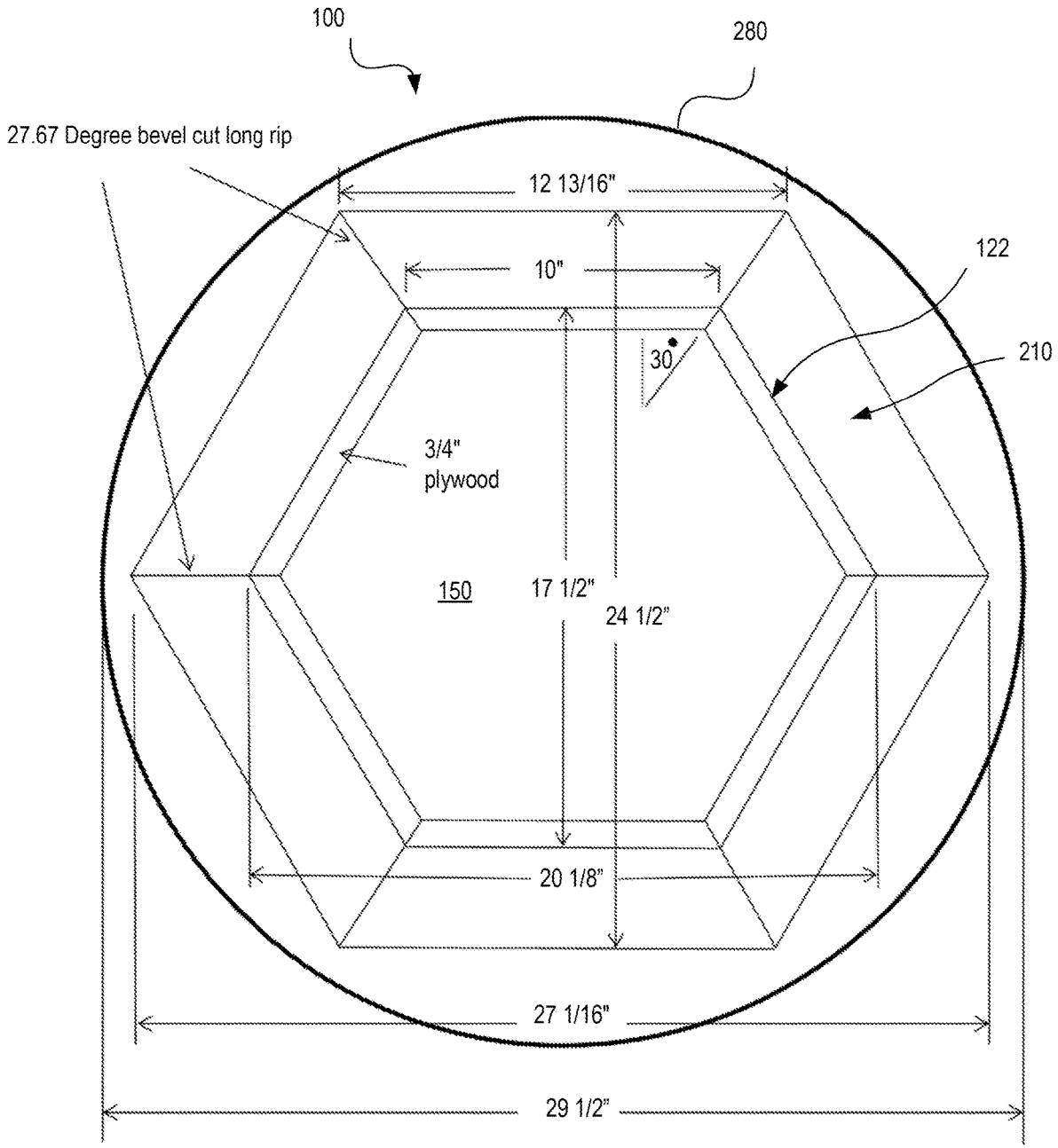
FIG. 11 is a schematic top view of the apparatus of FIG. 1.

Although the base portion 210 shown in FIG. 1 includes tapered sidewalls 216, in other embodiments, an apparatus can include a base portion 260 that has one or more side portions that are substantially straight or otherwise parallel with respect to a vertical axis of the apparatus (or orthogonal to the floor or other support surface). For example, as shown in FIG. 7, a base portion 260 with a hexagonal perimeter shape (from a top view) can include side portions that are substantially parallel with respect to a vertical axis of the base portion.

In some embodiments, for example, the second end portion 214 of the base portion 210 can have any suitable diameter or maximum width, including a diameter or maximum width within the range of about 10 inches to about 40 inches, about 20 inches to about 36 inches, or about 26 inches to about 32 inches. In some embodiments, the second end portion 214 of the base portion 210 has a diameter or maximum width that is about 24 inches, about 26 inches, about 28 inches, about 30 inches, about 32 inches, or about 34 inches. For example, the second end portion 214 of the base portion 210 can have a hexagon-shaped perimeter and have an about 30 inch maximum width (measured at the widest opposing points of the hexagon). FIGS. 8-13 illustrate additional views of the apparatus 100 of FIGS. 1-5, or portions thereof. Examples of suitable dimensions and suitable materials for components or portions of the apparatus 100, including for the base portion 210, are shown in FIGS. 8-13, however, the apparatus 100 can include components or portions having different dimensions than that shown in FIGS. 8-13, as described herein, and/or can be constructed of one or more different materials, or combination of materials, than that shown in FIGS. 8-13, as described herein. For example, the base portion 210 can be constructed of any suitable material, including, for example, any material described herein with respect to the support member 150. For example, the base portion can be constructed of wood (e.g., hickory, walnut, oak, or any other type of ¾" inch plywood), fiberglass, plastic, or any other suitable material, or combination of the materials.

In some embodiments, the base portion 210 is attached to a foundation 280. The foundation 280 can have any suitable shape. For example, as shown in FIG. 1, the foundation 280 can have an upper surface, a lower surface, and have a perimeter (from a top or bottom view) that is substantially circular. Although the foundation 280 is shown as having a perimeter that is circular, in other embodiments, the foundation 280 perimeter can have a different shape, including, for example, any perimeter shape described herein with respect to the first end portion 212 and/or second end portion 214 of the base portion 210, or with respect to the support member 150 of the pommel portion 110. The foundation 280 can be any suitable size, including, for example, a size having a diameter (or width) that is within the range of about 18 inches to about 42 inches. In some embodiments, the foundation 280 has a maximum width (which, for polygonal shaped embodiments, is measured corner or vertex to opposing corner or vertex) within the range of about 30 inches to about 42 inches, or that is about 32 inches, about 36 inches, or about 42 inches. In some embodiments, the foundation can be constructed of ¾ inch plywood, or other suitable material, measuring about 30 inches in diameter. The foundation is configured to add weight and stability to the apparatus. One objective met by the foundation is to add weight and width to the base portion to make a superior and more stable apparatus, in comparison to known trainer bases (e.g., a cylindrical base of a known mushroom trainer). The foundation can be made out of hickory, walnut, oak, or any other suitable substitute of plywood. It can also be made of plastic, fiberglass, metal, or any suitable combination of materials.

Figure 5:
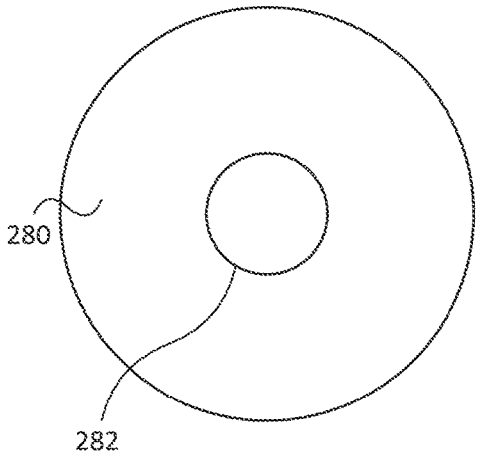

In some embodiments, as shown in FIG. 5, the foundation 280 and/or a support plate (not shown) at the second end portion 214 of the base portion 210 can define an opening 282. The opening 282 can be sized and configured to permit access by a user to the lower surface of the support plate 220 at the first end portion 212 of the base portion 210 and/or to the lower surface of the support member 150 of the pommel portion 110 disposed on the base portion 210. For example, a fastener or coupling mechanism configured to couple the pommel portion 110 to the base portion 210 can be accessed through the opening 282. In other embodiments, the foundation 280 is devoid of such an opening. In some embodiments, the base portion (any base portion described herein, including, e.g., base portion 210, 250, 260, 610) can include a flange that is extended from at least a portion of a lower perimeter of the base portion. In some embodiments, the height of the base portion can be adjustable.

An apparatus 500 according to an embodiment is illustrated in FIGS. 14-20. The apparatus 500, or portions thereof, can be similar in many respects, or identical to, other apparatus (e.g., apparatus 100) described herein, and therefore may not be described in detail herein. The apparatus 500 is configured for use in training a gymnast or other athlete, for example, on execution of skills and maneuvers for the pommel horse. Said another way, the apparatus 500 can be, for example, a pommel horse training apparatus. The apparatus 500 can include a pommel portion 510, and optionally a base portion 610 and/or a foundation 680. The foundation 680 can be similar in many respects, or identical to, any foundation (e.g. foundation 280) described herein, and so may not be not described in detail herein.

The pommel portion 510 includes a plurality of elongate pommel segments 522 and a plurality of posts (or support posts) 524, which can collectively be referred to as a pommel 520, and, optionally, includes a support member 550. The pommel 520 can be coupled to the support member 550, as described herein. The plurality of elongate pommel segments 522 includes a first pommel segment 521 and a second pommel segment 523. A centerline (not shown, but see, e.g., the centerline represented by dashed line CL1 shown in FIG. 4) of the first pommel segment 521 is non-parallel to a centerline (not shown, but see, e.g., the centerline represented by dashed line CL2 shown in FIG. 4) of the second pommel segment 523. An interior angle formed by an intersection of the centerline of the first pommel segment 521 and the centerline of the second pommel segment 523 can be within the range of about 45 degree to about 144 degrees, within the range of about 90 degrees to about 135 degrees, and more particularly, about 120 degrees. The centerline of the first pommel segment is coplanar with the centerline CL2 of the second pommel segment. Said another way, the centerlines and are each linearly arranged on a substantially common geometric plane.

The pommel segments 522 can be coupled together, for example, the first pommel segment 521 is coupled to the second pommel segment 523. An end portion of an elongate pommel segment 522 (e.g., the first pommel segment 521) can be coupled to an end portion of an adjacent elongate pommel segment 522 (e.g., second pommel segment 523) via any suitable coupling mechanism, such as an adhesive, fastener (e.g., a screw), a weld, a dowel, or the like, or any combination thereof. In some embodiments, the plurality of elongate pommel segments 522 are monolithically constructed, and optionally are monolithically constructed with the plurality of posts 524. As shown, each elongate pommel segment (e.g., the first pommel segment 521) is in contact with and directly coupled to another elongate pommel segment (e.g., the second pommel segment 523). The plurality of elongate pommel segments 522 can be coupled together in a manner that results in an upper surface of the pommel portion 510 being substantially smooth and/or substantially free of any outwardly extending protrusions. Each pommel segment can have a substantially cylindrical body portion between a first end portion and a second end portion thereof. The elongate pommel segments 522 are each substantially linear. The elongate pommel segments 522 can each be substantially uniform in circumference along its length (or at least a majority of its length, e.g., between opposing end portions thereof). End portions of one or more of the elongate pommel segments 522 can be beveled or otherwise angled, which can help in accurately and smoothly aligning an end portion of one elongate pommel segment 522 with an end portion of an adjacent elongate pommel segment 522 during construction thereof into a polygonal arrangement.

Each pommel segment can be substantially similar in many respects, or identical to, any pommel segments described herein, including, for example, pommel segments 122. For example, each elongate pommel segment is sized and shaped to be gripped by a hand of a user. For example, a cross-sectional diameter of the elongate pommel segment 522 can be about 1 inch to about 1.5 inches. For example, the elongate pommel segment 522 can have a diameter of about 1⅜ inch. The elongate pommel segment 522 can be constructed of hickory, walnut, oak, or other wood, plastic, fiberglass, metal, or any other suitable material. The elongate pommel segment 522 can have a length in the range of about 3 inches to about 18 inches. Each elongate pommel segment 522 can have a length within the range of about 7 inches to about 12 inches, about 8 inches to about 11 inches, or about 9 inches to about 10 inches. In some embodiments, the elongate pommel segment 522 can be about 9⅜ inches in length. In some embodiments, the elongate pommel segment 522 can be about 10.5 inches in length.

Figure 16:
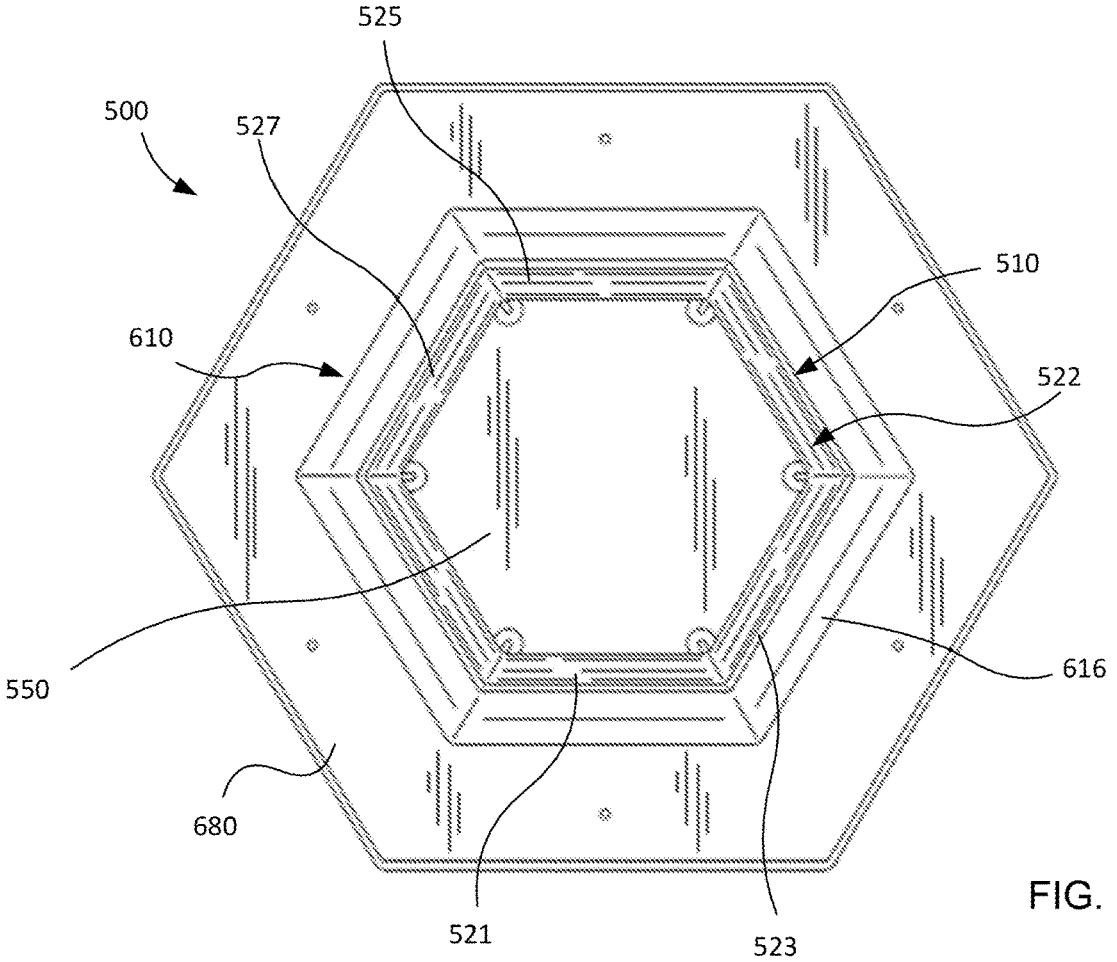
FIGS. 16-19 are top, side, front, and bottom views, respectively, of the apparatus of FIG. 14. The rear and opposing side views are identical to the front and side views, respectively.
Figure 17:
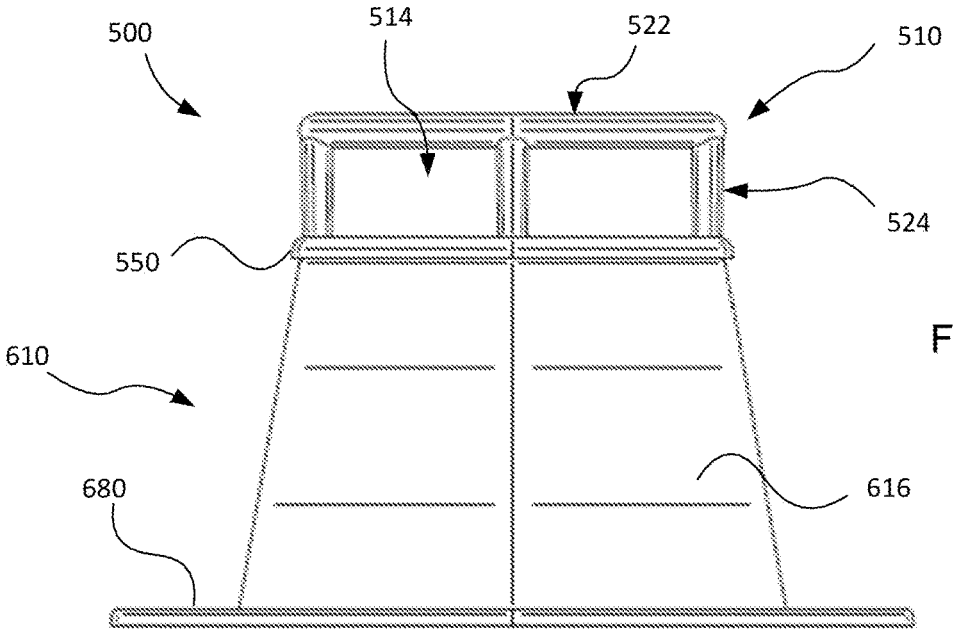
Figure 18:
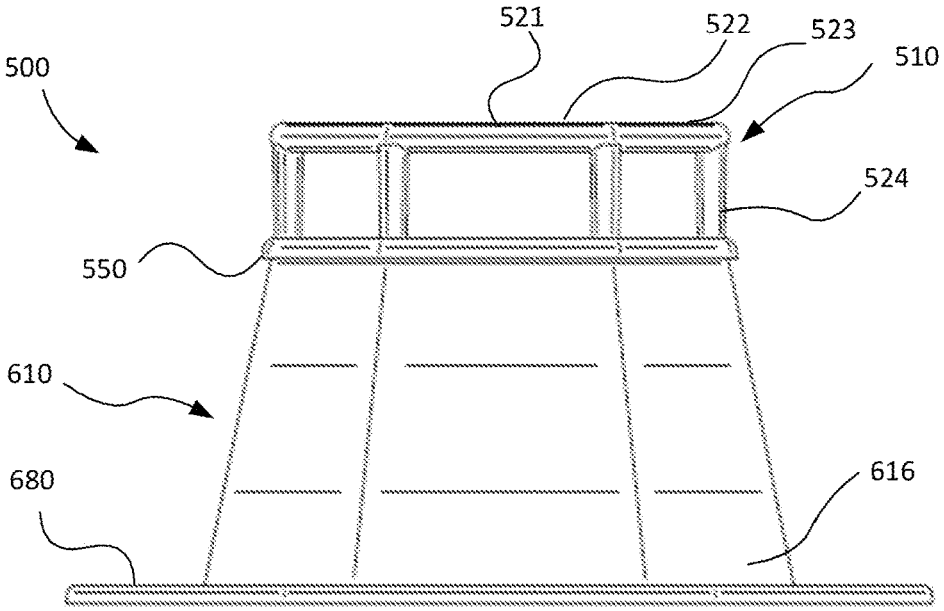

The plurality of elongate pommel segments 522 includes six pommel segments. As shown in FIG. 16, the six elongate pommel segments 522 (also referred to herein as horizontal members) are collectively arranged into the shape (e.g., from a top view) of a polygon. Said another way, the plurality of elongate pommel segments can be arranged to form a geometric shape that has an outer perimeter (e.g., from a top view) in the shape of a polygon. More specifically, as shown in FIG. 16, the plurality of elongate segments can have an outer perimeter in the shape of a hexagon. The pommel portion 510, as a whole, can also have (e.g., from a top view) an outer perimeter in the shape of the polygon, including, for example, a hexagon.

The plurality of pommel segments 522 can be arranged to form a closed geometric shape. In this manner, end portions of adjacent pommel segments are in contact such that the outer perimeter shape formed by the plurality of pommel segments 522 is continuous. In some embodiments, the plurality of pommel segments 522 define an opening within the closed geometric shape. The opening can be defined, for example, by an inner perimeter of the plurality of pommel segments 522 (from the top view). In other embodiments, however, the collective arrangement of the plurality of elongate pommel segments, however, can have any suitable geometric shape described herein.

The pommel portion 510, or more specifically the plurality of elongate pommel segments 522, can include multiple sets of parallel pommel segments. For example, a first set of parallel pommel segments can include the first pommel segment 521 and a third pommel segment 525 from the plurality of elongate parallel pommel segments 522, which third pommel segment 525 has a centerline (not shown) that is substantially coplanar with and parallel to the centerline of the first pommel segment 521. A second set of parallel pommel segments can include the second pommel segment 523 and a fourth pommel segment 527 from the plurality of elongate parallel pommel segments 522, which fourth pommel segment 527 has a centerline (not shown) that is substantially coplanar with and parallel to the centerline of the second pommel segment 523. The first set of parallel pommel segments is coupled to (and in some embodiments, directly coupled to, as shown in FIG. 4) the second set of parallel pommel segments. The second set of parallel pommel segments are nonparallel to the first set of parallel pommel segments. Each pommel segment from the first and second sets of parallel pommel segments is linearly arranged on a substantially common geometric plane (e.g., similar to plane P shown in FIG. 3A). The pommel portion 510 can include a third set of parallel pommel segments, which is non-parallel to each of the first set of parallel pommel segments and the second set of parallel pommel segments. Each pommel segment from the sets of parallel pommel segments can be linearly arranged on a substantially common geometric plane. In some embodiments, each pommel segment from the plurality of pommel segments 522 has a centerline that is disposed on a geometric plane. Arrangement of the plurality of elongate pommel segments in a geometric shape having two or more parallel sets of elongate pommel segments, such as the hexagon, can be particularly useful in pommel horse training, as described herein. In some embodiments, the pommel portion 510 includes a single pommel (not shown in FIG. 16) that can be at least partially disposed within an inner perimeter of the geometric arrangement formed by the plurality of elongate pommel segments 522. In some embodiments, the single pommel is similar in many respects, or identical to pommel 140 or pommel portion 710 (including pommel 720 and outer pad 712) described herein.

The pommel portion 510 includes the plurality of support posts 524 coupled to the plurality of elongate pommel segments 522 such that the plurality of support posts space the plurality of elongate pommel segments apart from a support surface (e.g., support member 550, a base portion described herein, the floor, the ground, or the like). In this manner, the plurality of support posts 524 couple the elongate pommel segments 522 to the support member 550 such that the elongate pommel segments 522 are spaced apart from and vertically disposed above the support member 550 when the apparatus 500 is disposed in an upright position on a support surface, as described herein. The support posts 524 can be substantially similar in many respects, or identical to, any support post (e.g., support posts 124) described herein, and so are not described in detail.

The support post 524 can have any suitable size and dimension, including, for example, a diameter within the range of about 0.5 inches to about 2 inches, or within the range of about ⅞ inches to about 1.5 inches. Each support post 524 (which can be, e.g., upright or vertically arranged dowel-like supports, and may also be referred to as a vertical member) can have a height within the range of about 1 inch to about 12 inches. Each support post from the plurality of support posts 524 has substantially the same height. The support post 524 can be constructed of any suitable material, including, for example, those described herein with respect to the elongate pommel segment 522. The apparatus 500 is shown as including six support posts 524, each of which is disposed adjacent end portions of adjacent elongate pommel segments 522. As such, the number of elongate pommel segments 522 in the plurality of elongate pommel segments can be the same as the number of support posts 524. In other embodiments, however, the number of plurality of elongate pommel segments 522 can be less than or more than the number of support posts 524.

The posts 524 can be coupled to the support member 550, for example using any suitable coupling mechanism, including, but not limited to a screw or other fastener, a weld, or the like. In some embodiments, the posts 524 and/or the plurality of elongate pommel segments 522 can be monolithically formed with the support member 550. In some embodiments, the support post 524 is partially disposed in a hole defined by the support member 550, to help couple the support post 524 to the support member in a substantially vertical orientation (e.g., such that a center axis of a length of the support post 524 is transverse to, or orthogonal to, a horizontal axis of, or plane defined by, an upper surface of the support member 550). In some embodiments, the support member 550 includes a recess adjacent each support post 524. In this manner, a coupling mechanism (not shown in FIG. 14) (e.g., a screw, dowel, or the like) can be used to couple the support post 524 to the support member 550 such that the coupling mechanism is countersunk or otherwise recessed below a surface 552 of the support member 550.

In some embodiments, the plurality of elongate pommel segments 522 (or the plurality of elongate pommel segments 522 and the plurality of support posts 524, collectively the pommel 520) of the pommel portion 510 can have a maximum width (e.g., from a top view or a bottom view) of about 12 inches to about 24 inches. In some embodiments, the pommel can have a maximum width (e.g., from a top view or a bottom view, measured to the outside edge of the pommel segments 522 from the top view) of about 16 inches (e.g., 16⅜ inches or 16½ inches), about 17 inches (e.g., about 17⅛ inches) or about 18 inches (e.g., 17⅝ inches or 18.5 inches).

The pommel portion 510 optionally includes the support member 550. The support member 550 can be substantially similar in many respects, or identical to, any support member (e.g., support member 150) described herein. For example, the support member 550 can have any size, shape, or the like, or be constructed of any suitable material as described herein with respect to support member 150. The support member 550 includes an upper surface, a lower surface, and an outer perimeter (from a top view). The support member 550 is coupled to the elongate pommel segments 522 via the support posts 524 as described herein. In some embodiments, a surface (e.g., the upper surface) of the support member 550 and an inner perimeter defined by the plurality of elongate pommel segments collectively define, from a top view of the pommel portion 510, an interior region or volume 514 (see, e.g., FIG. 17). In some embodiments, the support member 550, the plurality of posts 524 and the plurality of elongate pommel segments 522 collectively define the interior volume 514 (see, e.g., FIG. 17).

The support member 550 is configured to be disposed on, and to couple the pommel portion 510 to a base portion 610, as described herein. The upper surface of the support member 550 can be substantially planar (e.g., flat). The lower surface of the support member 550 can be substantially planar, or can have a different configuration to enable the support member 550 to be coupled to the base portion 610 or a second support member (not shown). The outer perimeter of the support member 550 can be polygonal, as shown, or round, or have another suitable shape. The outer perimeter of support member 550 can be the same shape as the geometric shape formed by the arrangement of the plurality of elongate pommel segments 522 (i.e., a hexagon).

In some embodiments, the apparatus 500 includes one or more pads configured to be coupled to one or more portions of the pommel portion 510. For example, as shown in FIG. 44-47, the support member 550 can include a pad 530 (or padded portion) disposed on or otherwise coupled to an upper surface of the support member 550. The pad 530 can be disposed on a surface of the support member 550, for example, within the interior region collectively defined (e.g., from a top view of the pommel portion) by the surface of the support member 550 and the inner perimeter defined (from a top view) by the plurality of elongate pommel segments 522. The pad 530 can be removably coupled to the upper surface of the support member 550. The pad 550 can be configured to help prevent injury by contact of the user with the upper surface of the support member 550 during use. The pad 550 can be configured to simulate (e.g., to the touch of a gymnast) a surface of a pommel horse saddle. The pad 530 can, for example, have a leather or other material disposed over one or more layers of padding (including any suitable padding described herein). The pad 530 can be used, for example to place the user's hand thereon, during execution of a gymnastic skill.

Figure 44:
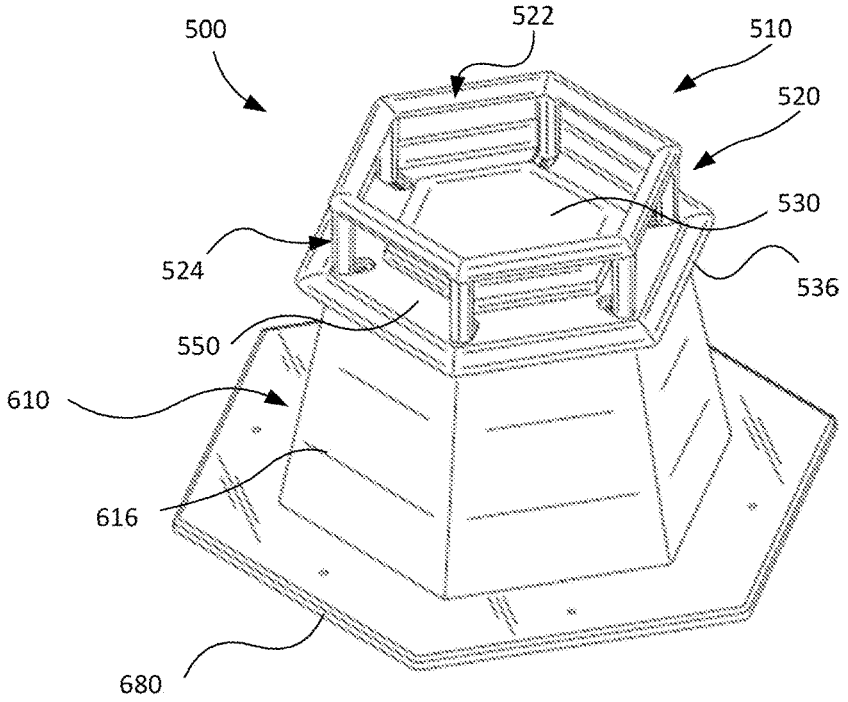
FIGS. 44-48 are perspective, front, right side, top and bottom views of the apparatus of FIG. 14 according to an embodiment. The rear and left side views (not shown) are identical to the front and right side views, respectively. In other embodiments, the bottom view can be identical to the bottom view shown in FIG. 66.
Figure 45:
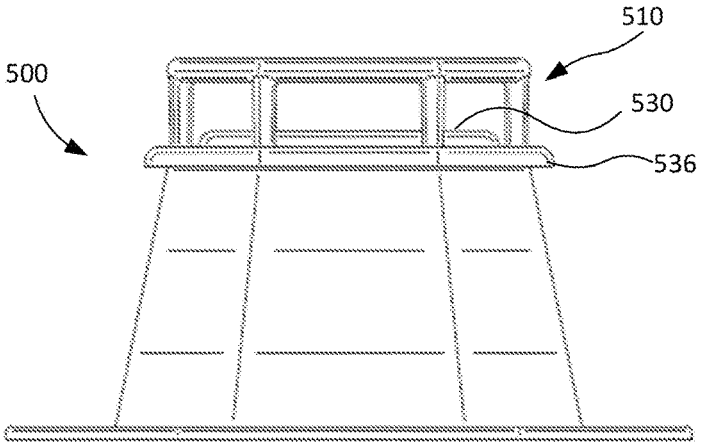
Figure 46:
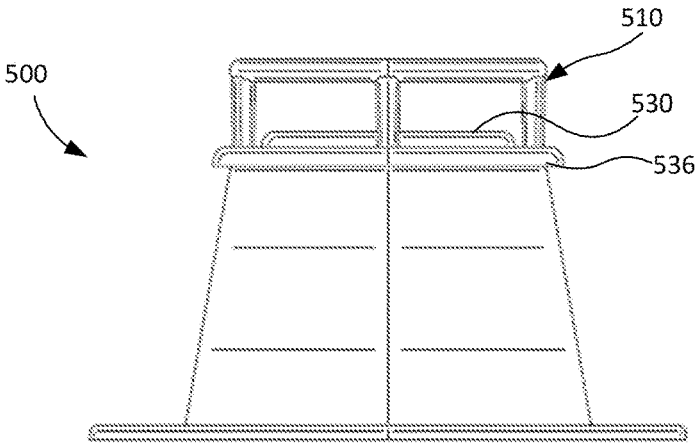
Figure 47:
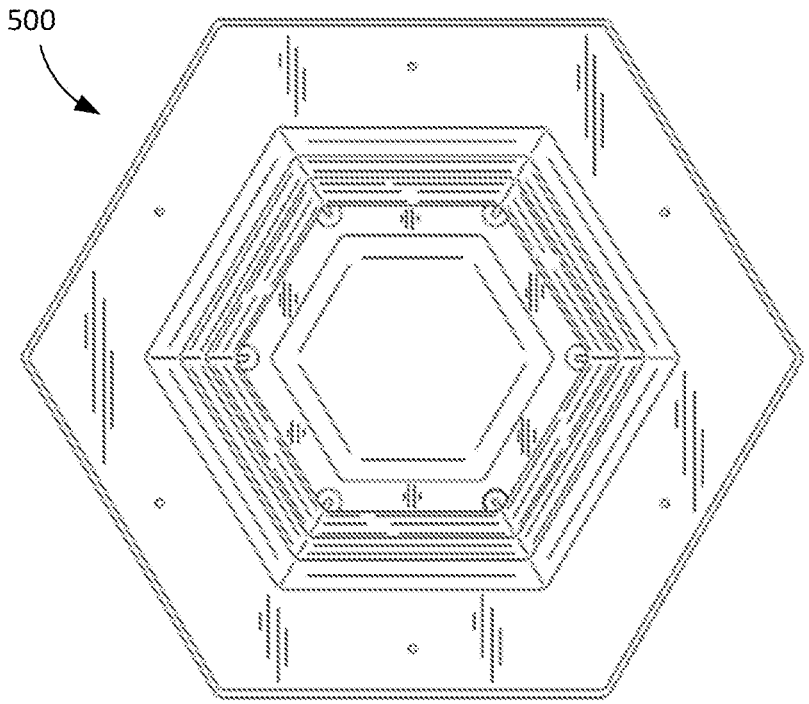
Figure 48:
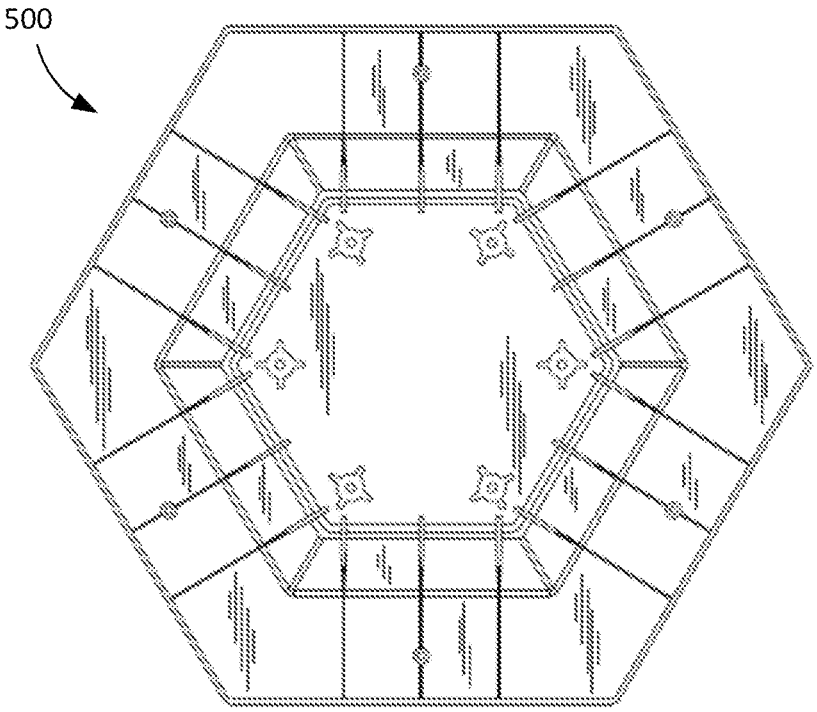
Figure 49:
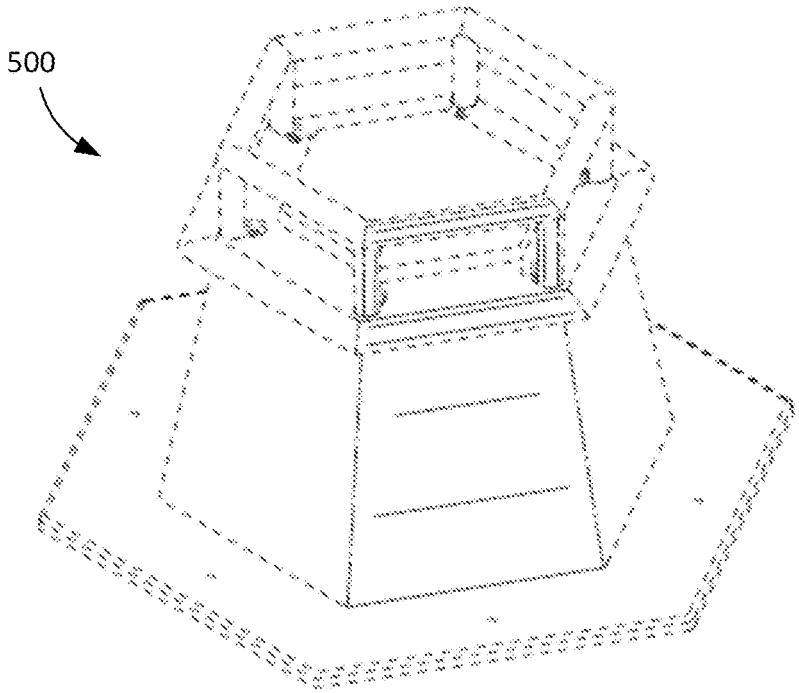
FIGS. 49-54 are perspective, right side, front, rear, top and bottom views of the apparatus of FIG. 44 according to an embodiment. The left side view (not shown) is identical to the right side view.
Figure 50:
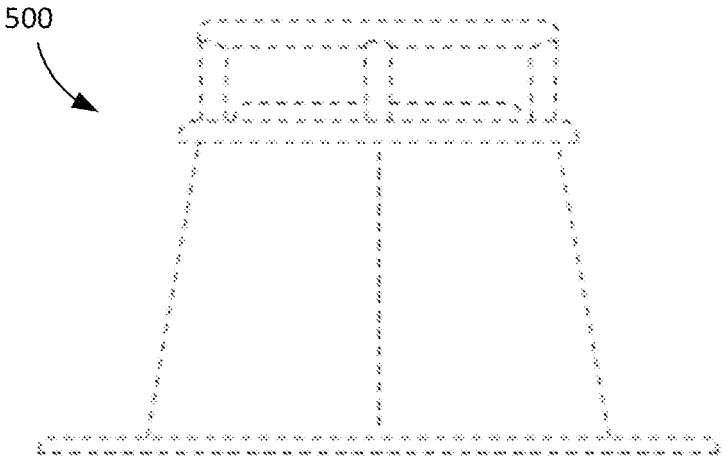
Figure 51:
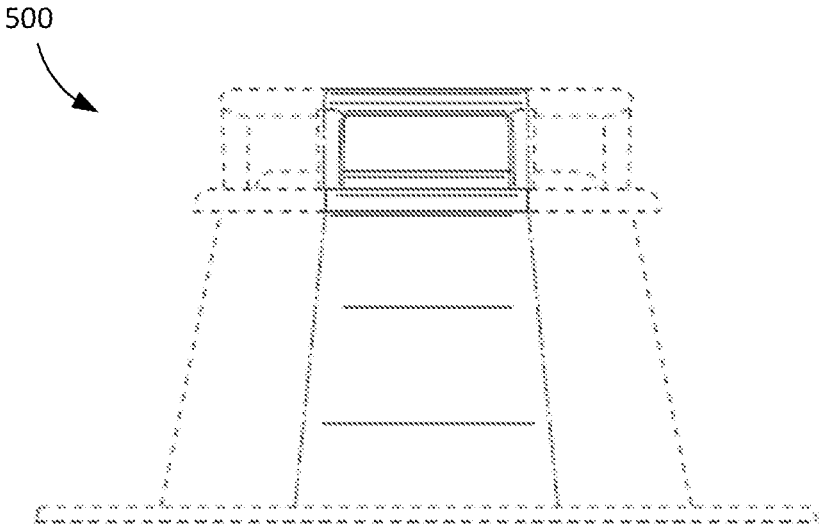
Figure 52:
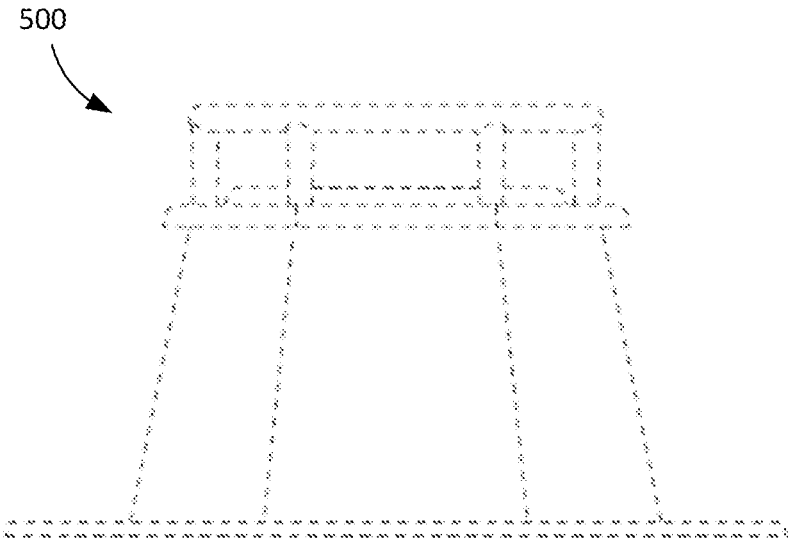
Figure 53:
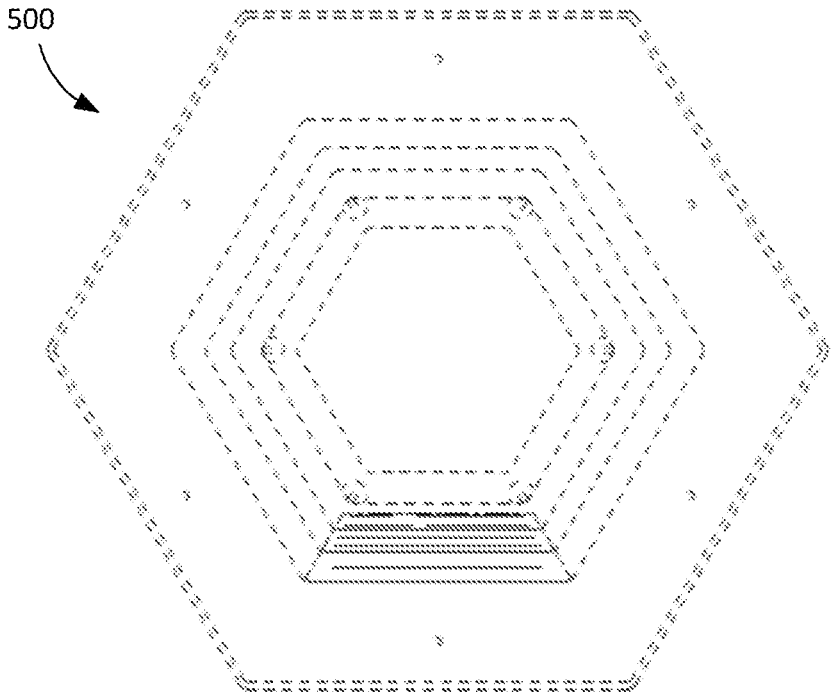
Figure 54:
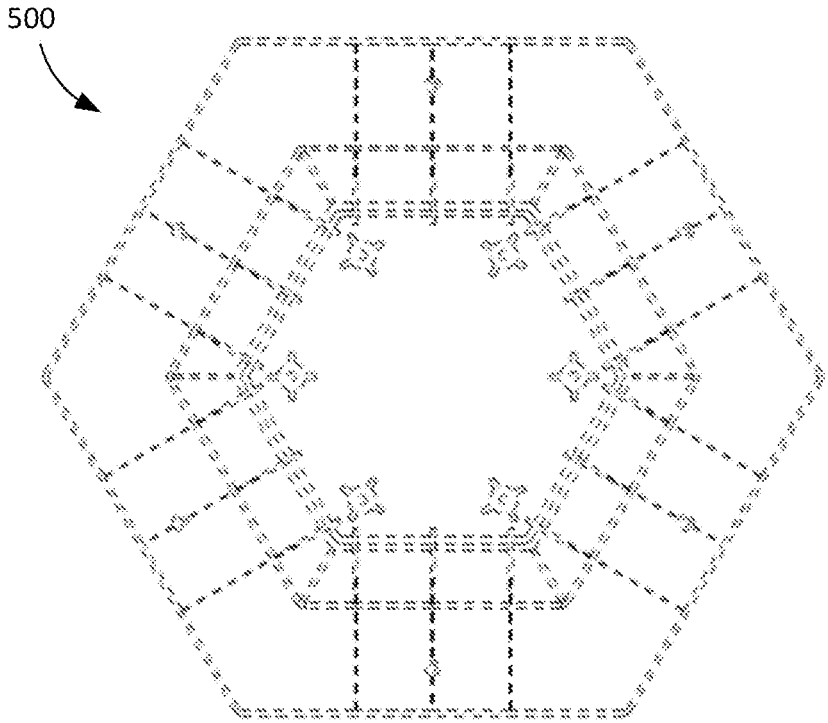
Figure 55:
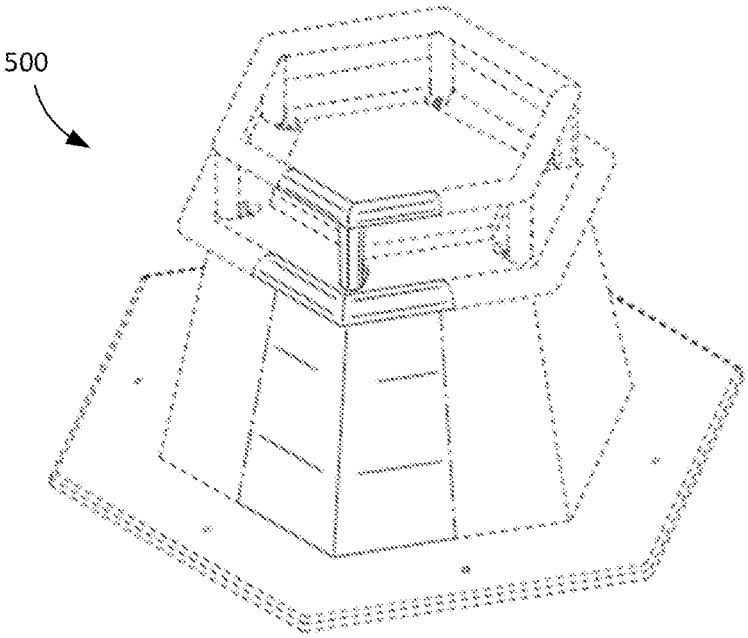
FIGS. 55-61 are perspective, front, rear, left side, right side, top and bottom views of the apparatus of FIG. 44 according to an embodiment.
Figure 56:
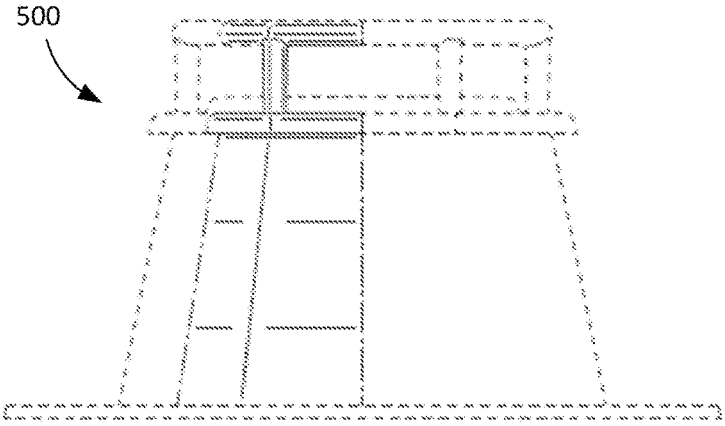
Figure 57:
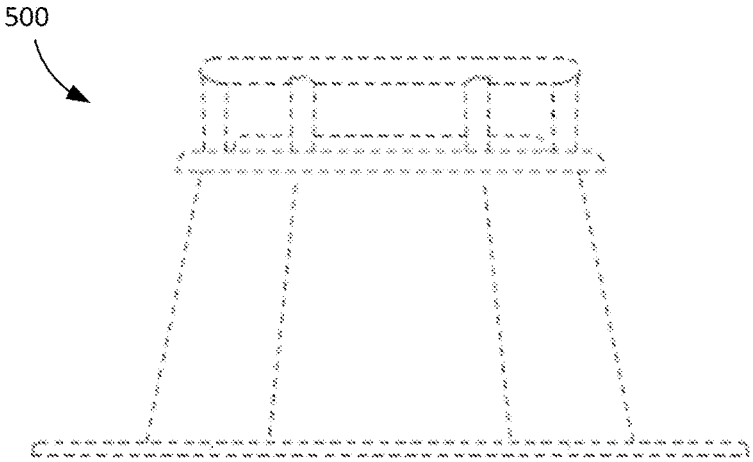
Figure 58:
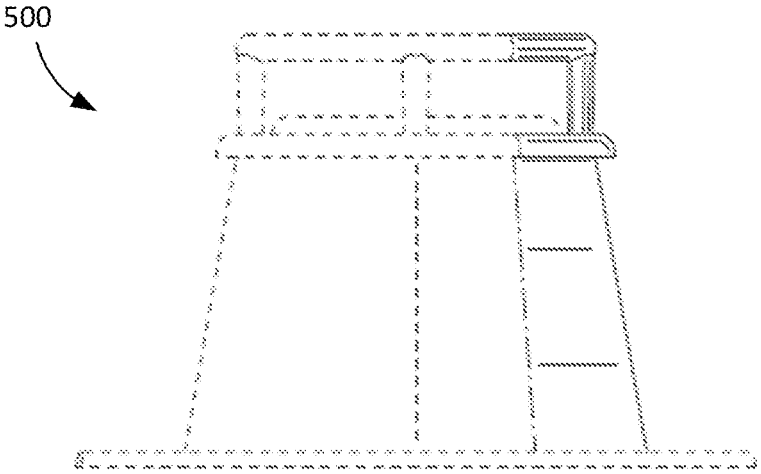
Figure 59:
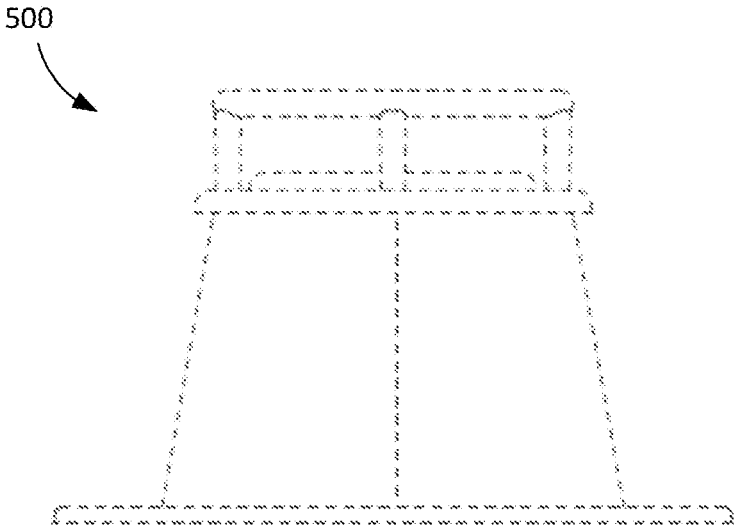
Figure 60:
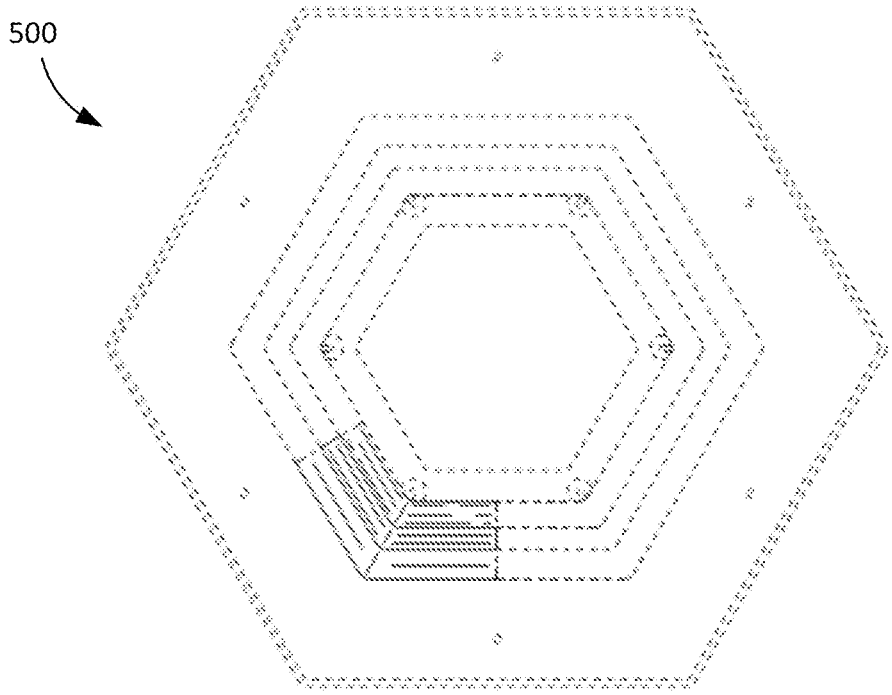
Figure 61:
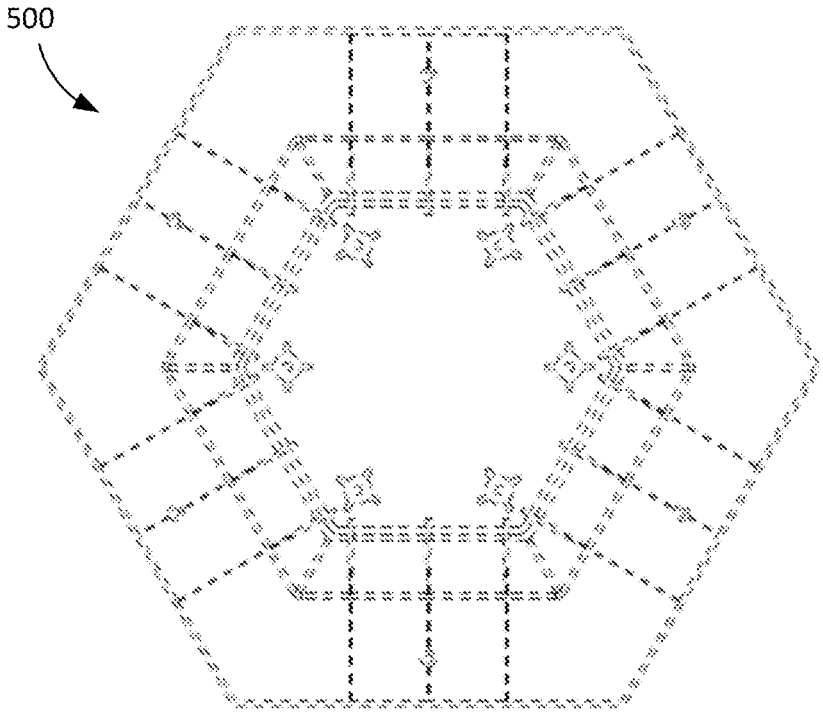
Figure 62:
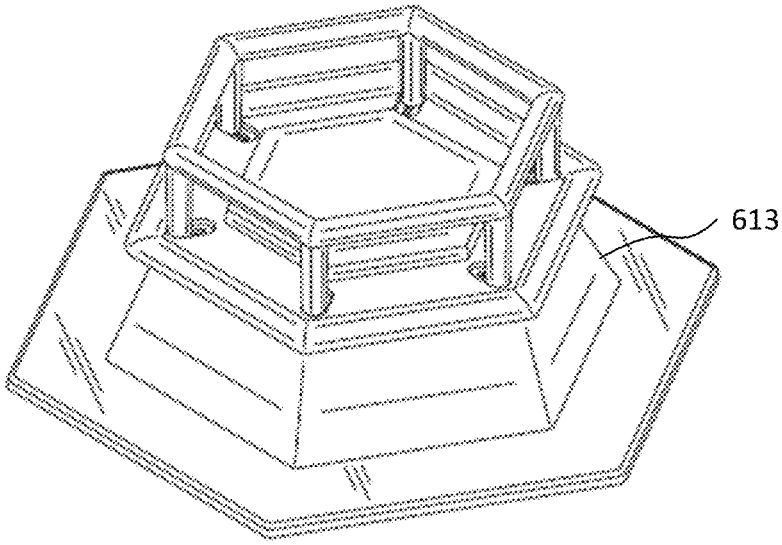
FIGS. 62-66 are perspective, front, right side, top and bottom views of an apparatus according to an embodiment. The rear and left side views (not shown) are identical to the front and right side views, respectively. In other embodiments, the bottom view can be identical to the bottom view shown in FIG. 48.
Figure 63:
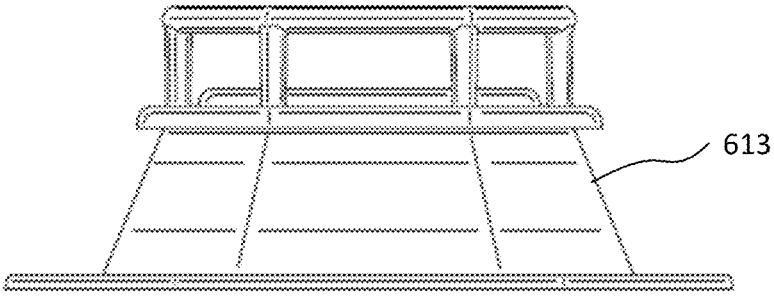
Figure 64:
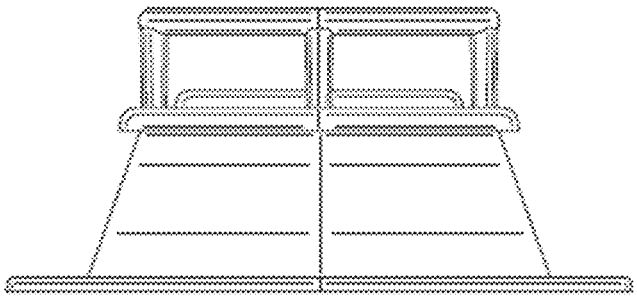
Figure 65:
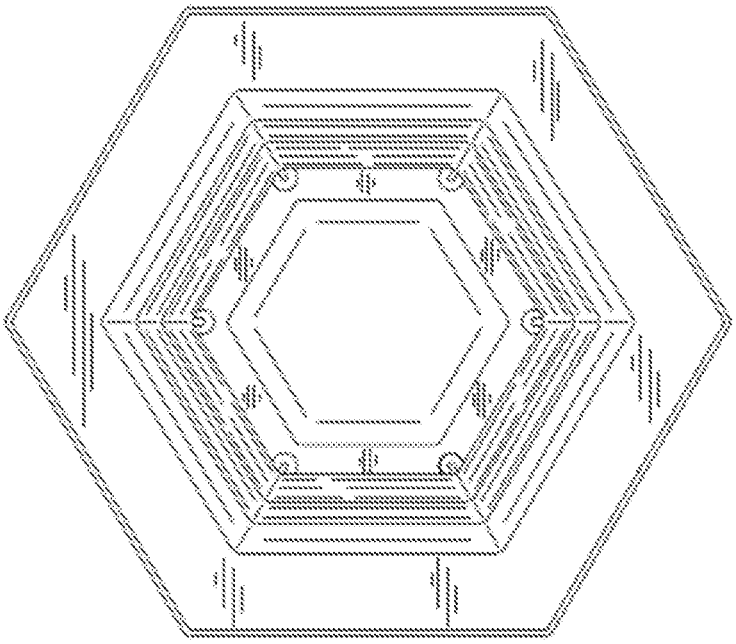
Figure 66:
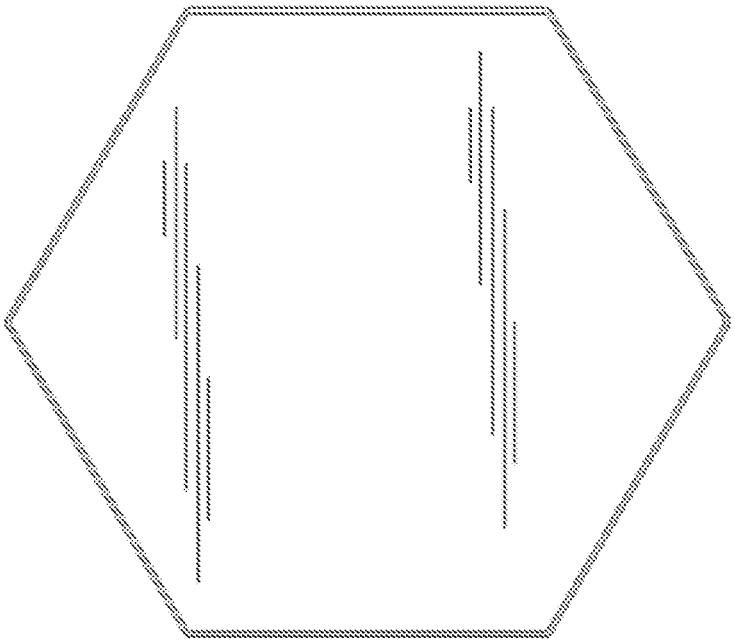
Figure 67:
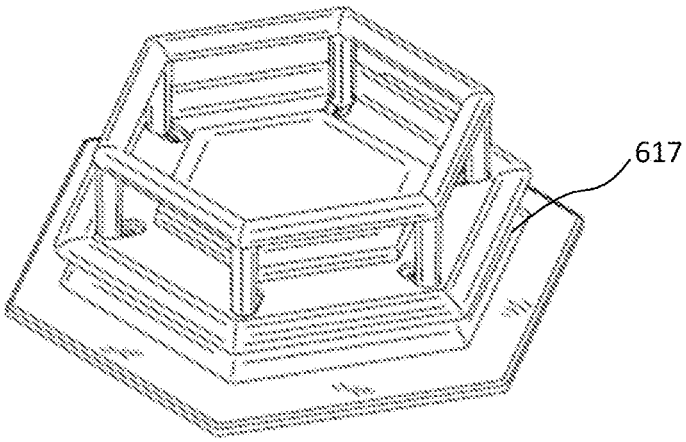
FIGS. 67-71 are perspective, front, right side, top and bottom views of an apparatus according to an embodiment. The rear and left side views (not shown) are identical to the front and right side views, respectively. In other embodiments, the bottom view can be identical to the bottom view shown in FIG. 48.
Figure 68:
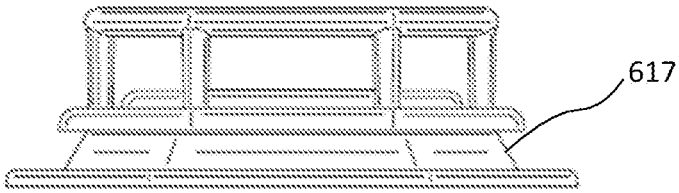
Figure 69:
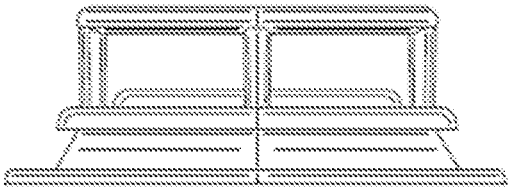
Figure 70:
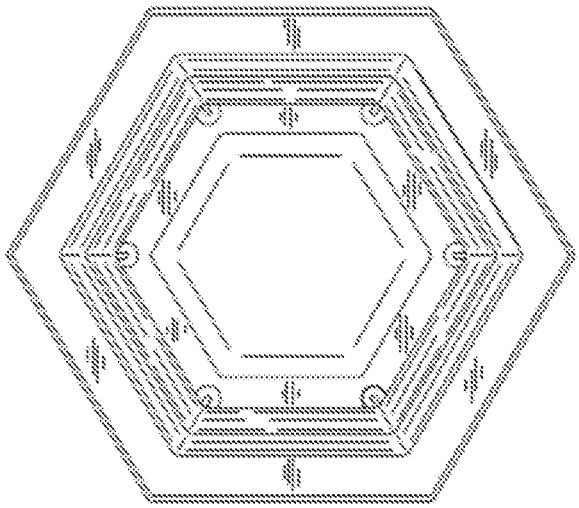
Figure 71:
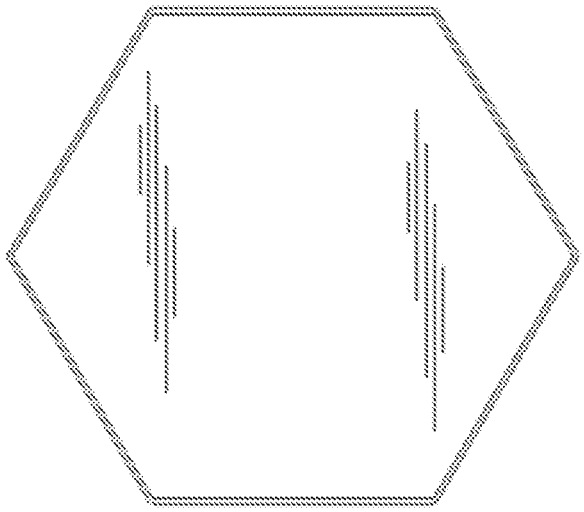

In some embodiments, the apparatus 500 includes a pad 536 (e.g., a perimeter pad) configured to be disposed on at least a portion of a perimeter (from a top view) of the support member (e.g., support member 150, 350, 550). The pad 536 can be disposed about at least a portion of the outermost perimeter of the pommel portion (e.g., pommel portion 110, 310, 510). Said another way, the pad 536 can be configured to be disposed over an outer surface of any corner or vertex of the perimeter of the support member 550. In this manner, the pad 536 helps to prevent injury to the user that may otherwise be caused by the user contacting the corner or vertex during use of the apparatus 500. The pad 536 can be configured to be disposed over substantially an entirety of the perimeter of the support member, such as shown in FIGS. 44 & 47. Each of pads 530, 536 can be similar in many respects, e.g., thickness or materials, to pads 170, 180. Also in some embodiments, the apparatus 500 includes one or more of pads 170, 180 for the pommel segments as described herein.

Figure 19:
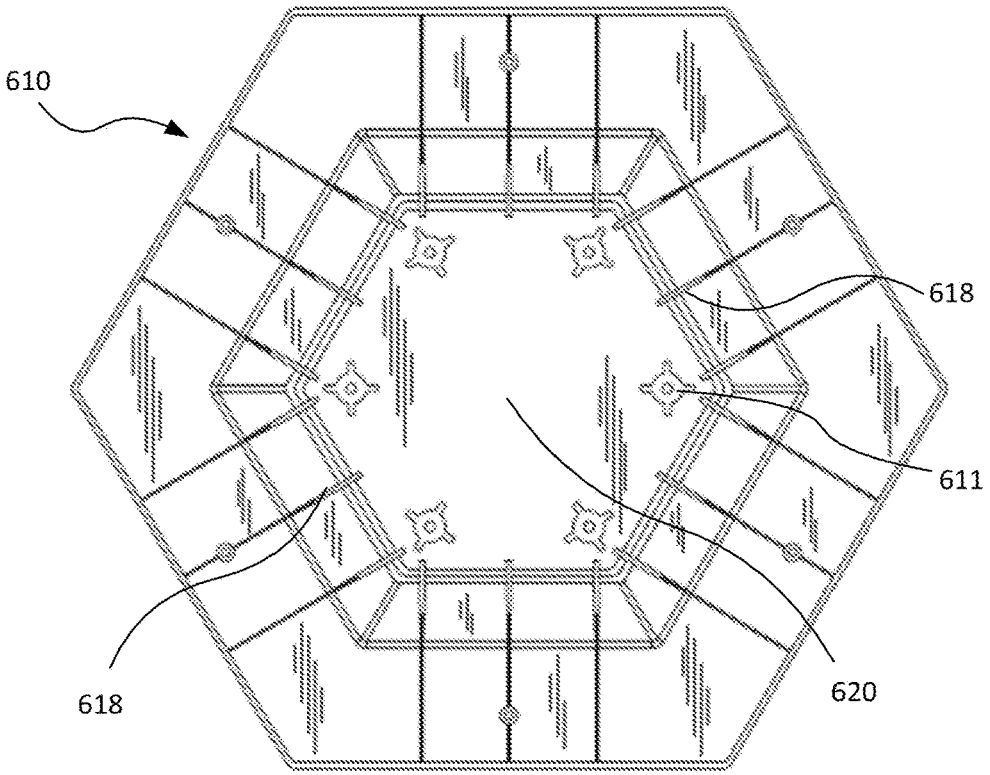

The base portion 610 of the apparatus 500 is configured to be coupled to the pommel portion 510. In some embodiments, the apparatus 500 includes fasteners 611 (e.g., one, two three, four, five, six, or more fasteners) configured to removably couple the support member 550 to the base portion 610, thereby coupling the pommel portion 510 to the base portion. The fastener 611 can be disposed through at least a portion of the support member 550 between the upper surface and the lower surface of the support member 550, and through at least a portion of an upper surface of the base portion 610. The fastener 611 can include one or more of, for example, a bolt (e.g., toggle bolt), wing nut, screw (e.g., hex screw), a quick-release lock, or the like. The fastener can be configured to be accessed (for coupling and/or uncoupling) via the upper surface of the support member 550, or, as shown in FIG. 19, the fastener 611 can be configured to be accessed via an underside of the upper surface of the base portion 610. The pommel portion 510 can be selectively coupled to a base portion different from base portion 610, e.g., having a different size, shape, or the like, as described in more detail herein. The support member 550, and thus the pommel portion 510, can be permanently coupled or affixed to the base portion 610.

Figure 14:
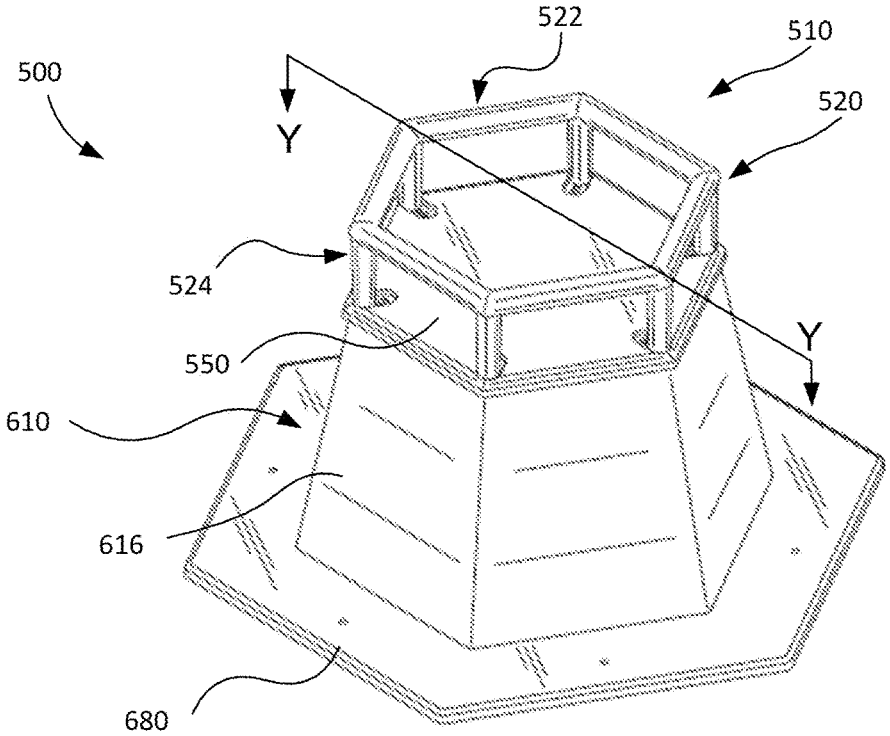
FIG. 14 is a perspective view of an apparatus according to an embodiment.

The base portion 610 is configured to support the pommel portion 510 in a vertically spaced relationship with respect to a support surface (e.g., the ground, floor, gymnastics mat, or other suitable surface), when the apparatus 500 is in an upright position. The base portion 610 can be substantially similar in many respects, or identical to, any base portion (e.g., base portion 210) described herein. The base portion 610 includes a first end portion 612, a second end portion 614 opposite the first end portion, multiple sidewalls (or side members) 616 disposed between the first end portion 612 and the second end portion 614. In the embodiment of FIG. 14, each sidewall 616 has a substantially planar or flat outer surface that has a perimeter that is substantially trapezoidal in shape. Edges or sides of the sidewalls 616 are coupled together. Although the base portion 610 is shown as having a substantially hexagonal perimeter profile (from a top view or from a horizontal plane cross-sectional view), in other embodiments the base portion 610 can be differently shaped.

Figure 15:
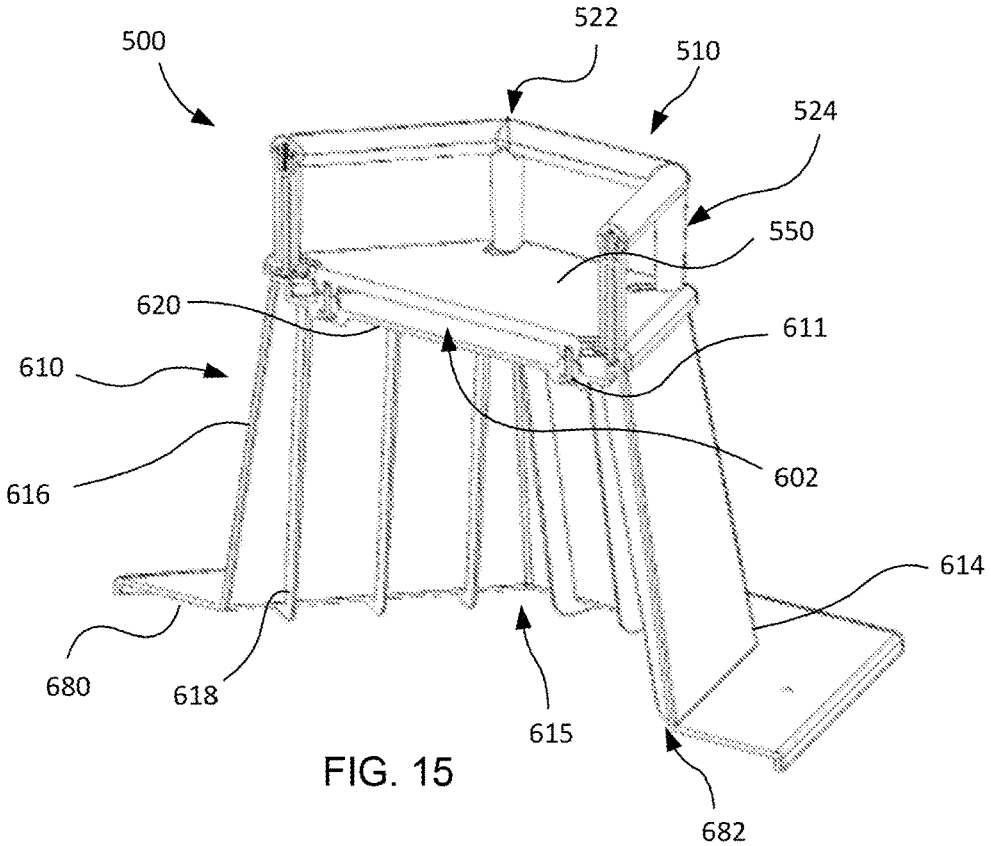
FIG. 15 is a perspective cross-section of the apparatus of FIG. 14 taken along line Y-Y in FIG. 14.

Elongated ridges 618 are optionally disposed on an inner surface of the sidewalls 626. The ridges 618 strengthen the sidewalls 616, thereby increasing the structural integrity of the base portion 610. Although each side member 616 is shown in FIG. 15 as including three ridges, in other embodiments, an apparatus can include any suitable number of ridges (e.g., one, two, four or more). Also, although the ridges 618 are shown in FIG. 15 as being substantially extended from a bottom portion of the sidewall 616 to a top portion of the sidewall, in other embodiments, the ridges can have a different length (e.g., such that one or more ridges has a length less than, e.g., ⅓, ½ or ⅔ of the height of the sidewall 616) and/or a different arrangement with respect to the sidewall (e.g., such that one or more ridges are diagonal or horizontal with respect to a height of the sidewall 616). In still other embodiments, the sidewall 616 can be reinforced in a different or additional manner, such as by a reinforcement member in a grid, diamond or other suitable pattern.

The base portion 610 includes a support plate 620 (see, e.g., FIG. 15) coupled to a first end portion 612 of the base portion 610 (e.g., to top portions of the sidewalls 616). The support plate 620 of the base portion 610 can be coupled to the support member 550 of the pommel portion 510, for example, via any suitable coupling mechanism or fastener 611 (such as screws), as shown in FIGS. 15 and 19. In this manner, the pommel portion 510 can be coupled to the base portion 610. In some embodiments, the support plate 620 and support member 550 collectively define an interior volume 602. The interior volume 602 can help to absorb or dissipate vibrational forces that may be generated during an athlete's use of the apparatus 500.

The base portion 610 has an interior volume 615 that can be collectively defined by the support plate 620, sidewalls 616, and optionally a foundation 680 (or other support surface), as shown in FIG. 15. The base portion 610 is tapered outwardly from the top portion 612 to the bottom portion 614, such that the base portion 610 is wider closer and lower to the ground or other support surface. The larger width (or diameter) bottom portion 614 of the base portion 610 increases the stability of the base portion 610, in comparison, for example, to a base portion with sidewalls 616 that are substantially perpendicular to a support surface. Said another way, the first end portion 612 of the base portion 610 can be narrower in circumference (or have a smaller diameter or maximum width, or smaller perimeter length) than the corresponding dimension of the bottom portion 614 of the base portion 610. The base portion 610 can have any suitable dimensions as described herein (e.g., with respect to base portion 210).

Figure 20:
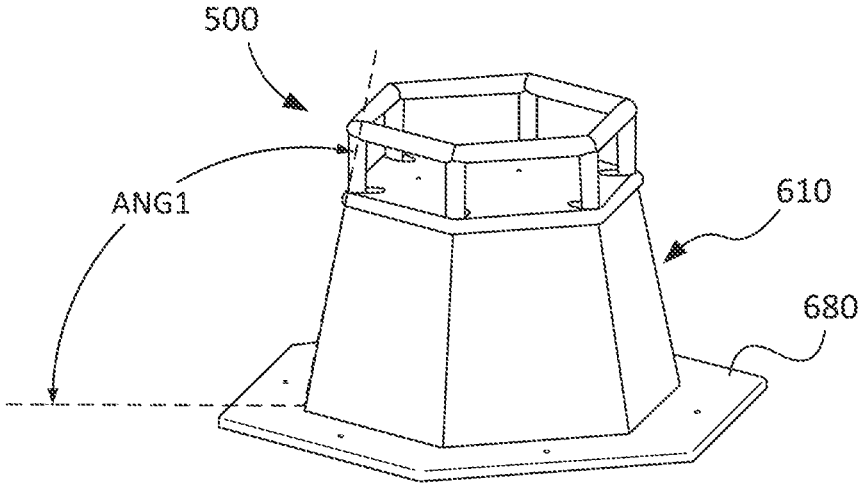
FIG. 20 is a perspective view of the apparatus of FIG. 14.
Figure 21:
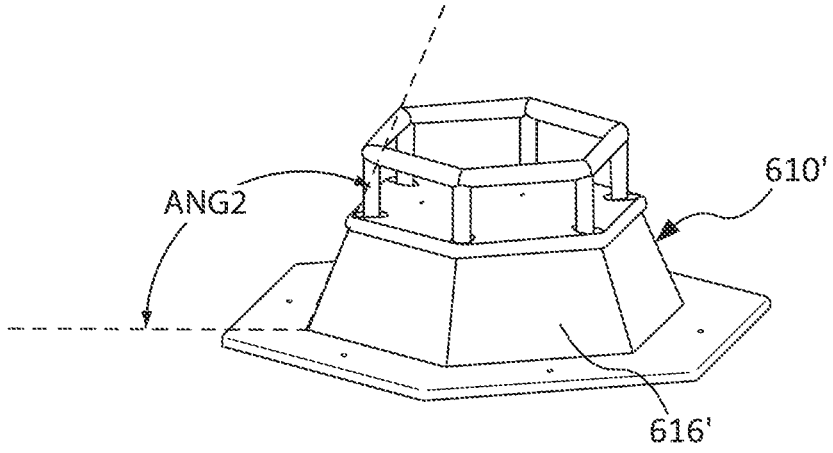
FIGS. 21-22 are perspective views of apparatus according to embodiments.
Figure 22:
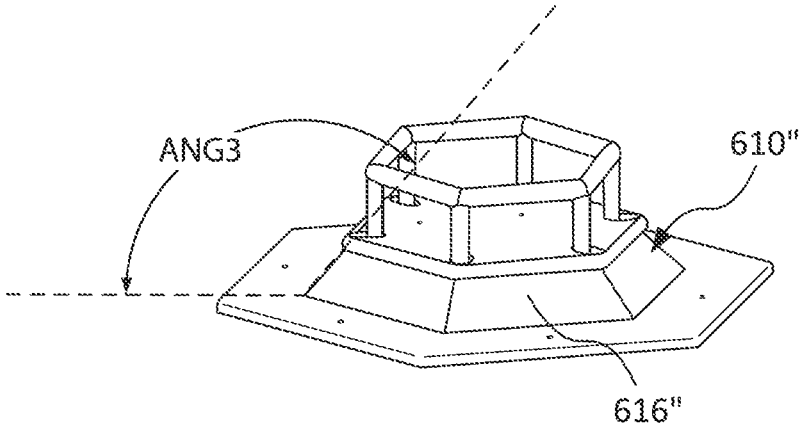

The base portion 610 can have any suitable height. The base portion 610 can be, for example, within the range of about 2 inches to 30 inches in height. For example, the base portion 610 can be about 16 inches in height. In other embodiments, as shown in FIGS. 21-22 and 62-71, the base portion 610 can have a height less than 16 inches. For example, a base portion 610' can have a height within the range of about 6 inches to 10 inches, or a height of about 8 inches. In another example, a base portion 610" can have a height within the range of about 2 inches to about 6 inches, or a height of about 4 inches. As base portions 610, 610' and 610" of decreasing height are considered, an angle formed between an upper surface of the foundation 680 and an outer surface of the side member 616 can optionally be increased, as shown in FIGS. 20-22, or decreased. In this manner, the support member 150 of the pommel portion 510 can be selectively coupled to, and therefore the pommel portion can be used with, base portions of different heights, which can be useful based on the skill level of the athlete or gymnast. For example, the apparatus 500 can include the pommel portion 510 and a set of base portions 610, 610', 610", 613, 617. In some embodiments, the pommel portion 510 can be used interchangeably with each base portion 610, 610', 610", 613, 617. Although specific angles ANG1 (e.g., about 101 degrees), ANG2 (e.g., about 115 degrees), ANG3 (e.g., about 132 degrees) are shown in FIGS. 20-22, respectively, in other embodiments, the base portion can have an angle of a different degree value formed between the outer surface of the side member 616 and the upper surface of the foundation 680. For example, an outer surface of side member 616' of base member 610' can form an angle with an upper surface of the foundation 680 that is within the range of about 105 degrees to about 125 degrees, within the range of about 110 degrees to about 120 degrees, or about 115 degrees. In another example, an outer surface of side member 616" of base member 610" can form an angle with an upper surface of the foundation 680 that is within the range of about 120 degrees to about 140 degrees, within a range of about 125 degrees to about 135 degrees, or about 131 degrees.

In some embodiments, the foundation 680 and/or a support plate (not shown) at the second end portion 614 of the base portion 610 can define an opening 682. The opening 682 can be sized and configured to permit access by a user to the lower surface of the support plate 620 at the first end portion 612 of the base portion 610 and/or to the lower surface of the support member 550 of the pommel portion 510 disposed on the base portion 610. For example, the fasteners 611 can be accessed through the opening 682. The foundation 680 can be devoid of such an opening.

Figure 23:
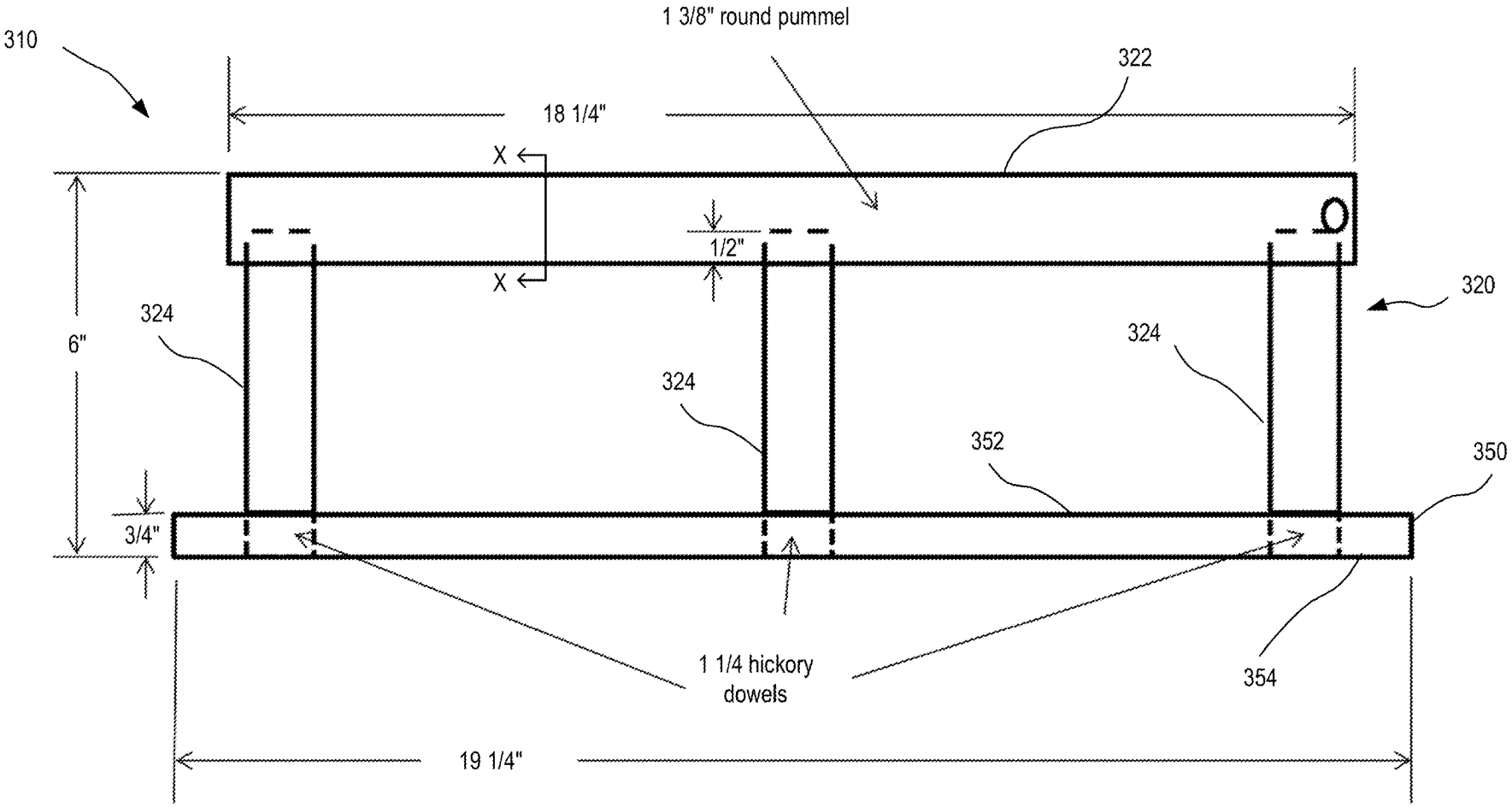
FIG. 23-24 are front and top views, respectively, of a portion of an apparatus according to an embodiment.
Figure 24:
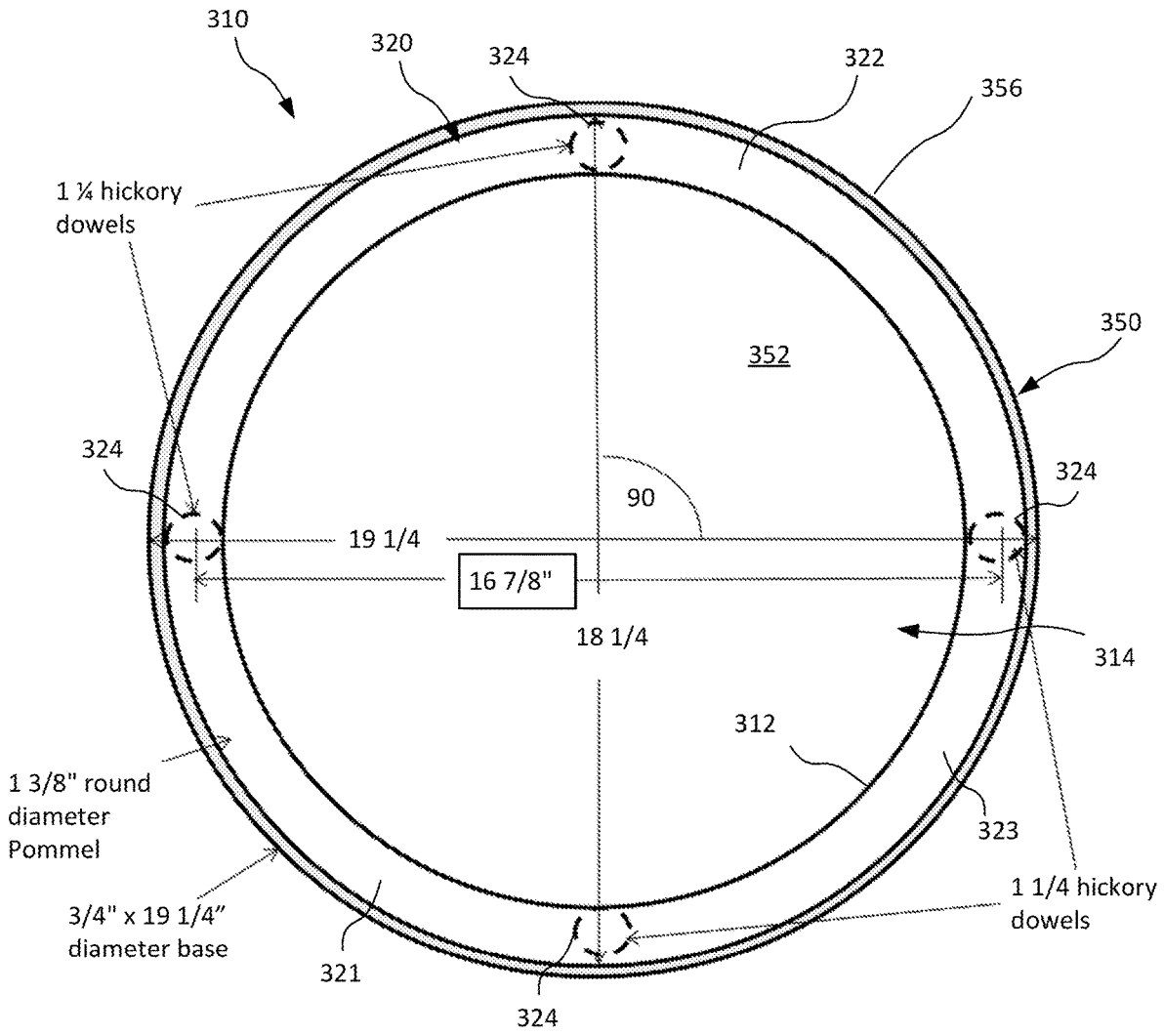

Although the apparatus (e.g., apparatus 100, 500) have been described herein as including a pommel portion having a plurality of elongate pommel segments arranged in a polygonal configuration, such as that of a hexagon, octagon, decagon, or the like, in other embodiments, an apparatus can include a pommel that has a plurality of elongate pommel segments arranged in a different configuration, such as a circle, oval, or the like. For example, as shown in FIGS. 23-24, an apparatus 300 according to an embodiment can include a pommel portion 310 that includes a pommel 320 and a support member 350. The pommel portion 310 can be coupleable to any base portion described herein (not shown in FIGS. 23-24) (e.g., base portion 210, base portion 610) or optionally to a saddle of a pommel horse. Accordingly, the base portion is not described herein with respect to FIGS. 23-24.

The pommel 320 has a substantially circular configuration (e.g., from a top view of the apparatus). Said another way, the pommel 320 forms a substantially closed loop that has an inner perimeter 312 defining an opening 314. Such a circular pommel 320 can be beneficial, for example, in the training of a beginner gymnast, Cross-Fit athlete, or any other athlete, and particularly for use in strengthening the upper body and core of the gymnast or athlete. Such a circular pommel 320 can also be beneficial for developing fundamental and basic skills needed by a gymnast for pommel horse exercises or maneuvers, and in particular for mastering the circle maneuver and other basic development skills on the pommel horse. In some instances, a gymnast, or other athlete or user, can train on such a circular pommel before progressing to training on a polygonal pommel, such as that as described herein (e.g., with respect to apparatus 100), and optionally after first doing body preparation exercises for developing the circle maneuver for the pommel horse.

In some embodiments, the pommel portion 310 includes a plurality of elongate pommel segments 322, which can be fixedly or removably coupled together (e.g., in any suitable manner, such as those described herein with respect to apparatus 100, 500). The pommel segments can optionally be monolithically formed. The pommel segments 322 can be disposed, for example, between support posts 324. The pommel portion 310, and the pommel segments 322 specifically, can have an upper surface that is substantially smooth and/or substantially free of any outwardly extending protrusions. The elongate pommel segments 322 can have a substantially circular (or other rounded shape) cross-sectional profile (e.g., taken along line X-X in FIG. 23). The plurality of elongate pommel segments 322 can have a substantially uniform cross-sectional width or diameter at substantially each location along its length (or at least a majority of its length). In the embodiment shown in FIGS. 23-24, the pommel portion 310 includes a plurality of elongate pommel segments 322 that may visually appear as a single piece and four support posts 324, however, in other embodiments, the pommel portion 310 can include a different number of pommel segments 322 and/or support posts 324. For example, the pommel can include one, two, three, four, five, seven, eight, nine, ten or more pommel segments or support posts. In some implementations, the pommel portion 310 can include a separate pommel (not shown) that can be disposed within an inner perimeter of the geometric arrangement formed by the pommel portion 310, as described herein (e.g., with respect to pommel portion 110 of apparatus 100 and/or pommel portion 510 of apparatus 500).

The elongate pommel segment 322 is sized and shaped to be gripped by a hand of a user. For example, a cross-sectional diameter of the elongate pommel segment 322 of the pommel 320 can be about 0.5 inches to about 2 inches, or about 1 inch to about 1.5 inches. For example, the elongate pommel segment 322 can have a cross-sectional diameter of about 1⅜ inches. The elongate pommel segment 122 can be constructed of hickory, walnut, oak, or other wood, plastic, fiberglass, metal, or any other suitable material.

The support post(s) 324 are configured to be coupled to the elongate pommel segment 322 and to couple the elongate pommel segment 322 to the support member 350 such that the elongate pommel segment 322 is spaced apart from and vertically disposed above the support member 350 when the apparatus 300 is disposed in an upright position on a support surface (e.g., a base as described herein, the floor, the ground, or the like). The support posts 324 (e.g., upright or vertically arranged dowel-like posts or supports) are used to support the pommel 320 with respect to the support member 350. In the embodiment shown in FIGS. 23-24, the pommel portion 310 includes four support posts. The four support posts are substantially equidistantly spaced with respect to the circularly arranged elongate pommel segments 322. In this manner, for example, the four support posts, from a top or bottom view, have a substantially square-shaped arrangement. The support post 324 is coupled at a first end to the support member 350 and at a second end to the elongate pommel segment 322. In some embodiments, the support post 324 is partially disposed in a hole or recess defined by the support member 350, to help couple the support post 324 to the support member in the vertical orientation (e.g., such that a center axis of a length of the support post 324 is transverse to, or orthogonal to, a horizontal axis of, or plane defined by, an upper surface of the support member 350).

The support post 324 can have any suitable size and dimension, including, for example, a diameter within the range of about 0.5 inches to about 2 inches, or within the range of about ⅞ (or 0.875) inches to about 1.5 inches. More specifically, each support post 324 can have a cross-sectional diameter of about 1.25 inches. Each support post 324 can have a height within the range of about 1 inch to about 12 inches. The support post 324 can be constructed of any suitable material, including, for example, those described herein with respect to the elongate pommel segment 322. For example, the support post 324 can be constructed of wood, plastic, fiberglass, or other suitable material, including, but not limited to, a hickory wood dowel.

In some embodiments, the plurality of elongate pommel segments 322 of the pommel portion 310 can have a diameter or maximum width (e.g., from a top view or a bottom view) of about 12 inches to about 26 inches. Said another way, an outer surface of the pommel 320 can have a diameter or maximum width of about 12 inches to about 26 inches. In some embodiments, the diameter (or maximum width) of the pommel 320 (or any pommel described herein, including pommel 120) is no less than about 12 inches.

The pommel 320 can be coupled to the support member 350, for example using any suitable coupling mechanism, including, but not limited to a screw or other fastener, a weld, or the like. In some embodiments, the pommel 320 can be monolithically formed with the support member 350 (e.g., by injection molding, such as using injection molded plastic, by carving from a single wood block or block of other suitable material). The pommel 320 includes a plurality of elongate pommel segments 322 and one or more support posts 324. The support member 350 can be similar, or identical, in many or all respects to any support member (e.g., support member 150) described herein. Accordingly, the support member 350 is not described in detail herein. The support member 350 includes an upper surface 352, a lower surface 354, and an outer perimeter 356. The upper surface 352 of the support member 350 can be substantially planar (e.g., flat). The lower surface 354 of the support member 350 can be substantially planar, or can have a different configuration to enable the support member 350 to be coupled to a base portion described herein (not shown in FIGS. 23-24, such as base portion 210) or a second support member (not shown in FIGS. 23-24) or other support surface. At least one of the upper surface 352, the lower surface 354 or a cross-section of the outer perimeter 356 of the support member 350 can have any suitable shape. For example, one of the upper surface 352, the lower surface 354 or the cross-section of the outer perimeter 356 of the support member 350 can have a circular shape (from a top or bottom view). In another example, one of the upper surface 352, the lower surface 354 or the cross-section of the outer perimeter 356 of the support member 350 can have a polygonal shape (e.g., a rectangle, a square, a hexagon, an octagon, a decagon, or the like), such as that described herein (e.g., with respect to support member 150). In some embodiments, the support member 350 has a diameter (or maximum width) of about 12 inches to about 28 inches.

The support member 350 is configured to support the pommel 320. Said another way, the support member 350 holds the pommel 320 by being coupled to the support posts 324, as described herein. The support member 350 can be constructed of any suitable material, including one or more materials as described herein (e.g., with respect to support member 150). For example, in some embodiments, the support member 350 can be constructed of wood (e.g., plywood, or more specifically ¾" plywood), plastic, fiberglass, or any other suitable material. In some embodiments, the support member 350 (or any support member described herein, including support member 150), or a portion thereof, can include an outer layer of material. For example, at least a portion of the support member 350, can include a layer of leather, carpet, foam, carpet-bonded foam, or other suitable material, which can provide padding for the comfort of the athlete during use and which can also improve the safety of the apparatus during use by covering a hard surface or potentially sharp edge of the apparatus.

Figure 28:
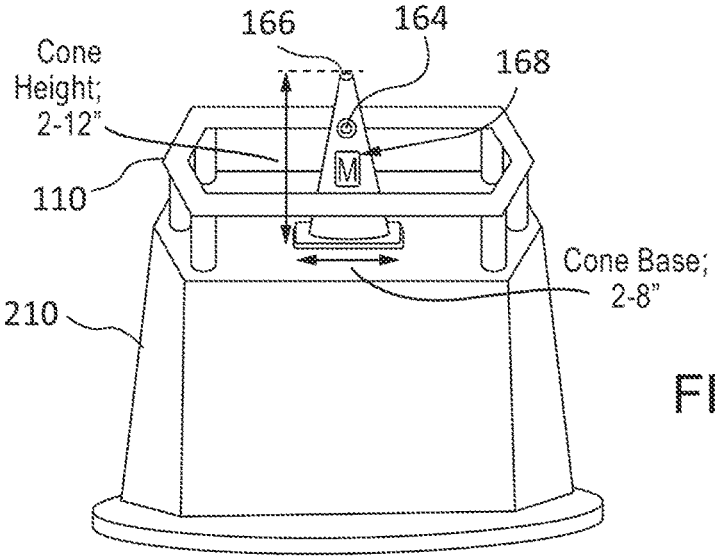
FIG. 28 is a front perspective view of the apparatus of FIG. 1 according to an embodiment.

Referring to FIG. 28, in some embodiments, the apparatus described herein (e.g., apparatus 100, 300, 500) can include a sensor 164. The sensor unit 164 can be removably coupled to the pommel portion 110, or other suitable portion of the apparatus. The sensor unit 164 is configured to detect movement of the athlete, gymnast or other user while performing exercises or other movements on the apparatus. In some embodiments, the sensor unit 164 includes a pressure sensor configured to detect contact by the athlete with the sensor or with a cone 166 to which the sensor unit 164 is coupled. For example, the sensor unit 164 can be configured to detect a threshold amount of pressure caused by contact of the user with the sensor unit. In some embodiments, the sensor unit 164 includes a movement sensor configured to detect movement within a predetermined distance from the sensor unit 164 or to detect movement of the sensor unit 164 or the cone 166. For example, the sensor unit can be configured to detect a threshold amount of movement of the sensor unit with respect to the pommel portion, or with respect to one or more known axes. In some embodiments, the sensor unit is configured to detect proximity, within a predetermined distance (e.g., up to about 3 cm), of the user with a portion of the sensor unit 164. Any suitable sensor, or combination of sensors, can be used, including but not limited to, a pressure sensor, movement sensor, orientation sensor, gyroscope, accelerometer, proximity sensor or the like. In some embodiments, multiple sensors are circumferentially disposed (e.g., continuously or in a spaced relationship) about a portion of the cone 166.

The cone 166 can be disposed on and/or coupled to an upper surface of the support member 150 (not shown in FIG. 28) or an upper surface of the base portion 210. The cone 166 can be any suitable size and shape. For example, the cone can be about 1 inch to about 12 inches in height. Although a cone is shown in FIG. 28, the cone or structure supporting the sensor unit 164 can have any suitable shape, including but not limited to a cube or cuboid, rectangular prism, pyramid, sphere, polyhedron, cone, cylinder, a frustoconical shape, or any other shape that is suitable for disposing within the pommel portion such that pommel horse exercise(s) can be properly performed there-around. In this manner, the cone 166 (or other suitable support structure) can vertically extend into a center area above and circumferentially defined by a plurality of elongate pommel segments (e.g., segments 122, 322, 522). The cone 166 (or any other suitable support structure) can be attached to the apparatus, for example, by a hook-and-loop fastener (e.g., Velcro®), button, strap or any suitable fastener or adhesive, or a combination thereof.

The sensor unit 164 can be configured to produce a signal or an output in response to detecting contact by the athlete with the sensor unit 164 or cone 166, detecting the proximity within the predetermined distance of a user with a portion of the sensor unit, or detecting a threshold amount of the movement of the sensor unit (e.g., with respect to the pommel portion and/or one or more known axes). For example, in some embodiments, the sensor is configured to emit an audible indication (e.g., a sound, tone, or the like), visual indication (e.g., a light, or colored light), and/or tactile indication (e.g., a vibration) of the sensor detecting the contact or movement. In another example, the sensor is configured to send a signal to an output device (e.g., an output device separate or distinct from the sensor, such as a mobile phone, personal digital assistant, tablet, or other personal and/or portable computing device) indicative of the sensor detecting the contact or movement, such that the output device emits at least one of the audible, visual or tactile indication, or combination thereof. For example, in some embodiments, the output device can be an electronic device such as a mobile phone, tablet, PDS, or other personal computer that includes an application configured to receive data from the sensor and to track the sensor data. The application can cause the electronic device to emit the output based on the sensor data. In some embodiments, an electronic device can be used to record video of the athlete during use. For example, a mobile phone, camera or the like can be mounted to the cone or a portion of the training apparatus. The application can be configured to receive and/or process the video data and sensor data to output (e.g., a visual output on a screen of the device, an audible output, a signal to another device, or the like) information associated with the athlete's movement (e.g., instances of contact or movement, distance between the athlete's body and a predetermined location, such as the video recording device, sensor, pommel, or other location at one or more times during use, or the like). The application can also be configured to track the time or duration of use or of execution of one or more maneuvers by the athlete, the user's cumulative incidences of an output being emitted in response to contact or movement detected by the sensor, or other suitable data associated with the athlete's use of the apparatus.

In use, for example, as an athlete practices a pommel horse exercise (e.g., a circle maneuver), proper execution of the exercise may include the athlete's body avoiding a center area defined by an inner perimeter of the pommel portion (e.g., pommel portion 110, 310, 510) within which the sensor 164 and/or cone 166 is disposed. If, during execution of the exercise, the athlete lacks proper form or improperly executes the exercise such that the athlete's body enters the center area and contacts the sensor and/or cone 166 or causes the sensor and/or cone to move more than a predetermined threshold, the sensor 164 can detect such contact and/or movement and produce the output indicative thereof. In this manner, the athlete and/or a coach can become aware in substantially real time of the contact, which contact and/or movement caused by improper form may otherwise not have been apparent to the athlete or coach. Such substantially instantaneous feedback can help expedite developmental stages of the athlete training using the apparatus described herein.

A metronome 168 can be coupled to the pommel horse training apparatus (e.g., apparatus 100, 300, 500 or any apparatus described herein). In some embodiments, the metronome 168 is coupled to the cone 166. The metronome 168 is configured to help with the rhythm and tempo of the athlete during execution of an exercise or maneuver (e.g., a circle or any other skill or routine the athlete may execute or attempt to execute). More particularly, the metronome 168 is configured to emit a sound (e.g., a click or other sound) and/or a visual indication (e.g., a light) at a predetermined tempo or rhythm for a period of time. The predetermined tempo or rhythm can be based on the skill, exercise or routine being performed by the athlete.

In some embodiments, the apparatus includes a memory configured to store data associated with a particular exercise or routine (e.g., an amount of rotations or passes to be executed by an athlete during the routine or exercise), athlete names or identifiers, historical data or records of an athlete's performance, including, but not limited to, time duration for execution (or attempted execution) of an exercise or routine, total time of use of the apparatus over a predetermined period of time, number of times of detection by the sensor of contact, movement, or the like during execution of an exercise or routine (or cumulatively over a predetermined period of time), number of successful rotations without improper contact or movement as detected by the sensor for a particular exercise or routine or cumulatively, a pressure or movement threshold for the sensor, a set of predetermined tempos or rhythms that can be selectively output by the metronome or that can be associated with a particular athlete within the memory for output by the metronome during the athlete's use of the apparatus, or another suitable training parameter or record. The memory can be coupled to the metronome and/or the sensor. In some embodiments, the apparatus includes a processing device (e.g., a mobile phone, personal digital assistant, tablet, personal computer, or the like) coupled to or that otherwise includes the memory, a clock, the sensor(s) and the metronome or a similar device.

Figure 29:
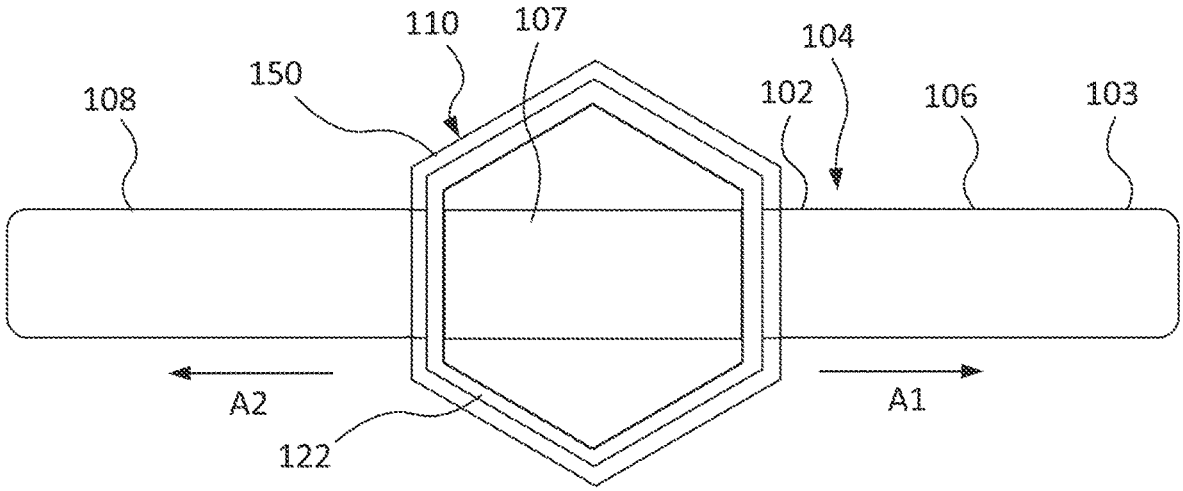
FIG. 29 is a top view of a portion of the apparatus of FIG. 1 with floor horse extenders according to an embodiment.

As described herein, in some embodiments, a pommel portion described herein (e.g., the pommel portion 110, 310, 510) is configured to be used separately from the base portion (e.g., base portion 210, 510, 510', 510", 810). For example, the pommel portion 110 can be removed from the base portion 210 to place the pommel portion 110 on or closer to the floor for the athlete to continue to work foundational skills and/or more difficult developmental skills. Referring to FIG. 29, an apparatus according to an embodiment, includes a floor horse extender 104 disposed on opposing sides of the pommel portion. One or more portions of the floor horse extender 104 can be coupled, for example removably coupled, to the pommel portion 110. The floor horse extender 104 can include an elongate member 106 that has a first end portion 102 disposed adjacent a side portion of the pommel portion 110 and a second end portion 103 that is extended longitudinally away from the side portion of the pommel portion, such as when the elongate member is removably coupled to the pommel portion. The floor horse extender 104 can include two or more elongate members 106, 108 that are positioned with respect to the pommel portion 110 to extend longitudinally away from a center portion of the pommel portion 110. The first elongate member 106 of the floor horse extender 104 can be disposed such that it extends from a first side of the pommel portion and the second elongate member 108 can be disposed such that it extends from a second (e.g., opposing) side of the pommel portion. The floor horse extender 104 can include a third elongate member 107 configured to be disposed within the center portion of the pommel portion 110 such that the third elongate member 107 is substantially extended between opposing sides of the pommel portion, and optionally between the first and second elongate members 106, 108. In some embodiments, adjacent ends of the elongate members can be coupled together. One or more of the elongate members 106, 107, 108 can be coupled to the floor and/or a bottom portion of the pommel portion 110. For example, at least one elongate member can be coupled via a hook-and-loop fastener to carpet bonded foam of the pommel portion 110 (e.g., on an upper surface of the support member 150 of the pommel portion 110). The elongated member(s) can have an upper surface configured for a user to practice gymnastic skills, as described herein.

Each elongate member 106, 107, 108 of the floor horse extender 104 can have a height from about 3 inches to about 36 inches, and more particularly of about 5 inches to about 10 inches, and still more particularly of about 5.25 inches. Each elongate member 106, 107, 108 can have a length of about six inches to about 42 inches, more particularly of about 10 inches to about 20 inches, and still more particularly of about 18 inches. Each elongate member 106, 107, 108 can have a width of about 10 inches to about 15 inches, and more particularly of about 13.5 inches. Each elongate member 106, 107, 108 can have a height, length, width, or the like, the same as or different from another elongate member 106, 107, 108. The elongate member(s) can be constructed of any suitable material, including, but not limited to wood, plastic, fiberglass, metal, foam, leather or other suitable material, or a combination of the foregoing.

In some embodiments, one or more elongate members 106, 107, 108 can be weighted, e.g., by being filled with sand, lead, metal, water, or other suitable material or substance or being constructed at least in part of such a material, thereby providing stability to the elongate member 106, 107, 108, and such that the floor horse extender 104 thereby provides stability to the pommel portion 110. More specifically, one or more weighted elongate members 106, 107, and/or 108 help prevent the pommel portion 110 from rolling and/or sliding (or other movement in response to movement of the athlete during use of the pommel portion 110) in the directions of arrows A1, A2, respectively, as shown in FIG. 29. In some embodiments, the weighted elongate members 106, 107, 108 can help to prevent or otherwise limit rolling, sliding or other movement in a direction transverse to the directions indicated by arrows A1 and A2, or rotational movement in a clockwise or counterclockwise direction. In some embodiments, the elongate member 106, 107, 108 is coupleable to or configured to be disposed on a weighted base, which can be weighted as described herein. Such a weighted base can be constructed of any suitable material described herein, including, but not limited to wood, plastic, fiberglass or metal. In some embodiments, for example, the elongate member 107 disposed within a perimeter of the pommel portion is weighted.

In use, the floor horse extender 104 replicates or simulates a traditional saddle (see, e.g., FIG. 30) of a pommel horse, though the floor horse extender 104 can be of a different size or shape than the traditional saddle. In this manner, a gymnast can practice forward travels, backward travels, turning travels, flair travels back and forth, train and execute turning flair travels, or other basic skills, including, but not limited to Kehre skills, Soma travels and handstand dismounts, using a pommel portion (e.g., pommel portion 110, 310) of an apparatus (e.g., apparatus 100) described herein on or proximate to the floor or other support structure and coupled to or otherwise positioned with the floor horse extender 104. Disposing the pommel portion on the floor, ground or the like, is a safe and logical progressive step to go from the pommel portion on top of a base portion described herein, then to the floor and then finally to the Olympic standard horse.

Figure 30:
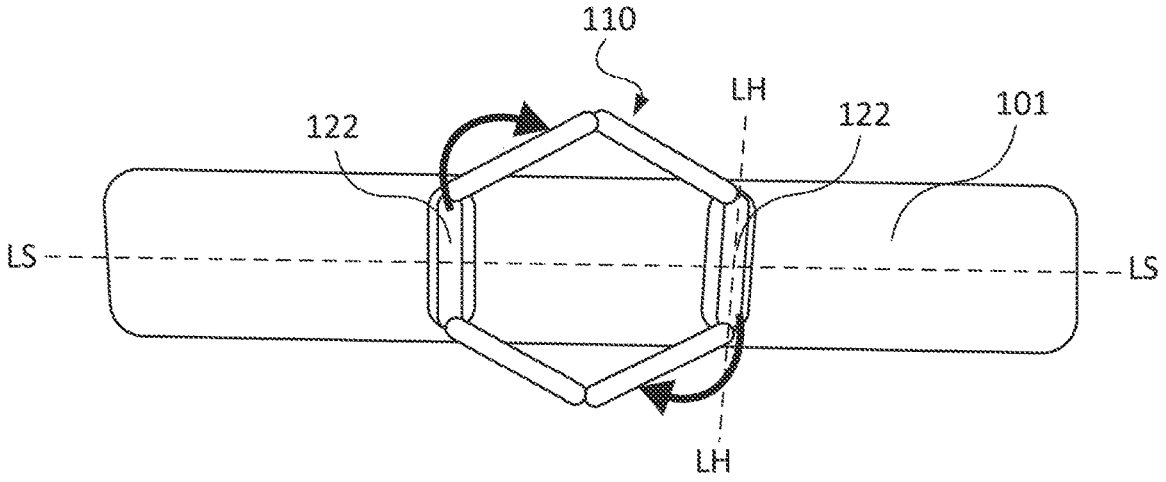
FIG. 30 is a top view of a portion of the apparatus of FIG. 1 disposed on a saddle according to an embodiment.
Figure 31:
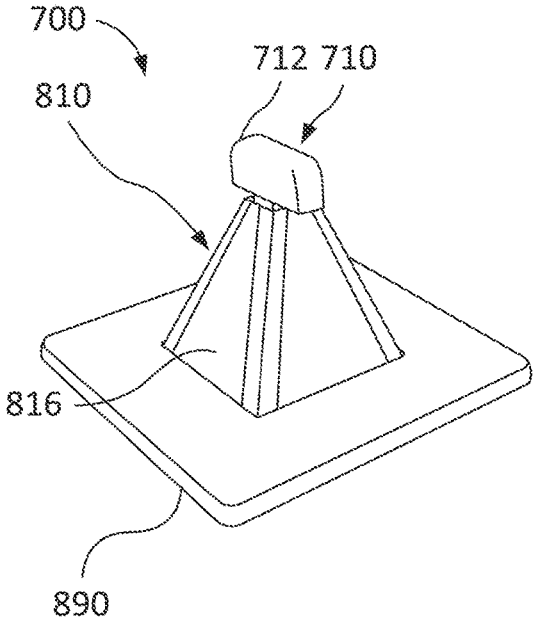
FIGS. 31-34 are perspective, side, front and top views, respectively, of an apparatus according to an embodiment.
Figure 32:
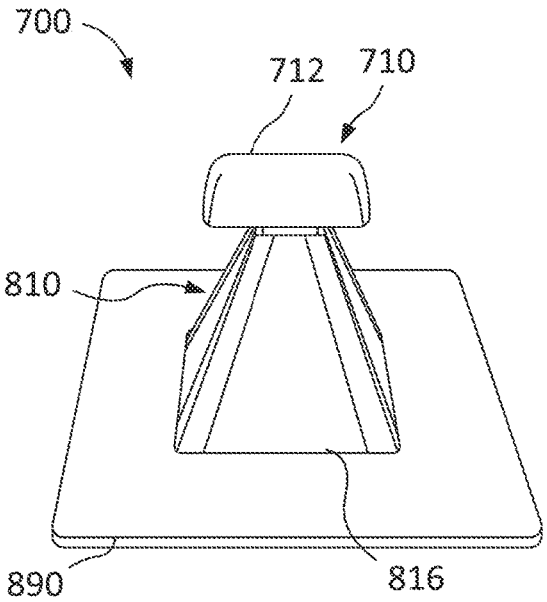
Figure 33:
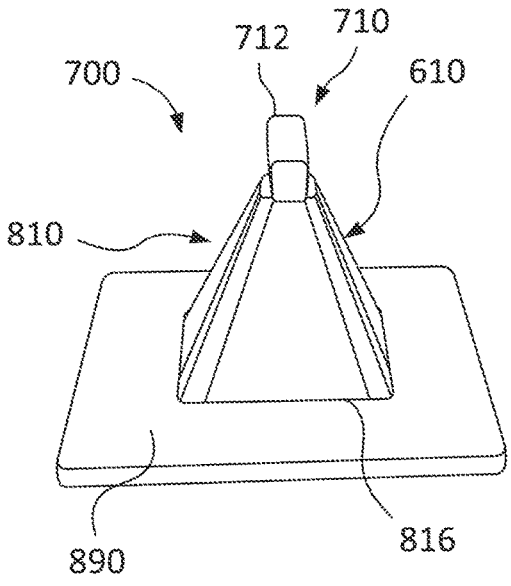
Figure 34:
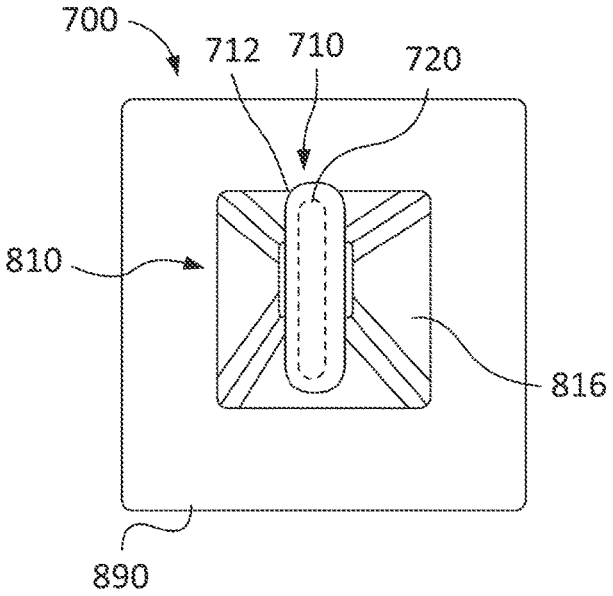

In some embodiments, a pommel portion (e.g., any pommel portion described herein, such as pommel portion 110, 310, 510, 710) of an apparatus according to an embodiment is configured to be disposed on or otherwise coupled to a pommel horse, or saddle thereof, such as a pommel horse used in Olympic gymnastics events which can include the saddle and two parallel pommels coupled to an upper surface thereof. A pommel portion described herein (e.g., pommel portion 110), or a portion thereof, can be coupled to the upper surface of such a saddle 101 of a pommel horse (e.g., optionally with one or both pommels removed therefrom), as shown in FIG. 30.

In some embodiments, the support post (e.g., a support post 124, 324, 524 described herein) (not shown in FIG. 30) of a pommel portion described herein is coupled to the saddle. For example, the support member 150 can be removed from the pommel portion 110 before coupling the support post 124 directly to the saddle. More specifically, in some embodiments, a set of support posts 124 can be coupled to the saddle 101 such that a support post 124 is associated with a connection point at which one of the parallel pommels had previously been coupled before removal from the saddle 101. For example, four support posts 124 of the pommel portion 110 can be coupled at end portions thereof to the saddle.

In another example, in some embodiments, the support member 150 of the pommel portion 110 is coupled to the saddle 101. For example, the support member 150 can be placed on an upper surface of the saddle 101 such that a longitudinal axis (represented by broken line LH-LH) of each elongate pommel segment of an opposing pair of elongate pommel segments 122 is transverse (e.g., substantially perpendicular) to a longitudinal axis (represented by broken line LS-LS) of the saddle 101 of the pommel horse. In this manner, the opposing pair of elongate pommel segments 122 are parallel to or collinear with the placement of the parallel pommels before their removal from the saddle. Any suitable coupling mechanism can be used to couple the pommel portion (e.g., the support post 124, the support member 150), including but not limited to, a screw, nut and bolt, mating fasteners, fastening straps, or the like, or any combination thereof.

Such embodiments that include the pommel portion described herein coupled to the saddle 101 of a pommel horse provide for a further step in the progressive training of an athlete or other user to learn and master pommel horse exercises and techniques for the pommel horse event. For example, a training regimen can include training an athlete, gymnast, or other user, on the apparatus with the pommel portion and base. The athlete can then progress to training using the pommel portion separate from the base. In other words, using the pommel portion as a floor-based (or otherwise having a lesser elevation with respect to the floor than when the pommel portion is coupled to the base portion) training device. Techniques that may be further developed by the athlete at this second level of training include techniques of greater extension, higher circle, faster circle, better hip rotation and turn out, than that previously achieved by the athlete. In addition, at this second level of training, the athlete can develop strength of the arm pull, which can increase the speed of the circle as well as the shoulder and hip counter turn out. In some embodiments, the athlete can then progress to a third level of training, in which a portion of the training apparatus described herein, (e.g., the pommel portion) is disposed on the pommel horse saddle. In this manner, the athlete can continue to develop the skills and techniques that were learned on the pommel portion attached to the base portion at the first training level, and the pommel portion disposed on the floor at the second training level. The progressive training opportunities provided for by use of the apparatus as described herein enable the athlete to more quickly and accurately develop pommel horse exercises and techniques, providing a significant advantage over training on the pommel horse alone and/or using known mushroom style pommel horse trainers that lack any pommel.

An apparatus 700 according to an embodiment is illustrated in FIGS. 31-34. The apparatus 700 is configured for use in training a gymnast or other athlete, for example, on execution of skills and maneuvers for the pommel horse. The apparatus 700 can include a pommel portion 710, a base portion 810, and optionally a foundation (not shown in FIGS. 31-34).

The pommel portion 710 (also referred to herein as a padded pommel) includes a pommel 720 (or inner pommel) (schematically illustrated in FIG. 34) and an outer pad 712 disposed over at least the upper and side surfaces of the pommel 720. The outer pad 712 can include one or more materials, including, for example, a foam, rubber, or other suitable material, and optionally another material (e.g., a layer of fabric or leather) covering the inner material. The outer pad 712 can be disposed on and/or coupled to (e.g., via an adhesive or other suitable coupling mechanism) the pommel 720, collectively forming a single padded pommel. The single padded pommel has a thicker surface in comparison to a pommel without such padding, which provides for additional stability to the athlete during use, for example, because the athlete's grip can "dig" into the padding material. The single padded pommel also is wider than the pommel without padding. In some embodiments, for example, the padded pommel can be double the thickness and/or width than the pommel without padding, or double the thickness and/or width of an elongate pommel segment (e.g., segment 122, 322, 522) described herein. In some embodiments, the padded pommel has a cross-sectional diameter that is greater than a cross-sectional diameter of one of the elongate pommel segments 122, 322, 522 (e.g., first pommel segment, 121, 321, 521 or second pommel segment 123, 323, 523). The wider grasp provided for by the padded pommel portion 710 alleviates the pressure placed on the athlete's joint(s) during use.

The base portion 810 of the apparatus 700 is configured to be coupled to the pommel portion 710. The base portion 810 is configured to support the pommel portion 710 in a vertically spaced relationship with respect to a support surface, when the apparatus 700 is in an upright position. The base portion 810 can be similar in many respects to any base portion described herein. The base portion 810 includes multiple sidewalls 816. In the embodiment of FIGS. 31-34, each side member 816 is substantially trapezoidal in shape (from a side view) and has a substantially planar or flat outer surface. The sidewalls 816 are coupled to side portions of adjacent sidewalls 816 to form a substantially truncated pyramid shape, as shown in FIGS. 31-34. In this manner, a bottom portion of the base portion 810 is substantially square in shape (e.g., from a bottom view) and the top portion of the base portion is substantially square in shape (e.g., from a top view, with the pommel portion 710 removed).

The base portion 810 can be disposed on and coupled to a foundation (not shown in FIGS. 31-34). The foundation can be similar in many respects, or identical to, any foundation described herein (e.g., foundation 280, 680). In some embodiments, the apparatus 700 includes a mat 890 configured to be disposed about the bottom portion of the base portion 810 and/or at least partially on a foundation of the apparatus 700. The mat 890 can have an outer perimeter shape (e.g., from a top or bottom view) similar to that of the base portion 610 (from the top or bottom view). For example, as shown in FIGS. 31-34, the mat 890 can be substantially square in shape (from a top or bottom view). The mat 890 can have an opening defined by an inner perimeter of the mat, such that the opening is configured to receive or otherwise be disposed about at least a portion of the bottom portion of the base portion 810. The mat 890 can be similar in many respects to any mat or mat system described herein, including, for example, being constructed of any suitable material described with respect to the mat systems herein.

In some embodiments, the pommel portion 710 including the padded pommel is configured for use with an apparatus (e.g., apparatus 100, 300, 500) described herein. For example, in some embodiments, the padded pommel is included in a pommel portion (e.g., pommel portion 110, 310, 510) described herein. For example, the pommel portion 110, 310, 510 can include the padded pommel at least partially disposed within the interior volume collectively defined by the plurality of elongate pommel segments 122, 322, 522, the plurality of posts 124, 324, 524, and optionally the support member 150, 350, 550. The padded pommel 710 can be distinct from the plurality of elongated pommel segments 122, 322, 522.

Mat systems configured for use with the gymnastics training apparatus described herein are depicted in FIGS. 37-41. The mat system can be configured to provide a cushioned surface for a gymnast or other user to land upon (e.g., during dismount, falling, or the like) when using the gymnastics training apparatus. The mat system can be configured to help retain the base portion 210, and in this manner, helps to stabilize the base during use of the gymnastics training apparatus by a gymnast or other user. The mat system can be configured to be disposed about, and optionally coupled to, the bottom or second end portion (e.g., end portion 214) of the base portion (e.g., base portion 210, 610, 810) of the apparatus. In some embodiments, a mat system can have an inner perimeter that defines an opening. At least a portion of the base portion 210 of the training apparatus can be disposed within the opening, e.g., such that the inner perimeter of the mat system contacts an outer surface portion of the base portion. The inner perimeter of the mat system can have any suitable shape described herein. In some embodiments, the inner perimeter of the mat system can be shaped similarly as an outer perimeter of the base portion (e.g., of the second end portion of the base portion). In some embodiments, the inner perimeter of the mat system can have the shape of a circle, square, triangle, rectangle, a hexagon, octagon, decagon, or other polygon.

The mat system can have an outer perimeter. The outer perimeter of the mat system can have any suitable shape, including those described herein with respect to the inner perimeter of the mat system, the base of the apparatus, and/or the pommel arrangement of the apparatus. In some embodiments, the inner perimeter and outer perimeter of the mat system have the same or similar shape (e.g., each of the inner perimeter and outer perimeter of the mat system can be hexagonal). In other embodiments, the inner perimeter can be shaped differently from the outer perimeter of the mat system (e.g., the inner perimeter can be hexagonal and the outer perimeter can be circular).

Figure 35:
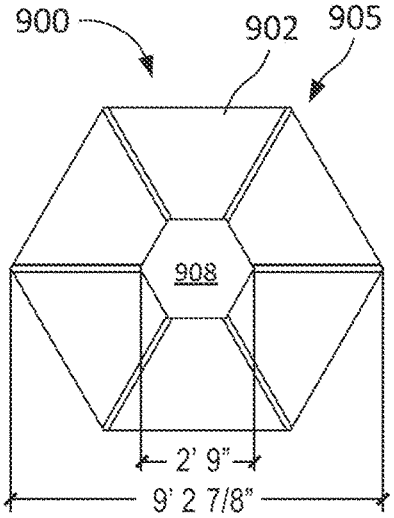
FIG. 35 is a top view of mat system according to an embodiment. The bottom view is the same as the top view, and thus is not shown.
Figure 36:
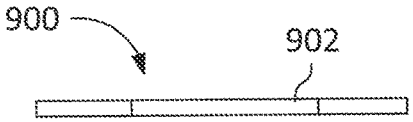
FIGS. 36-37 are front and left side views of the mat system of FIG. 35. The rear and right side views are identical to the front and left side views, respectively, and thus are not shown.

Mat systems according to embodiments are illustrated in FIGS. 35-40. The mat system (e.g., mat system 900, 920, 940, 960) can be constructed of multiple or a plurality of mat sections (e.g., 905, 925, 945, 965, respectively). For example, in one embodiment, the plurality of mat sections can include two or more sections, including, for example, six identically shaped sections as shown in FIGS. 35, 38, 39 and 40. Each section includes an upper surface, a lower surface, and side portions extended between the upper surface and the lower surface. In some embodiments, an upper surface of each mat section from the plurality of mat sections can define a polygonal shape. In some embodiments, the mat sections can each have four side portions. In such embodiments, for example as shown in FIG. 35, each mat section can be (e.g., from a top or bottom view) substantially trapezoidal, with a first side portion that forms a portion of the inner perimeter of the mat system and that is configured to be adjacent or in contact with a base portion (e.g., base portion 210, 610) of any apparatus (e.g., apparatus 100, 500, 700) described herein, a second side portion that forms a portion of the outer perimeter of the mat system and that is substantially parallel to the first side portion, and third and fourth side portions each extended from the first side portion to the second side portion. The third and fourth side portions can be configured, respectively, to be coupled to or in contact with third and fourth side portions, respectively of an adjacent mat section.

Figure 38:
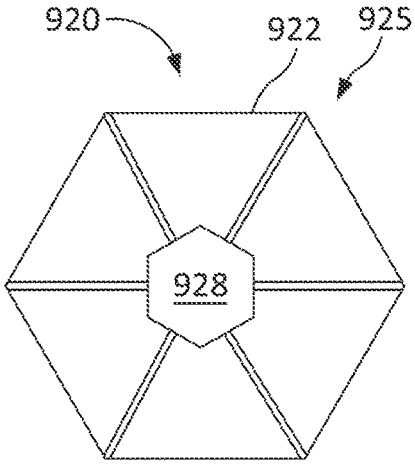
FIG. 38 is a top view of a mat system according to an embodiment. The bottom view is identical to the top view, and thus is not shown. The mat system of FIG. 38 has front, rear, left side, and right side views like those shown and/or described with respect to FIGS. 36-37.
Figure 40:
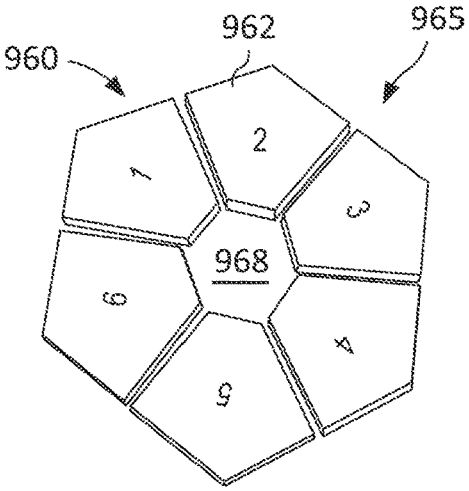
FIG. 40 is a top view of a mat system according to an embodiment.
Figure 39:
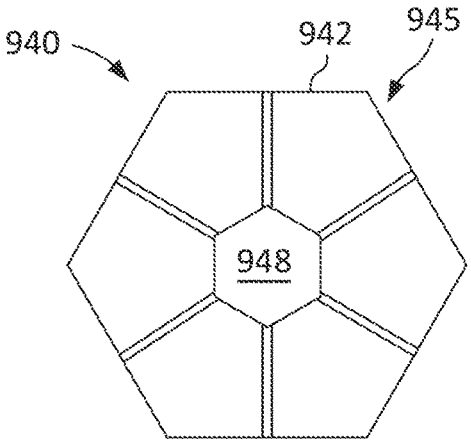
FIG. 39 is a top view of a mat system according to an embodiment. The bottom view is identical to the top view, and thus is not shown.
Figure 39A:
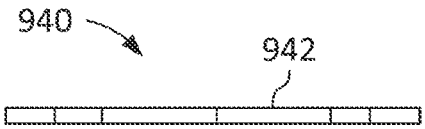
FIGS. 39A and 39B are front and left side views, respectively, of the mat system of FIG. 39. The rear and right side views of the mat system of FIG. 39 are identical to the front and left side views, respectively, and thus are not shown.
Figure 39B:
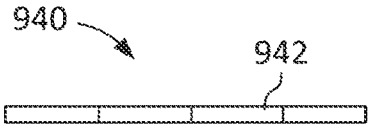

In some embodiments, a mat section can have five side portions. For example, each mat section can be (e.g., from a top or bottom view) substantially pentagonal, as shown in FIGS. 39 and 40. In another example, each mat section can be similar to the trapezoidal shape described herein with reference to FIG. 35, except that the first side portion of the mat section of FIG. 35 is in the shape of an inverted "V", as shown in FIG. 38, and thereby forms a first side portion (e.g., one half of the "V") and a fifth side portion (e.g., the other half of the "V").

The plurality of mat sections 905, 925, 945, 965 can have a first configuration in which the mat sections are removably coupled together and a second configuration in which the mat sections are uncoupled. In the first configuration, the plurality of mat sections have an outer perimeter and an inner perimeter defining an opening 908, 928, 948, 968, respectively. The opening 908, 928, 948, 968 is configured to receive therein at least a portion of the base portion. The inner perimeter of the plurality of mat sections in the first configuration can have a shape (e.g., from a top view) that is complementary to an outer perimeter shape of the base portion. As shown in FIGS. 37, 38, 39 and 40, for example, the inner perimeter is in the shape of a hexagon. In some embodiments, an outer perimeter (e.g., from a top or bottom view) of the plurality of mat sections 905, 925, 945, 965 has a shape substantially the same as the shape of the inner perimeter. For example, as shown in FIGS. 37, 38, 39 and 40, the outer perimeter is in the shape of a hexagon. In other embodiments, however, the outer perimeter of the plurality of mat sections 905, 925, 945, 965 has a shape different than that of the inner perimeter. For example, the outer perimeter can be in the shape of a circle or polygon different than the shape of the inner perimeter (e.g., different than a hexagon). In the second, or uncoupled, configuration, the mat sections 902, 922, 942, 962 can be separated or otherwise stacked, e.g., for storage.

In some embodiments, a mat system can include multiple mat sections that includes sets of differently shaped mat sections, in which the shape of a first set of mat sections is different from the shape of a second set of mat sections. Each mat section in a set, however, can have substantially the same shape. In some embodiments, a plurality of mat sections can include at least a first mat section that has an upper surface with an outermost perimeter that has a first polygonal (or other) shape and a second mat section that has an upper surface with a perimeter that has a second polygonal (or other) shape different from the first shape.

For example, referring to FIG. 41, a mat system 400 can include four mat sections with two sets of similarly shaped mat sections. The first set of mat sections can include two mat sections 402, 404 having a first perimeter shape (from a top view). For example, as shown in FIG. 41, each of mat sections 402, 404 is substantially trapezoidal (e.g., from a top view). A long edge portion of the mat sections of the first set can be disposed adjacent a bottom portion of the base portion 210 (not shown in FIG. 41). The second set of mat sections can include two mat sections 406, 408, having a second perimeter shape (from a top view) different from the first perimeter shape. For example, as shown in FIG. 41, each of mat sections 406, 408 is substantially arrow shaped (e.g., such that one end thereof forms a point or a "V" and the opposing end is in the shape of an inverted "V"). The second set of mat sections are configured to be disposed between portions of the mat sections of the first set, at shown in FIG. 41 such that the inverted "V" edge of each mat section of the second set is disposed adjacent the base portion 210. In this manner, when the mat system 400 is assembled (e.g., the mat sections 402, 404, 406, 408 are positioned and/or coupled together as shown in FIG. 41), the mat sections collectively define an opening 410, e.g., a substantially hexagonally-shaped opening or an opening with another shape that complements the shape of a portion of the base portion 210, within which a portion of the base portion 210 can be disposed. The mat system 400 is also hexagonally-shaped, from the top view.

Although the mat system 400 is shown and described as including a set of substantially trapezoidal shaped mat sections and a set of arrow shaped mat sections, in other embodiments, the mat sections of each set can be differently shaped. For example, referring to FIG. 42, in some embodiments a mat system 420 can include four mat sections with two sets of similarly shaped mat sections, of which the first set of mat sections can include two mat sections 422, 424, that are each substantially rectangular-shaped (e.g., from a top view). A long edge portion of the mat sections 422, 424 of the first set can be disposed adjacent a bottom portion of the base portion 210 (not shown in FIG. 42). The second set of mat sections can include two mat sections 426, 428 that each has three edge portions that are substantially linear and one edge portion that is in the shape of an inverted "V". The second set of mat sections are configured to be disposed between portions of the mat sections 422, 424 of the first set, as shown in FIG. 42 such that the inverted "V" edge of each mat section of the second set is disposed adjacent the base portion 210. In this manner, when the mat system 420 is assembled (e.g., the mat sections 422, 424, 426, 428 are positioned and/or coupled together as shown in FIG. 42), the mat sections collectively have an inner perimeter that defines an opening 430, e.g., a substantially hexagonally-shaped opening or an opening with another shape that complements the shape of a portion of the base portion 210, within which a portion of the base portion 210 can be disposed. The mat system 420 can have an outer perimeter shape (from a top view) that is different than the shape of the inner perimeter defining the opening 430. For example, the mat system 420 can have a substantially square or rectangular outer perimeter shape, from the top view, as shown in FIG. 42.

In another example, referring to FIG. 43, in some embodiments a mat system 440 can include four mat sections with two sets of similarly shaped mat sections, of which the first set of mat sections can include two mat sections 442, 444, that are each substantially semi-circular (or half-moon) shaped (e.g., from a top view). A long edge portion of the mat sections 442, 444 of the first set can be disposed adjacent a bottom portion of the base portion 210 (not shown in FIG. 43). The second set of mat sections can include two mat sections 446, 448 that each has two opposing edge portions that are substantially linear, a curved edge portion, and an edge portion opposite the curved edge portion that is in the shape of an inverted "V". The second set of mat sections are configured to be disposed between portions of the mat sections 442, 444 of the first set, at shown in FIG. 43 such that the inverted "V" edge of each mat section of the second set is disposed adjacent the base portion 210. In this manner, when the mat system 440 is assembled (e.g., the mat sections 442, 444, 446, 448 are positioned and/or coupled together as shown in FIG. 43), the mat sections collectively define an opening 450, e.g., a substantially hexagonally-shaped opening or an opening with another shape that complements the shape of a portion of the base portion 210, within which a portion of the base portion 210 can be disposed, and such that the mat system 440 has a substantially circular shape (e.g., from the top view).

The sections of the mat can be configured to be coupled together. For example, in some embodiments, each mat section is configured to be coupled to an adjacent mat section using any suitable coupling mechanism, including, but not limited to one or more hook and loop fasteners (e.g., Velcro®), magnets, adhesive (e.g., a removable adhesive, a temporary adhesive, a permanent adhesive, or the like), snaps, zippers, mating recesses or channels, or the like, or any suitable combination of the foregoing. The coupling mechanism can be configured to stabilize the mat to the base. The coupling mechanism(s) can be at least partially disposed on or otherwise coupled to the upper surface, lower surface or one or more side portions of the mat section, or a combination thereof. In some embodiments, for example, a side portion (e.g., the third side portion or fourth side portion) of the mat section can include a flap of material that is configured to be disposed on an upper or lower surface of an adjacent mat section. A side of the flap that contacts the adjacent mat section surface can include the coupling mechanism (or a portion thereof). For example, a portion of a hook-and-loop fastener can be disposed on the flap and the complementary portion of the hook-and-loop fastener can be disposed on the surface of the mat section. As such, when the flap of one mat section is disposed on the surface of the adjacent mat section, the portions of the hook-and-loop fastener are coupled together, thereby coupling the mat sections.

A first mat section and a second mat section can be connected by Velcro® on the lower surfaces of the mat section, and by Velcro® on the upper surfaces of the mat sections. This coupling can be done all the way around the mat system until all sections are connected on either side to adjacent mat sections. The sections of the mats can also be connected along a length of their side portions by Velcro® connecting two sections together. For example, the Velcro® can be disposed length-wise down the side portion of the mat from the center (or inner perimeter) and extended outwardly down the length of the side portion of the mat section to an outer edge (or outer perimeter) of the mat system. In other embodiments, the Velcro®, or other coupling mechanism, can be disposed along a portion of the length of the side portion of the mat section.

Figure 37:
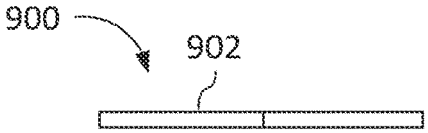

In some embodiments, each mat section can be configured to be coupled to the base (e.g., proximate the first side portions of the mat sections of FIGS. 37, 39 and 40, the first and/or fifth side portions of the mat section of FIG. 38, or the inverted "V" portion of the mat sections of FIG. 41, described above). In such embodiments, each mat section can be coupled to the base using a hook-and-loop fastener (e.g., Velcro®), or any other suitable coupling mechanism, including those described herein, or any combination thereof. In one embodiment, for example, an upper surface of the foundation 280 includes a portion of a coupling mechanism (e.g., a portion of a hook-and-loop fastener) and a bottom surface of the mat section can include a complementary coupling mechanism (or portion thereof) configured to engage or otherwise be coupled to the coupling mechanism on the foundation 280. In some embodiments, the mat system defines a recessed portion or channel configured to receive a portion of the base (e.g., a flange of the base) to help stabilize the base in the upright position to prevent tipping or other undesired movement of the base during use.

The mat system can be of any suitable size for being disposed about the base of the training apparatus. For example, in some embodiments, the opening of the mat system has a maximum width of from about 1 feet to about 4 feet, from about 2 feet to about 3 feet. For example, in some embodiments, the opening of the mat system can have a maximum width that is about 2 feet, about 2.25 feet, about 2.5 feet, about 2.75 feet, or about 3 feet. The mat system can be of any suitable size for providing a landing area to an athlete upon dismount from the training apparatus and/or providing stabilization to the base. For example, in some embodiments, the mat system (e.g., with the mat sections thereof coupled together) has a maximum width of from about 5 feet to about 12 feet, from about 7 feet to about 11 feet, or from about 8 feet to about 10 feet. In some embodiments, for example the mat system can have a maximum width that is about 9 feet.

The mat, and the mat sections particularly, can be constructed of any suitable material including, but not limited to, foam. For example, the mat construction can include carpet bonded foam, cross-linked foam covered in vinyl or other material, or the like, or a combination thereof. The mat sections of the mat system can have a thickness of about ½ inch to about 6 inches. The thickness of the mat (or mat sections) can be, for example, 1⅜ inches or about 2 inches, e.g., for the carpet bonded foam mat system. The thickness of the mat (or mat sections) can be 1½ inches, e.g., for the cross-linked foam mat system with the vinyl cover.

While various embodiments have been described above, it should be understood that they have been presented by way of example only, and not limitation. Where schematics and/or embodiments described above indicate certain components arranged in certain orientations or positions, the arrangement of components may be modified. While the embodiments have been particularly shown and described, it will be understood that various changes in form and details may be made. Although various embodiments have been described as having particular features and/or combinations of components, other embodiments are possible having any combination or sub-combination of any features and/or components from any of the embodiments described herein.

The specific configurations of the various components described herein can also be varied. For example, the size and specific shape of the various components can be different from the embodiments shown, while still providing the functions as described herein. Additionally, the relative size of various components of the devices shown and described herein with respect to the size of other components of the devices are not necessarily to scale. Similarly, where methods and/or events described above indicate certain events and/or procedures occurring in certain order, the ordering of certain events and/or procedures may be modified. While the embodiments have been particularly shown and described, it will be understood that various changes in form and details may be made.

For example, although the mat system is shown and described herein as having six mat sections, in other embodiment, the mat system can have any suitable number of mat sections, such as one, two, three, four, five, seven, eight or more mat sections. In another example, although the a plurality of elongate pommel segments of the pommel portion 110 are shown and described herein as being substantially linear and substantially uniform in diameter across the length of the member, in other embodiments, one or more elongate pommel segments can be differently shaped. For example, in some embodiments, one or more elongate pommel segments can be non-linear (e.g., curved, tapered at one or both end portions, or the like). Further, although the elongate pommel segments are shown as being continuous (e.g., such that the shape of the collective arrangement of the plurality of elongate pommel segments is closed, or forms a closed geometric shape), in other embodiments, one or more elongate pommel segments can be spaced apart from one or more other elongate pommel segments. For example, the device can include multiple (e.g., six) distinct pommels coupled to the support member 150, arranged hexagonally to form three parallel sets of two pommels, or arranged in another geometric pattern, as described herein. In some embodiments, the device includes an additional pommel disposed within an inner perimeter formed by the pommel of FIG. 1 (or other geometrically arranged pommel or plurality of pommels).

In still another example, although the apparatus 100 is described as including the pommel portion 110 and the base portion 210, in other embodiments, an apparatus according to an embodiment can include any one of the pommel portion 110 (e.g., without the base portion 210 or with a different base portion or other support structure), the base portion 210 (e.g., without the pommel portion 110, with a different pommel portion, or with a different upper portion configured for athletic training), the mat system (e.g., without the apparatus 100 or with a different training or other apparatus), or any combination of the foregoing.

Although the support member 150 is shown and described herein as being coupled to the base portion 210, in other embodiments, the base portion can include the support member. Stated differently, the support member can be monolithically formed with the base portion.

In some embodiments, a system according to an embodiment includes multiple pommel portions 110 and the base portion 210. Different individual pommel portions can each have size and dimensions different than another pommel portion (e.g., the system can include a small, medium and large pommel portion, each having a progressively greater maximum widths as described herein). The base 210 can be removably coupleable to each of the multiple pommel portions. In this manner, an appropriately sized pommel portion can be selected for a particular user or gymnast based, at least in part, on the user's size and/or skill level.

Suitable dimensions for the features of the apparatus according to embodiments described herein are described herein and are shown in FIGS. 8-13, however, one or more features of the apparatus (e.g., apparatus 100, 300, 500 or any apparatus described herein) can have different dimensions. In one example, a base portion can have a first end portion with a hexagon-shaped perimeter (from a top view) that is about 18 inches (e.g., 18 3/16 inches) wide between opposing parallel edges and about 20 inches (e.g., about 20⅝ inches) wide between opposing vertices or points of the hexagon. The base portion can be about 7½ inches in height, with sidewalls about 7¾ inches in length (top to bottom, when the apparatus is in an upright position). The base portion can be disposed on a hexagonally shaped foundation that is about 32.5 inches wide between opposing parallel edges and about 37⅜ inches wide between opposing vertices of the hexagon.

In another example, a base portion can have a first end portion with a hexagon-shaped perimeter (from a top view) that is about 20 inches wide between opposing parallel edges and about 23 inches wide between opposing vertices or points of the hexagon. The base portion can be about 2¼ inches in height, with sidewalls about 7¾ inches in length (top to bottom, when the apparatus is in an upright position). Each sidewall can have a width, at the first end portion of the base portion, of about 11 inches (e.g., about 11½ inches), and a width at the second end portion of the base portion of about 12 inches (e.g., about 12⅜ inches). The base portion can be disposed on a hexagonally shaped foundation that is about 25 inches wide (e.g., 24¾ inches) between opposing parallel edges and about 28 inches (e.g., about 28⅝ inches) wide between opposing vertices of the hexagon. Each side edge of the foundation can have a length of about 14 inches (e.g., about 14 3/16 inches). The base portion and the foundation can have a height of about 3 inches.

In yet another example, a base portion can have a first end portion with a hexagon-shaped perimeter (from a top view) that is about 18 inches (e.g., about 18 1/16 inches) wide between opposing parallel edges and about 21 inches (e.g., 20¾ inches) wide between opposing vertices or points of the hexagon. The base portion can be about 15 inches (e.g., about 15¼ inches) in height, with sidewalls about 15 inches (e.g., about 15½ inches) in length (top to bottom, when the apparatus is in an upright position). Each sidewall can have a width, at the first end portion of the base portion, of about 11 inches (e.g., 10½ inches), and a width at the second end portion of the base portion of about 13 inches (e.g., about 13½ inches). The base portion can be disposed on a hexagonally shaped foundation that is about 36 inches wide between opposing parallel edges and about 41 inches (e.g., about 41¼ inches) wide between opposing vertices of the hexagon. Each side edge of the foundation can have a length of about 21 inches.

In another example, a pommel portion can have a height, from an upper surface of the support member to a top of the elongate pommel segments, of about 5 inches (e.g., 5¼ inches). The pommel portion can have a width between inner edges of support posts of about 8 inches (e.g., about 7¾ inches). A hexagon-shaped pommel portion can have sides that are about 10 inches (e.g., 9¾ inches) in length between vertices. The plurality of elongate pommel segments can have a perimeter (from a top view) with a width of about 17 inches (e.g., 17⅛ inches) between opposing parallel sides of the perimeter and a width of about 20 inches (e.g., 19⅝ inches) between opposing vertices of the perimeter. The support member can be hexagon-shaped and can have a width of about 22 inches (e.g., 22½ inches) between opposing vertices of the hexagon, and a width of about 20 inches (e.g., 19⅝ inches) between opposing parallel edges of the hexagon. A side edge of the hexagon-shaped support member can be about 11 inches (e.g., about 11¼ inches) in length.

What is claimed is:

1. An apparatus, comprising:

a pommel portion to be included in a pommel horse training apparatus, the pommel portion configured for a user to execute a pommel horse gymnastic routine thereon, the pommel portion including a plurality of pommel segments, a support member and a plurality of support posts, the plurality of pommel segments being coupled together to form a closed polygonal shape having an open center, each pommel segment from the plurality of pommel segments being elongate and having a centerline that is substantially coplanar with and non-parallel to a centerline of an adjacent pommel segment from the plurality of pommel segments, the support member having an upper surface and a lower surface, the upper surface being substantially planar from a first side of the pommel portion to a second side of the pommel portion opposite the first side of the pommel portion, the lower surface of the support member configured to be disposed on a base portion and configured to be coupled to the base portion, the plurality of support posts coupling the plurality of pommel segments to the support member such that the plurality of pommel segments are is spaced apart from the upper surface of the support member.

2. The apparatus of claim 1, further comprising:

the base portion, the base portion being coupled to the pommel portion, the base portion including a first end portion on which the support member of the pommel portion is disposed, a second end portion opposite the first end portion and configured to be disposed on a support surface, and a plurality of sidewalls extended from the first end portion to the second end portion so that a flat outer surface of each sidewall from the plurality of sidewalls is non-perpendicular to the upper surface of the support member.

3. The apparatus of claim 2, further comprising:

a mat having an inner perimeter defining an opening, the opening of the mat configured to receive therein at least a portion of the base portion, the inner perimeter of the mat having a shape complementary to an outer perimeter shape of the second end portion of the base portion.

4. The apparatus of claim 3, wherein a shape of the inner perimeter of the mat is a hexagon, an outer perimeter of the mat is in the shape of a polygon different than the hexagon.

5. The apparatus of claim 1, further comprising:

the base portion, the base portion including a first end portion and a second end portion and a sidewall extended from the first end portion to the second end portion, the support member being disposed on and coupled to the first end portion of the base portion, the second end portion configured to be disposed on a support surface, the second end portion of the base portion having a maximum width that is greater than a maximum width of the first end portion of the base portion.

6. The apparatus of claim 5, wherein an outer perimeter of the first end portion of the base portion has the polygonal shape, from a top view, and an outer perimeter of the second end portion of the base portion has the polygonal shape, from a top view.

7. The apparatus of claim 1, wherein the closed polygonal shape is a hexagon, the open center is defined by an inner perimeter of the hexagon.

8. The apparatus of claim 1, wherein a number of support posts of the plurality of support posts equals a number of pommel segments of the plurality of pommel segments.

9. The apparatus of claim 1, wherein the support member includes a pad disposed about at least a portion of an outermost perimeter of the support member.

10. The apparatus of claim 1, wherein:

the plurality of pommel segments defines an inner perimeter from a top view of the pommel portion, a surface of the support member and the inner perimeter defined by the plurality of pommel segments collectively define, from the top view of the pommel portion, an interior region, the pommel portion including a pad disposed on the surface of the support member within the interior region.

11. The apparatus of claim 1, wherein:

the support member, the plurality of posts and the plurality of pommel segments collectively define an interior volume, and the pommel portion includes a pommel distinct and spaced apart from the plurality of pommel segments, the pommel is at least partially disposed within the interior volume.

12. The apparatus of claim 1, wherein:

the support member, the plurality of posts and the plurality of pommel segments collectively define an interior volume, and the pommel portion includes a padded pommel at least partially disposed within the interior volume, the padded pommel is distinct from the plurality of pommel segments, the padded pommel includes an inner pommel and an outer pad, the outer pad is disposed over at least upper and side surfaces of the inner pommel, the padded pommel has a cross-sectional diameter that is greater than a cross-sectional diameter of each pommel segment from the plurality of pommel segments.

13. An apparatus, comprising:

a pommel portion including a plurality of pommel segments and a plurality of support posts coupled to the plurality of pommel segments, the pommel portion configured for a user to execute a pommel horse gymnastic maneuver thereon, the plurality of pommel segments being linearly arranged on a substantially common geometric plane, each pommel segment from the plurality of pommel segments being elongate and having a substantially cylindrical body portion between a first end portion and a second end portion thereof, the plurality of pommel segments being coupled together to form a closed polygonal shape having an open center, the plurality of support posts being substantially orthogonal to the substantially common geometric plane; and a base portion, the pommel portion disposed on top of and coupled to the base portion, the base portion including a plurality of sidewalls, each sidewall from the plurality of sidewalls coupled on a first side thereof to a side of a first adjacent sidewall and coupled on a second side thereof, opposite to the first side, to a side of a second adjacent sidewall, each sidewall from the plurality of sidewalls having a planar outer surface that is non-parallel and non-perpendicular to the substantially common geometric plane.

14. The apparatus of claim 13, wherein:

the pommel portion has an outer perimeter and an inner perimeter, each of the outer perimeter of the pommel portion and the inner perimeter of the pommel portion is hexagonal, the inner perimeter defining the open center, and an outer perimeter of the base portion is hexagonal, the base portion has a first end portion and a second end portion, the first end portion of the base portion is between the second end portion of the base portion and the pommel portion, the outer perimeter of the base portion at the first end portion is smaller than the outer perimeter of the base portion at the second end portion, the outer perimeter of the pommel portion is smaller than the outer perimeter of the base portion at the second end portion.

15. The apparatus of claim 13, wherein:

the plurality of support posts has a height of up to about 12 inches, and the pommel portion has a maximum width of about 12 inches to about 24 inches.

16. A gymnastic training apparatus, comprising:

a pommel portion including a plurality of pommel segments, a plurality of posts, and a support member, the plurality of pommel segments forming a geometric shape that is closed, each pommel segment from the plurality of pommel segments having a centerline disposed substantially on a geometric plane, the plurality of posts coupled to the plurality of pommel segments so that each post from the plurality of posts is substantially orthogonal to the centerline of each pommel segment from the plurality of pommel segments, the plurality of posts coupled to the support member so that each post from the plurality of posts is substantially orthogonal to a horizontal plane of an upper surface of the support member, an outer perimeter of the support member, from a top view, having the geometric shape, the plurality of pommel segments having an inner perimeter defining an opening within the closed geometric shape that is continuous across the geometric plane; and a base portion coupled to the pommel portion, the base portion including a plurality of sidewalls, each sidewall from the plurality of sidewalls having a flat outer surface that is non-perpendicular to the geometric plane, the plurality of sidewalls being coupled together so that a lower end portion of the base portion has a maximum width that is greater than a maximum width of an upper end portion of the base portion.

17. The apparatus of claim 16, wherein the geometric shape is a hexagon, an outer perimeter of the upper end portion of the base portion is hexagonal, an outer perimeter of the lower end portion of the base portion is hexagonal, each sidewall from the plurality of sidewalls is trapezoidal, and an outer perimeter of the support member is hexagonal.

18. The apparatus of claim 16, wherein a lower surface of the support member is disposed on the base portion, the apparatus further comprising:

a fastener removably coupling the support member to the base portion, the fastener being disposed through at least a portion of the support member between the upper surface of the support member and the lower surface of the support member, the fastener being disposed through at least a portion of a surface of the upper end portion of the base portion.

19. The apparatus of claim 16, wherein:

the base portion has a height within the range of about 2 inches to about 30 inches, the plurality of support posts has a height of up to about 12 inches, and the pommel portion has a maximum width of about 12 inches to about 24 inches.

20. The apparatus of claim 16, further comprising:

a sensor unit disposed in the opening of the plurality of pommel segments, the sensor unit configured to detect at least one of (1) a threshold amount of pressure caused by contact of a user with the sensor unit, (2) proximity, within a predetermined distance, of a user with a portion of the sensor unit, or (3) a threshold amount of movement of the sensor unit with respect to the pommel portion, the sensor unit configured to produce a signal in response to detection of the at least one of the threshold amount of pressure, the proximity or the threshold amount of movement.

* * * * *